US008165498B2

(12) United States Patent
Hoshino et al.

(10) Patent No.: US 8,165,498 B2
(45) Date of Patent: Apr. 24, 2012

(54) IMAGE FORMING DEVICE

(75) Inventors: Seiji Hoshino, Kanagawa (JP); Toshiyuki Andoh, Kanagawa (JP); Takashi Hodoshima, Kanagawa (JP); Takashi Hashimoto, Kanagawa (JP); Hidetaka Noguchi, Hyogo (JP); Tatsuhiko Oikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 786 days.

(21) Appl. No.: 12/230,134

(22) Filed: Aug. 25, 2008

(65) Prior Publication Data

US 2009/0116860 A1 May 7, 2009

(30) Foreign Application Priority Data

Sep. 3, 2007 (JP) ..... 2007-228005

(51) Int. Cl.
*G03G 15/08* (2006.01)

(52) U.S. Cl. ..... 399/121; 399/66; 399/388

(58) Field of Classification Search ..... 399/66, 399/121, 388, 389
See application file for complete search history.

(56) References Cited

U.S. PATENT DOCUMENTS 5,623,329 A * 4/1997 Yamauchi et al. ..... 399/314
2007/0269230 A1 11/2007 Hoshino et al.

FOREIGN PATENT DOCUMENTS

| | | |
|---|---|---|
| JP | 56-47639 | 7/1981 |
| JP | 61-090167 | 5/1986 |
| JP | 04-242276 | 8/1992 |
| JP | 06-274051 | 9/1994 |
| JP | 2005-316320 | 11/2005 |
| JP | 2006-293132 | 10/2006 |
| JP | 2008-040328 | 2/2008 |

* cited by examiner

*Primary Examiner* — David Gray
*Assistant Examiner* — Roy Y Yi
(74) *Attorney, Agent, or Firm* — Harness, Dickey & Pierce, P.L.C.

(57) ABSTRACT

An image forming device is disclosed that is able to enlarge a gap of a nipping portion with a simple and inexpensive structure, and able to reduce impact when a front end of a recording sheet runs into or a back end of the recording sheet passes through the nipping portion. The image forming device includes an image carrying unit, an image forming unit, a transfer unit, a conveyance unit, a determination unit that determines whether a thickness of the recording sheet is greater than a threshold value, and a cam member that rotates to enlarge or reduce the gap of the nipping portion between the image carrying unit and the transfer unit according to rotational positions of the cam member. When the thickness of the recording sheet is greater than the threshold, the cam member rotates so that the gap of the nipping portion is enlarged.

11 Claims, 38 Drawing Sheets

Immediately before entrance of recording sheet

During transfer

IMAGE FORMING DEVICE

BACKGROUND OF THE INVENTION

1. Field of the Invention

The present invention relates to an electrophotographic image forming device such as a copier, a printer, or a facsimile machine, specifically, an image forming device able to reduce impact when a front end of a recording sheet runs into a space between an image carrier, an image transfer unit and a fusing unit, or when a back end of the recording sheet passes through the nipping portion.

2. Description of the Related Art

In an electrophotographic image forming device of the related art, like a copier, a printer, or a facsimile machine, a toner image is carried on a photoconductive drum or a transfer belt while being conveyed, and a transfer roller presses a recording sheet, like recording paper, against the transfer belt to transfer the toner image to the recording sheet. When a front end of the recording sheet runs into a nipping portion between the transfer belt and the transfer roller, the front end of the recording sheet collides with the transfer belt, and this may cause a temporary increase or decrease of the conveyance speed of the transfer belt.

In recent years, image forming devices having a transfer and fusing unit have been developed. For example, in one kind of such image forming device, a pre-heating unit heats the recording sheet immediately before the transfer roller presses the recording sheet against the transfer belt, thereby, transfer and fusing are carried out at the same time and at the same position; in an additional kind of image forming device, another intermediate image carrier at the next stage presses the recording sheet against the transfer belt to touch the toner image, and an over-heating unit is provided to heat the toner image in advance at a position before transfer so as to melt the toner beforehand and fuse the toner image at the transfer position.

In such kinds of devices, similarly, at the nipping portion, the front end of the recording sheet may collide with the transfer and fusing unit, and this may cause a temporary increase or decrease of the conveyance speed of the transfer and fusing unit. This phenomenon is noticeable when the recording sheet is thick.

In an image transfer device or an image transfer and fusing device that transfers the toner image on the transfer belt or the intermediate image carrier to the recording sheet, the temporary increase or decrease of the conveyance speed influences cleaning, exposure, and developing processes when these processes are performed on the surface of the same transfer belt. This causes image defects, also known as banding, like lines in the main scanning direction, and stripe-like dark and light color unevenness in the sub scanning direction.

To solve this problem, in an image forming device of the related art, according to the thickness of the recording sheet, a specified gap smaller than the recording sheet thickness is formed in the nipping portion between the transfer belt and the transfer roller.

For example, Japanese Laid Open Patent Application No. 61-90167 (hereinafter, referred to as "reference 1") discloses an image forming device in which a gap is formed between a photoconductive drum and a pressure roller to reduce impact when the recording sheet runs into the space between the photoconductive drum and the pressure roller.

In addition, Japanese Laid Open Utility Model Application No. 56-47639 (hereinafter, referred to as "reference 2") discloses an image forming device in which a depressed groove is formed between a driving roller and a driven roller to reduce impact when the recording sheet runs into the space between the driving roller and the driven roller.

In addition, Japanese Laid Open Patent Application No. 6-274051 (hereinafter, referred to as "reference 3") discloses an image forming device in which rotation unevenness of a dielectric drum carrying an image is reduced by enlarging a gap between the dielectric drum and a pressure roller when a recording sheet runs into the gap; on the other hand, when an image is not formed on the dielectric drum, in synchronization with the timings when the recording sheet runs into a nipping portion between the dielectric drum and the pressure roller, the dielectric drum and the pressure roller are pressed to contact each other to close the gap in the nipping portion by a driving force from a driving unit for driving the dielectric drum.

In addition, Japanese Laid Open Patent Application No. 4-242276 (hereinafter, referred to as "reference 4") discloses an image forming device in which there are provided a dielectric drum, a pressure roller, a swinging arm which supports the pressure roller, an eccentric cam which drives the swinging arm up and down, and a motor which rotates the eccentric cam, and due to a downward action of the swing arm caused when the motor rotates the eccentric cam, a gap of a nipping portion between the dielectric drum and the pressure roller is enlarged according to the thickness of the recording sheet being conveyed, thereby adjusting the level of push-down of the pressure roller.

However, in the image forming device of the related art, because the swinging arm which supports the pressure roller, the eccentric cam, and the motor are provided, and the amount of push-down of the pressure roller is adjusted to form a gap between the dielectric drum and the pressure roller, the mechanism for forming the gap between the dielectric drum and the pressure roller in the nipping portion is complicated, and a large number of parts is required.

SUMMARY OF THE INVENTION

The present invention may solve one or more problems of the related art.

A preferred embodiment of the present invention may provide an image forming device able to enlarge a gap of a nipping portion between a dielectric drum and a pressure roller with a mechanism having a simple and inexpensive structure, and able to reduce impact when a front end of a recording sheet runs into or when a back end of the recording sheet passes through the nipping portion.

According to a first aspect of the present invention, there is provided an image forming device, comprising:

an image carrying unit that, while rotating, carries an image;

an image forming unit that forms the image on a surface of the image carrying unit;

a transfer unit that transfers an image formed on the surface of the image carrying unit to a recording sheet while rotating and being in contact with the image carrying unit;

a conveyance unit that conveys the recording sheet to a nipping portion between the image carrying unit and the transfer unit;

a determination unit that determines whether a thickness of the recording sheet conveyed by the conveyance unit is greater than a predetermined threshold value;

a cam member that rotates with respect to a rotational axis of the transfer unit, and enlarges or reduces a gap of the nipping portion between the image carrying unit and the transfer unit according to a rotational position of the cam member, wherein when the determination unit determines that the thickness of the recording sheet is greater than the predetermined threshold value, the cam member rotates so that the gap of the nipping portion is enlarged.

According to a second aspect of the present invention, there is provided an image forming device, comprising:

an image carrying unit that, while rotating, carries an image;

an image forming unit that forms the image on a surface of the image carrying unit;

a transfer and fusing unit that transfers an image formed on the surface of the image carrying unit to a recording sheet while rotating and being in contact with the image carrying unit, and fuses the image on the recording sheet;

a conveyance unit that conveys the recording sheet to a nipping portion between the image carrying unit and the transfer and fusing unit;

a determination unit that determines whether a thickness of the recording sheet conveyed by the conveyance unit is greater than a predetermined threshold value;

a cam member that rotates with respect to a rotational axis of the transfer and fusing unit, and enlarges or reduces the gap of the nipping portion between the image carrying unit and the transfer unit according to a rotational position of the cam member, wherein when the determination unit determines that the thickness of the recording sheet is greater than the predetermined threshold value, the cam member rotates so that the gap of the nipping portion is enlarged.

According to the above embodiments, when the thickness of the recording sheet is greater than the predetermined threshold value, the cam member, which rotates with respect to a rotational axis of the transfer unit or the transfer and fusing unit, rotates so that the gap of the nipping portion is enlarged, the arm for supporting the transfer unit or the transfer and fusing unit as disclosed in reference 4 is not necessary, thus it is possible to enlarge the gap of a nipping portion between the image carrying unit and the transfer unit or the transfer and fusing unit with a mechanism having a simple and inexpensive structure, and to reduce impact when a front end of a recording sheet runs into or when a back end of the recording sheet passes through the nipping portion.

As an embodiment, the cam member includes a first portion having a first external radius and a second portion having a second external radius, said first external radius being longer than a radius of the transfer unit with the rotational axis of the transfer unit as a center, said second external radius being shorter than the radius of the transfer unit with the rotational axis of the transfer unit as a center.

According to this embodiment, it is possible to enlarge a gap of a nipping portion for nipping the recording sheet with a mechanism having a simple and inexpensive structure, and to reduce impact when a front end of a recording sheet runs into or when a back end of the recording sheet passes through the nipping portion.

As an embodiment, the cam member includes a first portion having a first external radius and a second portion having a second external radius, said first external radius being longer than a radius of the transfer unit with the rotational axis of the transfer unit as a center, said second external radius being equal to the radius of the transfer unit with the rotational axis of the transfer unit as a center.

According to this embodiment, since the second external radius of the second portion of the cam member is equal to the radius of the transfer unit, the difference between the first external radius of the first portion of the cam member and the second external radius of the second portion of the cam member is small, and a nipping pressure between the image carrying unit and the transfer unit when enlarging the gap of the nipping portion changes smoothly; hence it is possible to greatly reduce stripe-like dark and light color unevenness and image defects, such as image deviation, which is also known as banding.

As an embodiment, an outside surface of the cam member includes a surface of the first portion, a surface of the second portion, and an inclined surface joining an end of the surface of the first portion and an end of the surface of the second portion.

According to this embodiment, since an inclined surface joining an end of the surface of the first portion and an end of the surface of the second portion is provided on the outside surface of the cam member, it is possible to reduce impact when enlarging or reducing a gap of a nipping portion between the image carrying unit and the transfer unit or the transfer and fusing unit.

As an embodiment, the inclined surface portion is formed of an elastic material having low resilience.

According to this embodiment, since the inclined surface portion is formed of an elastic material having low resilience, it is possible to reduce impact when enlarging or reducing a gap of a nipping portion between the image carrying unit and the transfer unit or the transfer and fusing unit.

As an embodiment, the first portion is formed of a material having a Young's modulus higher than the Young's modulus of the inclined surface portion.

According to this embodiment, since the first portion is formed of a material having a Young's modulus higher than the Young's modulus of the inclined surface portion, for example, the Young's modulus of nylon 6-6 (PA) is 3.0 GPa, the Young's modulus of polyacetal (POM) homopolymer is 3.2 GPa, these materials satisfy this requirement.

When a fusing unit of the transfer and fusing unit such as a heater is present, heat is transferred from a fusing opposite roller to a cam projection portion so that the distance between the fusing opposite roller and a secondary transfer roller changes due to thermal expansion and shrinkage. For this reason, it is required that the material of the cam projection portion have a very low linear expansion coefficient, and the material of the cam projection portion be appropriately selected taking into account the fusing and heating temperature and heat to be transferred. Therefore, in some cases, at a high temperature, iron, stainless and other metal materials are preferable rather than resin materials.

In the present embodiment, since the first portion is formed of a material having a Young's modulus higher than the Young's modulus of the inclined surface portion, it is possible to reduce the change of stress occurring when enlarging or reducing the gap of a nipping portion between the image carrying unit and the transfer unit or the transfer and fusing unit, and it is possible maintain the distance between the fusing opposite roller and a secondary transfer roller to be at high precision.

As an embodiment, the cam member is provided on a portion of the transfer unit not contacting the recording sheet.

As an embodiment, plural of the cam members are provided on two ends of the transfer unit, respectively, and the cam members on the two ends of the transfer unit rotate at the same speed.

As an embodiment, the cam members on the two ends of the transfer unit have the same first portion, the same first external radius, the same second portion, the same second external radius, and the cam members rotate so that rotational phases of the first portions of the cam members are the same.

As an embodiment, the cam members on the two ends of the transfer unit have the same first portion, the same first external radius, the same second portion, and the same second external radius, and the cam members rotate so that rotational phases of the first portions of the cam members differ from each other.

As an embodiment, the cam members on the two ends of the transfer unit have the same first portion, the same first external radius, and the same second external radius, the second portions of the cam members have different lengths, and the cam members rotate so that rotational phases of the first portions of the cam members are the same.

As an embodiment, the cam members on the two ends of the transfer unit have the same first external radius, the same second external radius, and the same second portion, the first portions of the cam members have different lengths, and the cam members rotate so that rotational phases of the second portions of the cam members are the same.

As an embodiment, the cam members on the two ends of the transfer unit have the same second external radius and the same second portion, the first external radii of the first portions of the cam members are different from each other, the first portions of the cam members have different lengths, and the cam members rotate so that rotational phases of the second portions of the cam members are the same.

As an embodiment, the cam members on the two ends of the transfer unit have the same second external radius, the first external radii of the first portions of the cam members are different from each other, the first portions of the cam members have different lengths, the second portions of the cam members have different lengths, and the cam members rotate so that rotational phases of the first portions of the cam members are the same.

According to the above embodiments of the present invention, when the thickness of the recording sheet is greater than the predetermined threshold value, the cam member, which rotates with respect to a rotational axis of the transfer unit or the transfer and fusing unit, rotates so that the gap of the nipping portion is enlarged, the arm for supporting the transfer unit or the transfer and fusing unit as disclosed in reference 4 is not necessary, thus it is possible to enlarge the gap of a nipping portion between the image carrying unit and the transfer unit or the transfer and fusing unit with a mechanism having a simple and inexpensive structure, and to reduce impact when a front end of a recording sheet runs into or when a back end of the recording sheet passes through the nipping portion.

These and other objects, features, and advantages of the present invention will become more apparent from the following detailed description of preferred embodiments given with reference to the accompanying drawings.

BRIEF DESCRIPTION OF THE DRAWINGS

FIG. 4 shows an operational state of the cam member of the present embodiment;

FIG. 5 shows an operational state of the cam member of the present embodiment subsequent to that shown in FIG. 4;

DESCRIPTION OF THE PREFERRED EMBODIMENTS

Below, preferred embodiments of the present invention are explained with reference to the accompanying drawings.

Figure 1:
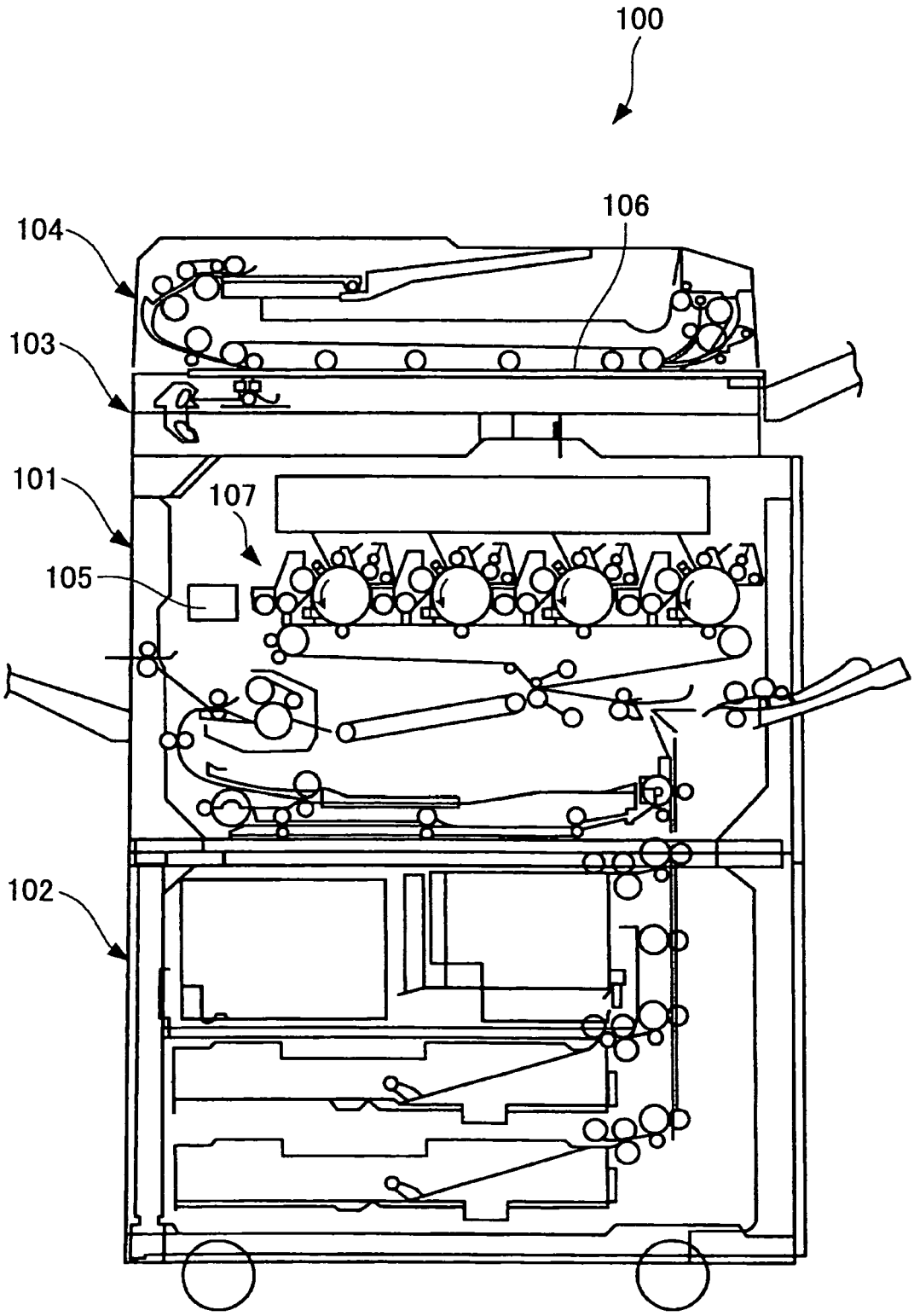
FIG. 1 is schematic cut-open view of an image forming device according to an embodiment of the present invention.

FIG. 1 is schematic cut-open view of an image forming device according to an embodiment of the present invention.

In the present embodiment, for example; the image forming device is a copier capable of color printing. It should be noted that the image forming device of the present embodiment may also be a printer, a facsimile machine, and a multifunction peripheral having functions of a copier, a facsimile machine, and others.

As shown in FIG. 1, an image forming device 100 of the present embodiment includes a printer 101, a paper-feeder 102, a scanner 103, an automatic document feeder 104, and a controller 105 for controlling operations of components of the image forming device 100. For example, the controller 105 is a CPU (Central Processing Unit).

The scanner 103 reads image information of a document placed on a contact glass 106, and includes a light source which emits light onto the document on the contact glass 106, and a reflecting mirror which directs light reflected from the document through an imaging lens to a photoelectric conversion element, like a CCD image scanner.

The printer 101 includes an intermediate transfer unit 107, and an exposure unit, an image forming unit, a fusing unit, a toner supplying unit, and others. The printer 101 transfers the image of the document obtained by the scanner 103 to a recording sheet, such as recording paper.

The paper-feeder 102 includes plural paper-feeding cassettes, or conveyance paths, and supplies the recording sheets held in the feeding cassettes to the intermediate transfer unit 107 through the conveyance paths.

Figure 2:
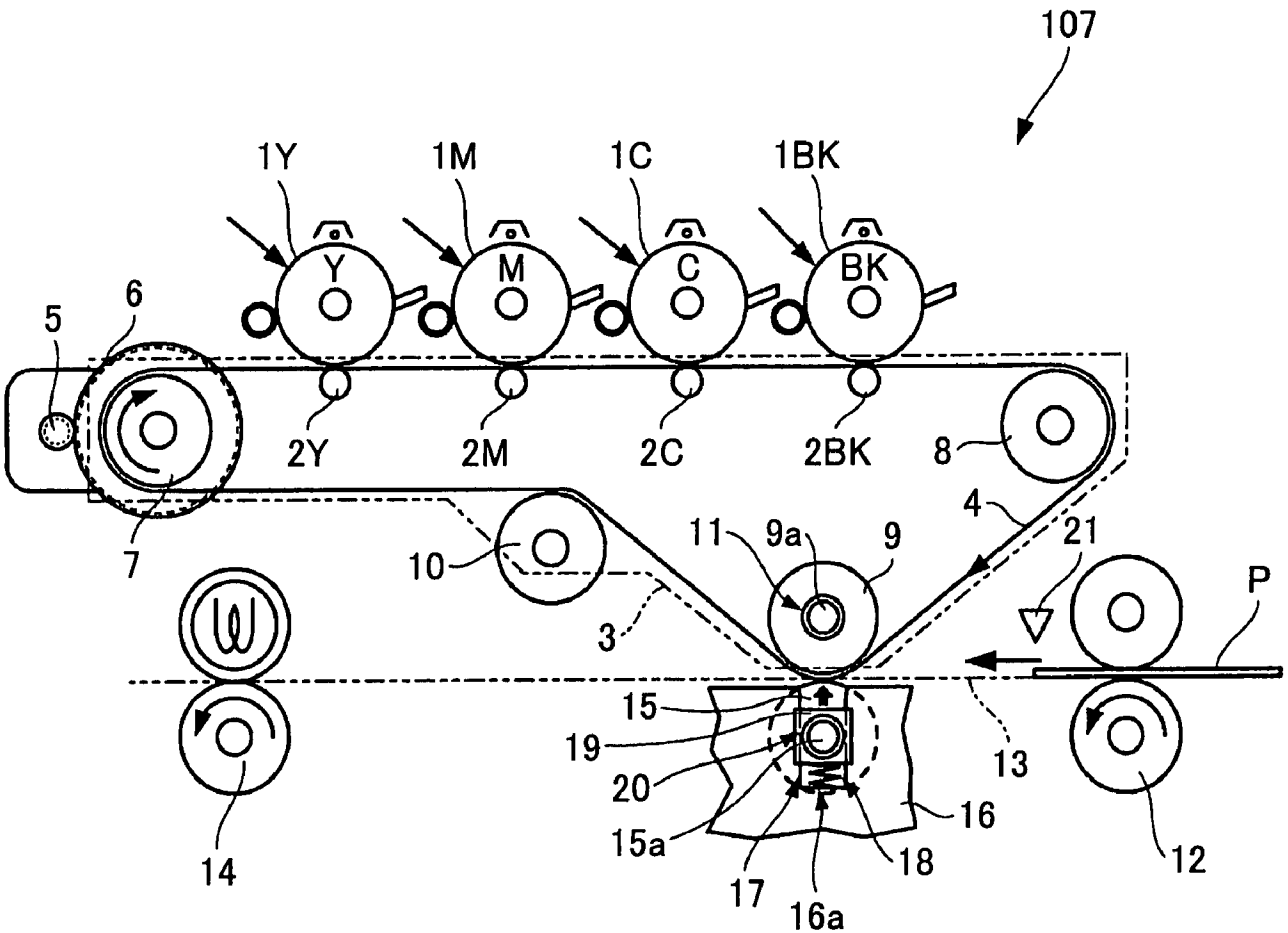
FIG. 2 is a schematic diagram of the intermediate transfer unit 107 of the image forming device according to the present embodiment of the present invention.

FIG. 2 is a schematic diagram of the intermediate transfer unit 107 of the image forming device according to the present embodiment of the present invention.

As shown in FIG. 2, an image forming unit 1Y, an image forming unit 1M, an image forming unit 1C, and an image forming unit 1BK form yellow, magenta, cyan, and black toner images, respectively, and perform primary transfer to transfer the obtained color toner image to an endless intermediate transfer belt 4.

The image forming unit 1Y, the image forming unit 1M, the image forming unit 1C, and the image forming unit 1BK correspond to the image forming unit in claims; however, the image forming unit of the present invention is not limited to these, but can be any device able to form images.

The intermediate transfer belt 4 is extended by a belt driving roller 7, a belt driven roller 8, an opposite roller 9, a belt supporting roller 10, and others. A belt driving motor 5 and a belt driving gear 6 drive the inscribing belt driving roller 7, and thereby, the intermediate transfer belt 4 rolls along a direction as indicated by an arrow in FIG. 2.

The intermediate transfer belt 4 or a photoconductive drum corresponds to the image carrying unit in claims; however, the image carrying unit of the present invention is not limited to these, but can be any device able to rotate in the conveyance direction of the recording sheet while carrying the toner image.

The recording sheet P is fed by a paper-separation mechanism or a conveyance unit (for example, the paper feeder 102), and is conveyed by a pair of resisting rollers 12 at desired timings, following a recording sheet conveyance path 13, so that the front end of the recording sheet P passes through a paper-resisting sensor 21, and is conveyed, together with the intermediate transfer belt 4, to a nipping portion between the opposite roller 9 and a secondary transfer roller 15.

The secondary transfer roller 15 corresponds to the transfer unit in claims; however, the transfer unit of the present invention is not limited to this, but can be any device having a cylindrical shape and able to transfer the toner image on the image carrier to the recording sheet while rotating in the conveyance direction of the recording sheet.

When the recording sheet P is conveyed to the nipping portion, the color toner image transferred onto the intermediate transfer belt 4 is transferred to the recording sheet P for the second transfer, and then the color toner image on the recording sheet P is heated and fused by a pair of fusing rollers 14, and then the recording sheet P is output.

Below, the structure around the secondary transfer roller 15 is explained.

Secondary transfer roller axles 15*a* at two ends of the secondary transfer roller 15 are supported by secondary transfer roller bearings 20; further, the outside surface of the secondary transfer roller bearing 20 is supported by a slide bearing holder 19.

The outside surface of the slide bearing holder 19 slides in a slide hole 17 formed on a main body side plate 16, allowing the secondary transfer roller 15 to have a degree of freedom in a normal direction, in which direction the secondary transfer roller 15 is in contact with the opposite roller 9. A pressing spring 18 is provided between the slide bearing holder 19 and a spring holder 16*a*. With this structure, when the recording sheet P arrives at the nipping portion, according to the thickness of the recording sheet P, the secondary transfer roller 15 slides downward in FIG. 2, namely, in the period when the front end and the back end of the recording sheet P pass through, the secondary transfer roller 15 moves up and down.

Figure 3:
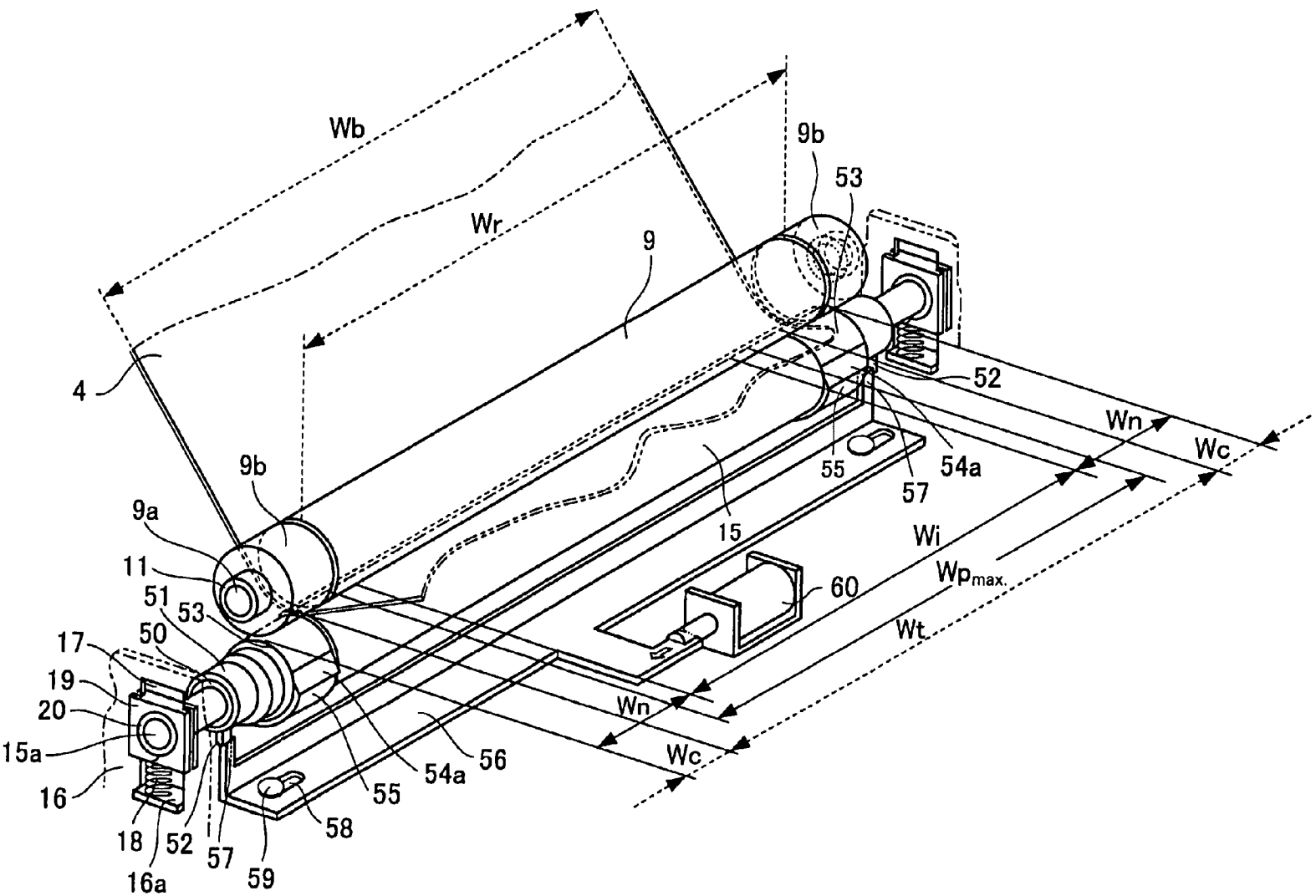
FIG. 3 is a perspective view illustrating a portion of the intermediate transfer unit 107 shown in FIG. 2 including the opposite roller 9 and the secondary transfer roller 15, where the cam member of the present embodiment is in a standby state.

FIG. 3 is a perspective view illustrating a portion of the image forming device according to the present embodiment including the opposite roller 9 and the secondary transfer roller 15. Specifically, FIG. 3 shows a standby state of the cam member of the present embodiment.

In the present embodiment, the portion around the opposite roller 9 and the secondary transfer roller 15 includes opposite roller side rings 9*b*, which are located at the two ends of the opposite roller 9 and rotate and slide with respect to the same axis of an axle 9*a* of the opposite roller 9, and cam rings 53, which face the opposite roller side rings 9*b* and rotate and slide with respect to the same axis of an axle 15*a* of the secondary transfer roller 15. The cam rings 53 are arranged at the two ends of the secondary transfer roller 15, which is not in contact with the recording sheet P.

The cam rings 53 corresponds to the cam member in claims, however, the cam member of the present invention is not limited to this, but can be any device able to rotate with respect to the same rotational axis as the transfer unit so as to increase the gap of the nipping portion.

In FIG. 3, the opposite roller 9, which has a width Wr in the main scan direction, stretches the intermediate transfer belt 4, which has a width Wb (namely, the width of the belt) in the main scan direction, and not-illustrated belt unit frames at two ends of the opposite roller 9 support the opposite roller axles 9*a* at the two ends.

As described above, the toner image is transferred to, by the primary transfer, and carried by the surface of the intermediate transfer belt 4. On the surface of the intermediate transfer belt 4, a region within the width Wi in the main scan direction defines an image region (the width Wi is referred to as "image region width"), and regions at the ends out of the image region define non-image regions Wn.

At the two ends of the secondary transfer roller 15, which has a width Wt in the main scan direction, there are the slide hole 17 formed on the main body side plate 16, and the slide bearing holder 19 sliding along the edge of the slide hole 17. The secondary transfer roller bearing 20 is attached to the slide bearing holder 19, and the secondary transfer roller axles 15*a* at the two ends of the secondary transfer roller 15 are supported by the secondary transfer roller bearing 20. The pressing spring 18 is provided between the bottom of the slide bearing holder 19 and the spring holder 16*a* to impose a pressure on the opposite roller 9.

As described above, FIG. 3 shows the cam member of the present invention in a standby state. Below, the standby state is explained.

Torque limiters 50, independently slide on the left and right ends of the secondary transfer roller 15, and torque limiter holders 51 are pressed in to fit the outside surface of the torque limiters 50.

Front inclined-portions 54*a*, cam projection portions 55, and back inclined-portions 54*b* (see FIG. 5) are formed on the outside surfaces of the cam rings 53, which are integrated with the torque limiter holders 51; the cam rings 53, the front inclined-portions 54*a*, the cam projection portions 55, and the back inclined-portions 54*b* are joined by adhesion, welding, fusing by means of press-fit, dual molding, tubing, and others, so that phase-shift in the rotational direction does not occur. The cam projection portions 55 correspond to "the first portion" in claims.

In the standby state shown in FIG. 3, there are latch claws 57 projecting at ends of a stopping plate 56, and because of the latch claws 57, rotation stopping claws 52 project up to the outside surface of the torque limiter holders 51; thereby, rotation of the cam rings 53 is stopped.

Figure 4:
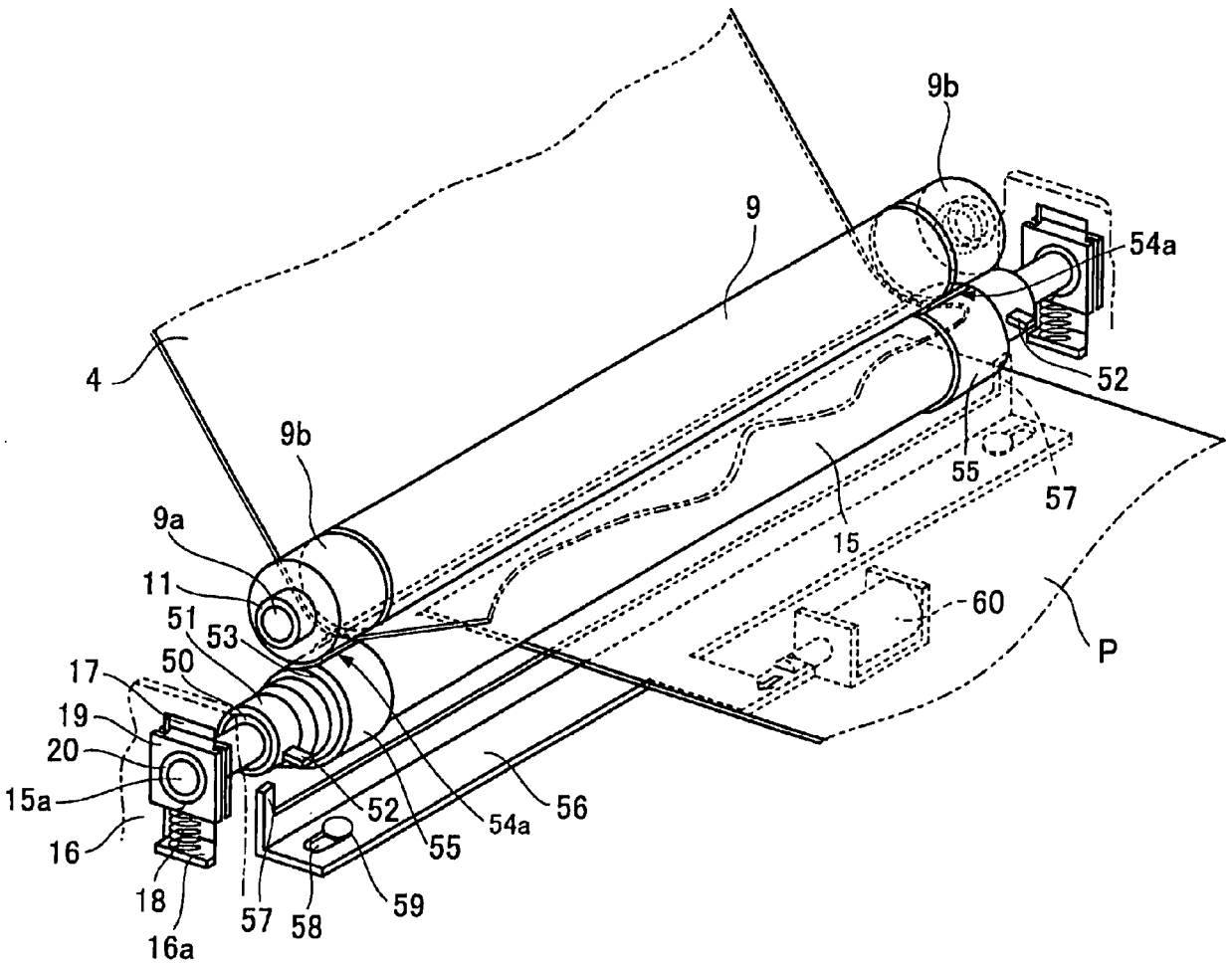
FIG. 4 is a perspective view illustrating the structure of a portion of the image forming device according to the present embodiment including the opposite roller 9 and the secondary transfer roller 15, specifically.

FIG. 4 is a perspective view illustrating the structure of a portion of the image forming device according to the present embodiment including the opposite roller 9 and the secondary transfer roller 15. Specifically, FIG. 4 shows an operational state of the cam member of the present embodiment.

Below, the operational state is explained.

There are two elongated holes 58 at corresponding positions near the left end and the right end of the stopping plate 56 and because of regulation by pins 59 fixed to the stopping plate 56, the stopping plate 56 is movable with a certain stroke in the horizontal (main scan) direction driven by a solenoid 60.

In FIG. 3, since usually the stopping plate 56 is more or less on the right side, the latch claws 57, which are at the right end and the left end of the stopping plate 56, latch the rotation stopping claws 52 on the right end and the left end to the outside of the torque limiter holders 51.

In FIG. 4, however, when the solenoid 60 is powered ON and starts to operate, as shown in FIG. 4, since the stopping plate 56 moves to the left side, the latch claws 57 release the rotation stopping claws 52 on the right side and the left side at the same time; hence, it is possible to rotate the torque limiter holders 51 and the cam rings 53 with a torque lower than a preset torque of the torque limiters 50.

Below, design considerations of the shapes of the latch claws 57 and the rotation stopping claws 52 are described.

Because of the shapes of the latch claws 57 and the rotation stopping claws 52 as shown in FIG. 4, the secondary transfer roller 15 and the secondary transfer roller axles 15*a* move up and down, and the torque limiter holders 51 and the rotation stopping claws 52 on the right side and the left side also move up and down. Since distances of the up-and-down movement on the right side and the left side may be different from each other, in order to rotate the cam rings 53 on the right side and the left side at the same time, it is necessary for the latch claws 57 on the right side and the left side to respectively release the rotation stopping claws 52 on the right side and the left side simultaneously at timings which are barely influenced by positions of the up-and-down movement. In the structure shown in FIG. 4, since the stopping plate 56 is shifted to the left side, the latch claws 57 are able to release the rotation stopping claws 52 on the right side and the left side simultaneously.

In the operational state shown in FIG. 4, the cam rings 53 rotate, and the front inclined-portions 54*a* are in contact with the opposite roller side rings 9*b*, thus the distance between the opposite roller axle 9*a* and the secondary transfer roller axle 15*a* begins to increase gradually (namely, the secondary transfer roller 15 is pushed down), but the recording sheet P has not reached the nipping portion.

Figure 5:
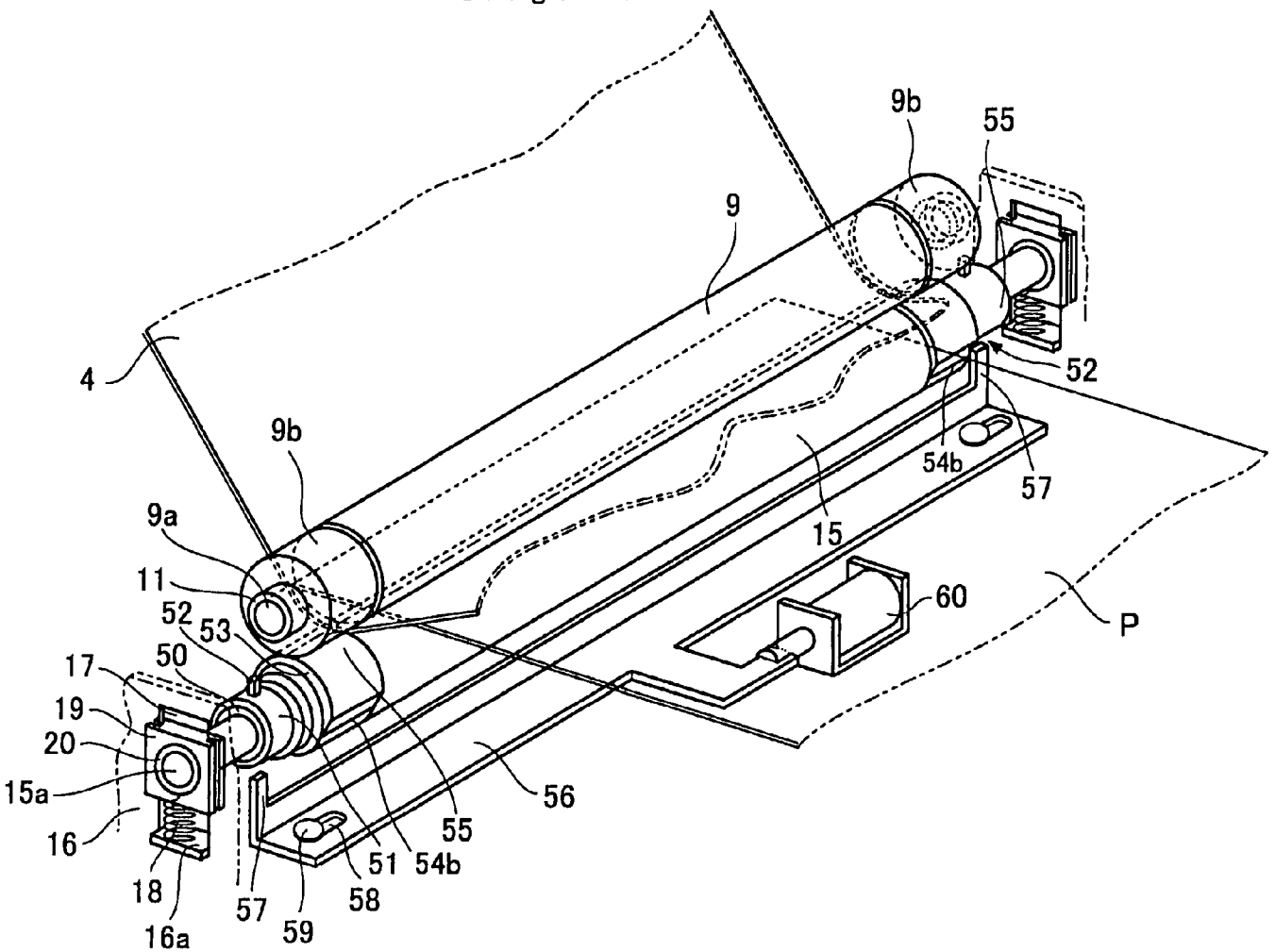
FIG. 5 is a perspective view illustrating the structure of a portion of the image forming device according to the present embodiment including the opposite roller 9 and the secondary transfer roller 15; specifically.

FIG. 5 is a perspective view illustrating the structure of a portion of the image forming device according to the present embodiment including the opposite roller 9 and the secondary transfer roller 15. Specifically, FIG. 5 shows an operational state of the cam member of the present embodiment subsequent to that shown in FIG. 4.

In FIG. 5, the cam rings 53 further rotate from the state shown in FIG. 4, and the cam projection portions 55 are in contact with the opposite roller 9, and the front end of the recording sheet P passes through the nipping portion. In this way, when the thickness of the recording sheet is greater than a certain threshold value, the cam rings 53 rotate to enlarge the gap of the nipping portion.

FIG. 6A through FIG. 6G are diagrams illustrating a sequence of rotational operations of the cam member of the present embodiment.

In the image forming device 100 includes a determination unit which determines whether the thickness of the recording sheet P being conveyed is greater than a given threshold value when the recording sheet P arrives at a preset position before the recording sheet P is nipped. When the determination unit determines the thickness of the recording sheet P is greater than the threshold value, the cam member of the present embodiment starts to operate. For example, in the present embodiment, the determination unit is implemented to be a controller 105.

When the determination unit determines that the thickness of the recording sheet P is below the threshold value, the latch claws 57 are latched, and the cam rings 53 are at rest without rotation; thus a transfer pressure reduction mode is not executed. For example, the thickness of the recording sheet P may be manually input to the image forming device 100 by a user, or may be the value automatically measured by a paper-thickness sensor.

Figure 6A:
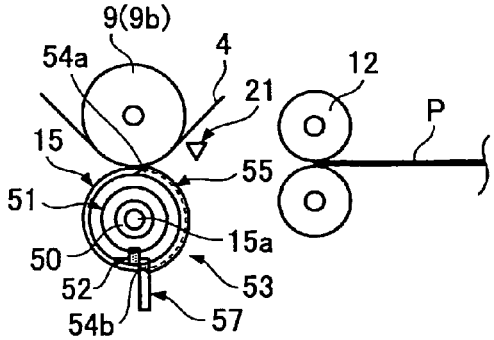
FIG. 6A through FIG. 6G are diagrams illustrating a sequence of rotational operations of the cam member of the present embodiment.

In FIG. 6A, when the resisting rollers 12 start to rotate, along with conveyance operation of the intermediate transfer belt 4, the opposite roller 9 starts to rotate and the secondary transfer roller 15 starts to rotate cooperatively. At this moment, since the rotation stopping claws 52 are latched by the latch claws 57, the torque limiters 50 slip, and the cam projection portions 55 are not in contact with the opposite roller side ring 9*b*, thus the cam rings 53 are at rest without rotation, namely, in the standby state.

Figure 6B:
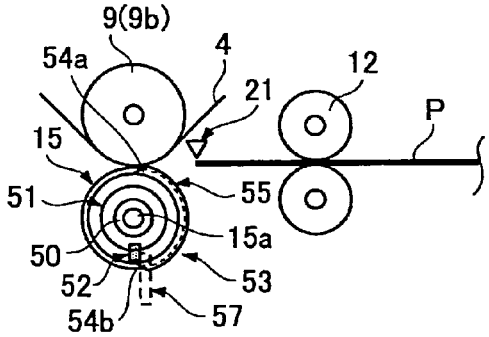

In FIG. 6B, when the paper-resisting sensor 21 detects that the front end of the recording sheet P arrives, and the thickness of the recording sheet P is greater than a given threshold value, along with operations of the solenoid 60, the latch claws 57 release the rotation stopping claws 52, and due to the transmission torque of the torque limiters 50, the torque limiter holders 51 and the cam rings 53 start to rotate counter-clockwise. Note that the paper-resisting sensor 21 may be arranged to detect the back end of the recording sheet P.

Figure 6C:
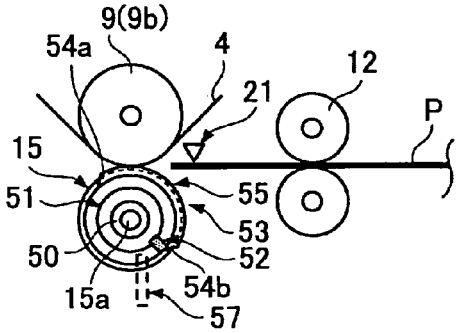

In FIG. 6C, the cam rings 53 further rotate, and the cam projection portions 55 are in contact with the opposite roller side rings 9*b*. At this time the opposite roller 9 and the secondary transfer roller 15 start to move apart from each other.

Figure 6D:
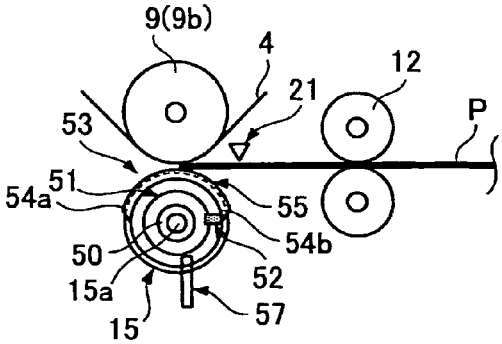

In FIG. 6D, the cam rings 53 further rotate, the recording sheet P is further conveyed, and the front end of the recording sheet P is nipped by the intermediate transfer belt 4 and the secondary transfer roller 15. At this time the opposite roller 9 and the secondary transfer roller 15 are completely separated from each other.

Figure 6E:
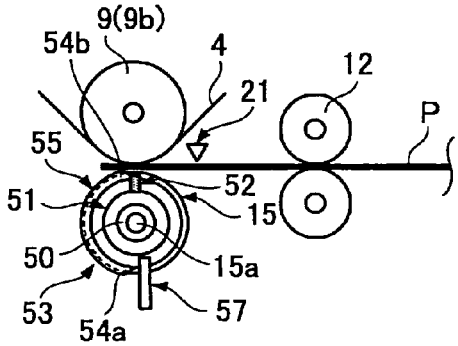

In FIG. 6E, the back inclined-portions 54*b* pass through the nipping portion between the opposite roller 9 and the secondary transfer roller 15, and thus, the recording sheet P is not influenced by the transfer pressure of the cam rings 53, that is, the cam member of the present embodiment.

Figure 6F:
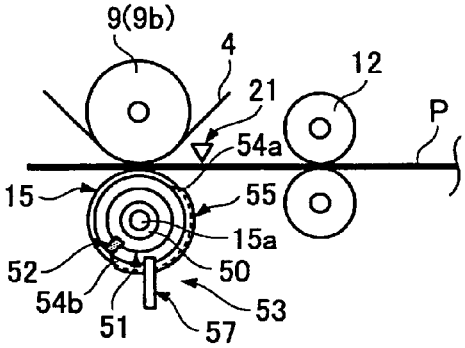

In FIG. 6F, the cam rings 53 further rotate counter-clockwise, and the latch claws 57 approach the rotation stopping claws 52 waiting to be latched.

Figure 6G:
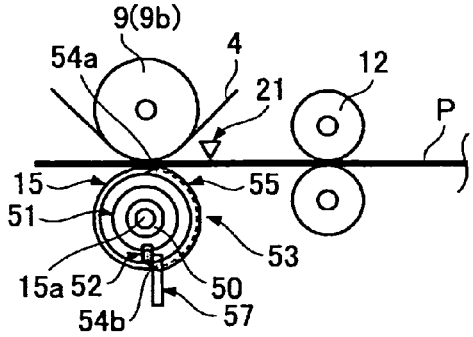

In FIG. 6G, the latch claws 57 are in contact with the rotation stopping claws 52 and latch the rotation stopping claws 52, and the cam rings 53 return to the positions shown in FIG. 6A, the standby state, without rotation.

FIG. 7, FIG. 8, FIG. 9, and FIG. 10 are cross-sectional views illustrating a portion of the image forming device according to the present embodiment including the opposite roller 9 and the secondary transfer roller 15 viewed from an upstream side when the recording sheet P having a maximum width Wpmax (referred to as "maximum recording sheet width") passes through the secondary transfer roller 15.

Specifically, FIG. 7, FIG. 8, FIG. 9, and FIG. 10 show the relationship between the recording sheet P having a maximum width WPmax (referred to as "maximum recording sheet width"), the front inclined-portions 54*a*, the back inclined-portions 54*b*, the opposite roller 9 having a width Wr (referred to as "opposite roller width"), the intermediate transfer belt 4 having a width Wb (referred to as "belt width"), and the secondary transfer roller 15 having a width Wt (referred to as "secondary transfer roller width").

The image region width Wi is slightly narrower than the maximum recording sheet width WPmax, and within the non-image region Wn there is an action area of the cam member in a transfer pressure adjustment region Wc, which is outside of the intermediate transfer belt 4.

It should be noted that although the opposite roller width Wr is illustrated to be equal to the secondary transfer roller width Wt, it is not necessary that the opposite roller width Wr be equal to the secondary transfer roller width Wt.

Figure 7:
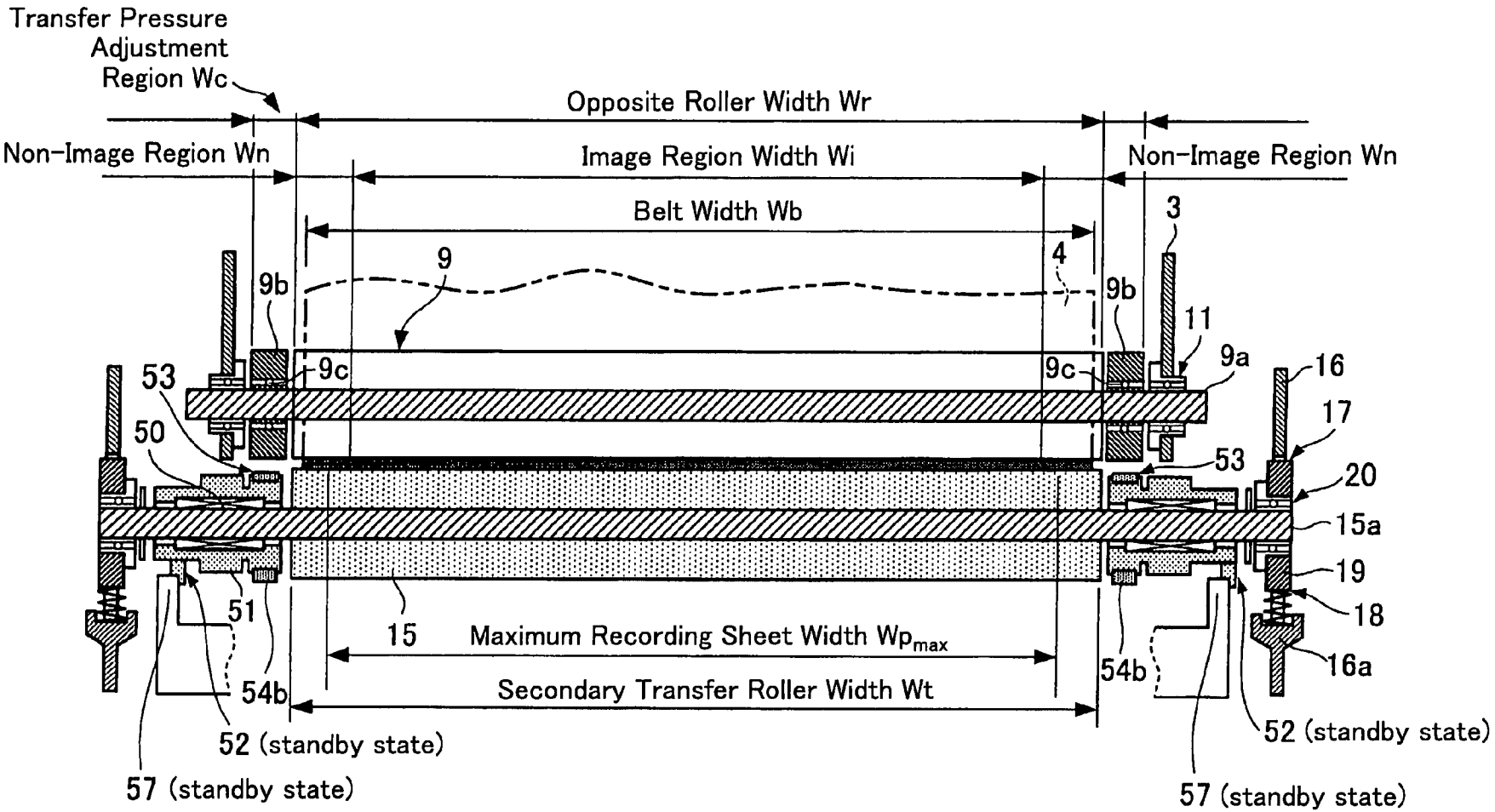
FIG. 7 is a cross-sectional view illustrating a portion of the image forming device according to the present embodiment including the opposite roller 9 and the secondary transfer roller 15 when the cam member of the present embodiment is in the standby state.

FIG. 7 is a cross-sectional view illustrating a portion of the image forming device according to the present embodiment including the opposite roller 9 and the secondary transfer roller 15 when the cam member of the present embodiment is in the standby state.

The state shown in FIG. 7 corresponds to the states shown in FIG. 6A and FIG. 6G.

Figure 8:
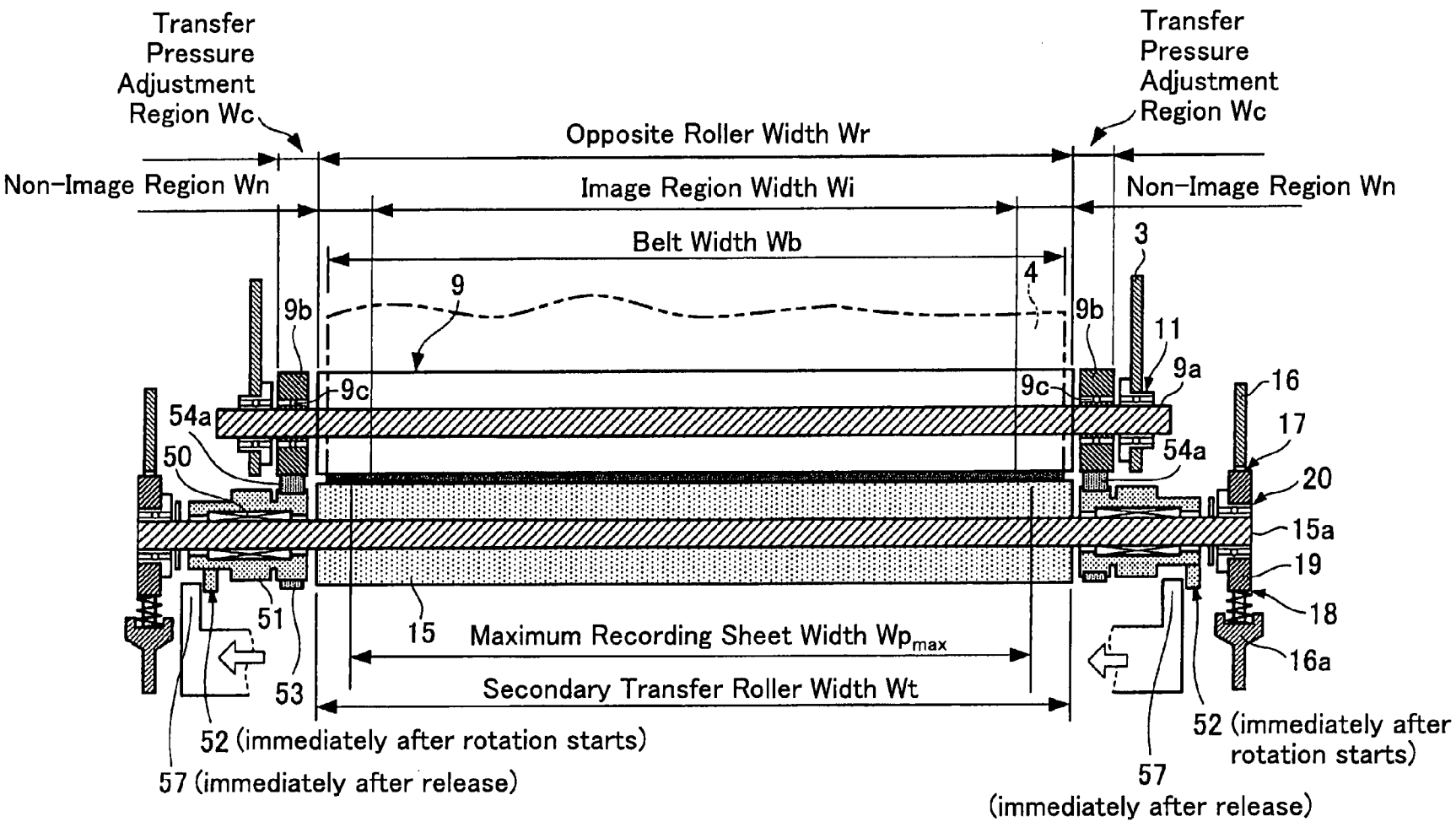
FIG. 8 is a cross-sectional view illustrating a portion of the image forming device according to the present embodiment including the opposite roller 9 and the secondary transfer roller 15 immediately before the recording sheet P runs into the nipping portion between the opposite roller 9 and the secondary transfer roller 15.

FIG. 8 is a cross-sectional view illustrating a portion of the image forming device according to the present embodiment including the opposite roller 9 and the secondary transfer roller 15 immediately before the recording sheet P runs into the nipping portion between the opposite roller 9 and the secondary transfer roller 15.

The state shown in FIG. 8 corresponds to the state shown in FIG. 6B.

Figure 9:
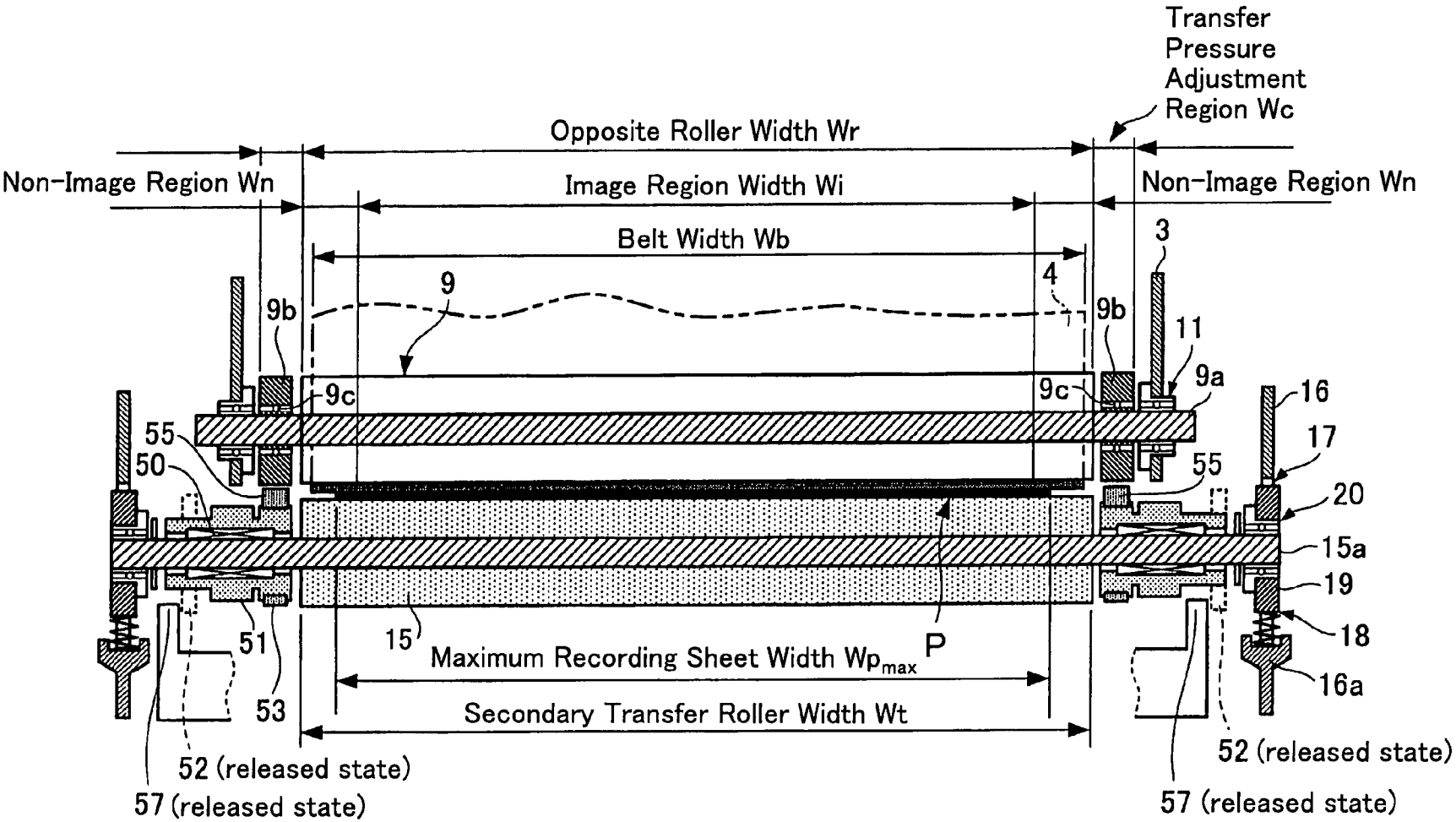
FIG. 9 is a cross-sectional view illustrating a portion of the image forming device according to the present embodiment including the opposite roller 9 and the secondary transfer roller 15 during transfer of the toner image.

FIG. 9 is a cross-sectional view illustrating a portion of the image forming device according to the present embodiment including the opposite roller 9 and the secondary transfer roller 15 during transfer of the toner image.

The state shown in FIG. 9 corresponds to the state shown in FIG. 6D.

Figure 10:
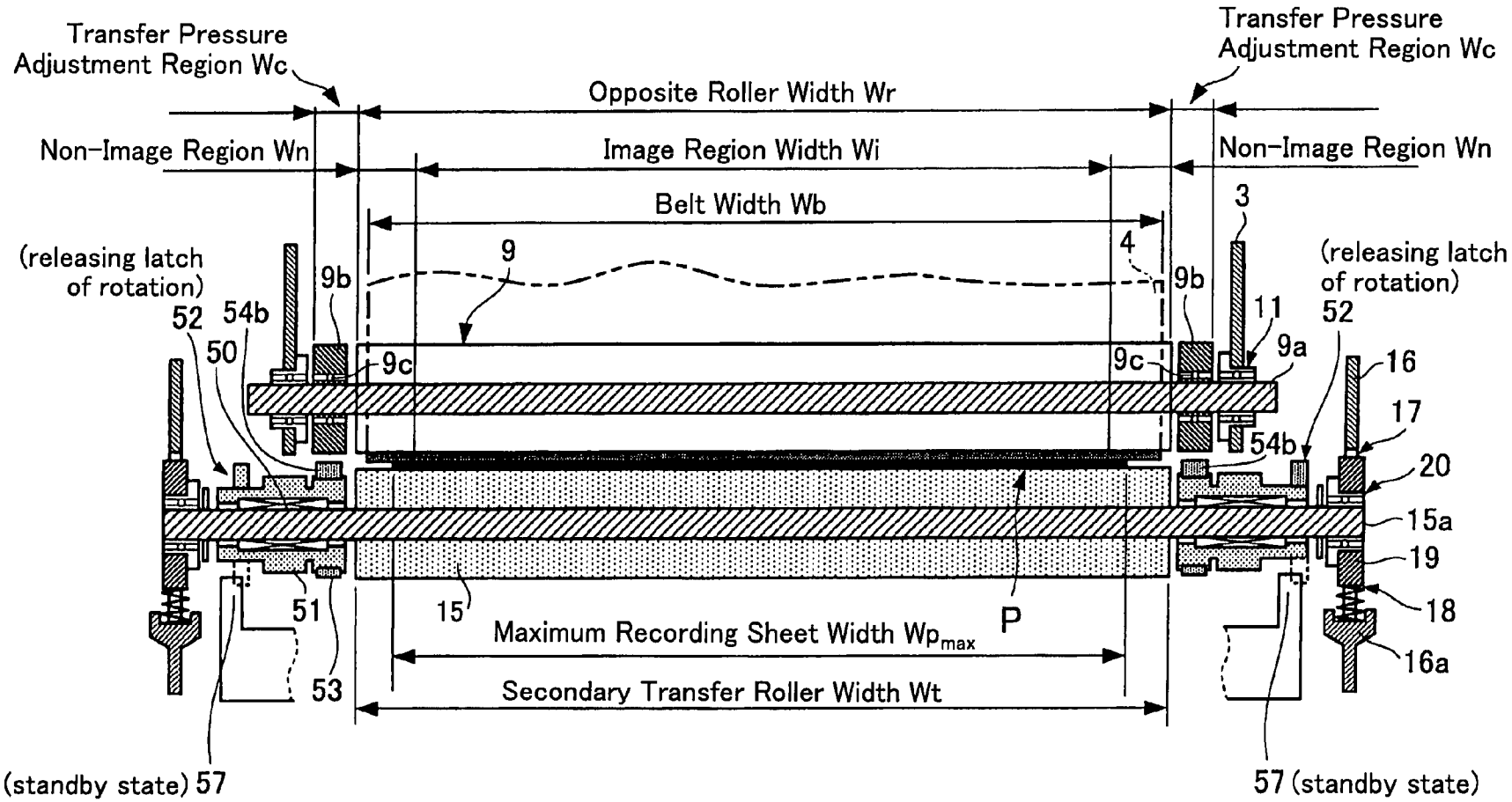
FIG. 10 is a cross-sectional view illustrating a portion of the image forming device according to the present embodiment including the opposite roller 9 and the secondary transfer roller 15 when the recording sheet P is nipped by the opposite roller 9 and the secondary transfer roller 15.

FIG. 10 is a cross-sectional view illustrating a portion of the image forming device according to the present embodiment including the opposite roller 9 and the secondary transfer roller 15 when the recording sheet P is nipped by the opposite roller 9 and the secondary transfer roller 15.

The state shown in FIG. 10 corresponds to the state shown in FIG. 6E.

FIG. 11A through FIG. 11D are diagrams illustrating dependence of the distance between the opposite roller axle 9*a* and the secondary transfer roller axle 15*a* on the rotational position of the cam rings 53.

In FIG. 11A through FIG. 11D, as shown in FIG. 3, FIG. 4, and FIG. 5, the outer surface of the cam ring 53 includes the surface of the cam projection portion 55, the surface of a peripheral portion 53*a* of the cam ring 53, the front inclined-portion 54*a* joining the cam projection portion 55 and the peripheral portion 53*a* of the cam ring 53, the back inclined-portion 54*b* joining the cam projection portion 55 and the peripheral portion 53*a* of the cam ring 53. The peripheral portion 53*a* of the cam ring 53 corresponds to "the second portion" in claims.

The cam ring 53 shown in FIG. 11A through FIG. 11D includes a portion constituted by the cam projection portion 55 having an external radius greater than the radius of the secondary transfer roller 15 with the secondary transfer roller axle 15*a* as a center, and a portion constituted by the peripheral portion 53*a* of the cam ring 53 having an external radius less than the radius of the secondary transfer roller 15 with the secondary transfer roller axle 15*a* as a center.

Figure 11A:
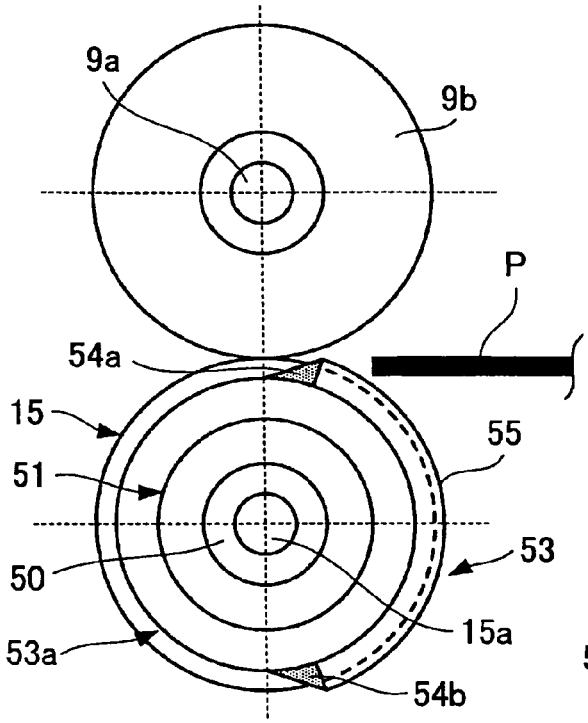
FIG. 11A through FIG. 11D are diagrams illustrating dependence of the distance between the opposite roller axle 9*a* and the secondary transfer roller axle 15*a* on the rotational position of the cam rings 53.

In FIG. 11A, before the recording sheet P arrives at the nipping portion, namely, at the time corresponding to the states shown in FIG. 6A and FIG. 7, the distance between the opposite roller axle 9*a* and the secondary transfer roller axle 15*a* is the minimum. At this moment, the secondary transfer roller 15 is driven to rotate by friction force with the opposite roller 9, which sandwiches the not-illustrated intermediate transfer belt 4.

Figure 11B:
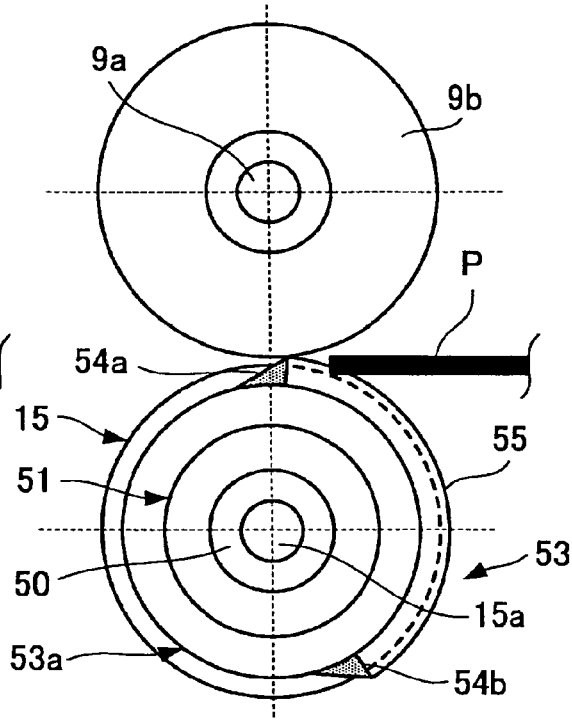

In FIG. 11B, before the recording sheet P arrives at the nipping portion, the upper-most portion of the inclined surface of the front inclined-portion 54*a*, which is joined to the peripheral portion 53*a* of the cam ring 53, is coming close to the nipping portion, and the opposite roller side ring 9*b* is in contact with the inclined surface of the front inclined-portion 54*a*, thus, the distance between the opposite roller axle 9*a* and the secondary transfer roller axle 15*a* is gradually enlarged.

At this moment, the source of torque transmission of the driven rotation of the secondary transfer roller 15 is changed to friction force transmission between the front inclined-portion 54*a* and the opposite roller axle 9*a* from friction force transmission of the opposite roller 9. In order to transmit the friction force, the front inclined-portion 54*a* is formed from an elastic material having low resilience; thereby it is possible to absorb torque fluctuation occurring during the change of the torque transmission path.

The elastic material having low resilience may include vulcanized rubber, such as natural rubber (NR), butyl rubber (IIR), ethylene-propylene rubber (EPDM), and others, or solid state elastomer materials, such as polyethylene-based elastomer, polyolefin-based elastomer (TPO, TPV), polyester-based elastomer (TPEE), urethane-based elastomer (TPU), polyimide-based elastomer, vinyl chloride-based elastomer (TPVC), fluorine-based elastomer, or foam materials, especially gel-like materials having noticeable impact absorption effect (attenuate vibration in a short time period).

Concerning properties of the elastic material having low resilience, for example, an impact resilience R, which is obtained by a measurement method in conformity with JISK6255, is less than 90%, preferably, from 50% to 0%, more preferably, from 20% to 0%.

Table 1 presents some generally-used elastic materials having low resilience.

It should be noted that in the present embodiment, the elastic material having low resilience is not limited to the materials in Table 1. For example, polymerization materials of the materials in Table 1 with polymer materials, foamed materials of the materials in Table 1, or the materials in Table 1 covered by other materials may also be used.

Here, the impact resilience R is measured in the following way. A steel ball or a hammer is dropped from a preset height h1 to a specimen, the rebound height h2 is measured, and the impact resilience R is calculated by the following formula.

$$R=(h2/h1)\times 100\%.$$

Figure 11C:
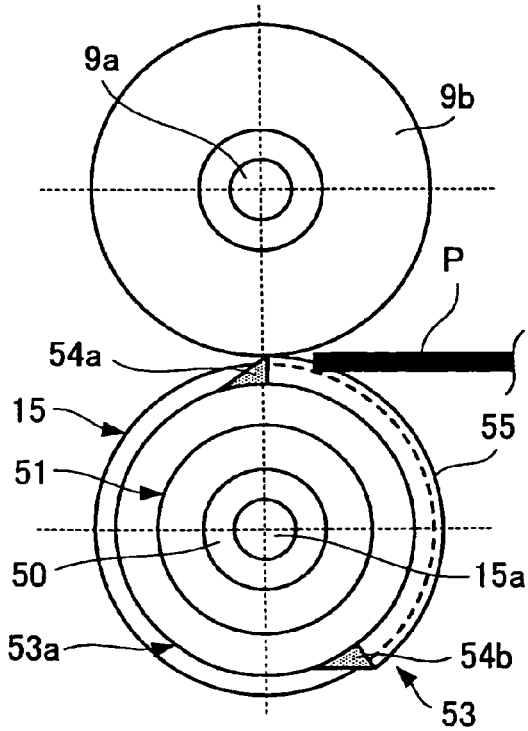

FIG. 11C shows an instant before the recording sheet P arrives at the nipping portion, and the upper-most portion of the inclined surface of the front inclined-portion 54*a*, which is joined to the peripheral portion 53*a* of the cam ring 53, passes through the nipping portion, and at which instant the cam projection portion 55 arrives at the nipping portion, and the cam projection portion 55 is in contact with the opposite roller side ring 9*b*. Since the opposite roller side ring 9*b* is in contact with the cam projection portion 55, the distance between the opposite roller axle 9*a* and the secondary transfer roller axle 15*a* is constant for a while.

Since the cam projection portion 55 supports the load equivalent to a transfer pressure imposed on the secondary transfer roller 15, preferably, the material of the cam projection portion 55 has a Young's modulus higher than the Young's modulus of the front inclined-portions 54*a*. For example, the Young's modulus of nylon 6-6 (PA) is 3.0 GPa, and the Young's modulus of polyacetal (POM) homopolymer is 3.2 GPa; these materials satisfy this requirement. Further, when the fusing unit of the transfer and fusing unit as shown in FIG. 34 through FIG. 38, namely, a heater, is present, since heat is transferred from a fusing opposite roller to the cam projection portion 55, the distance between the transfer and fusing opposite roller and a third transfer and fusing roller 70 changes according to the amount of the heat. As a result, as shown in Table 2, it is preferable to use materials having a linear expansion coefficient as low as possible for the cam projection portion 55, and the material of the cam projection portion 55 should be appropriately selected taking into account the fusing and heating temperature and heat to be transferred. Therefore, the material of the cam projection portion 55 is not limited to resin materials, but iron, stainless and other metal materials may be used at a high temperature.

In addition, because the material of the cam projection portion 55 is selected to have high resistance against creep deformation, the distance between the opposite roller axle 9*a* or a third transfer and fusing roller axle 70*a* and a transfer-fusing-pressing roller 73 can be maintained with high precision without being affected by bending caused by elastic deformation, creep deformation over time, or deformation caused by friction.

Figure 11D:
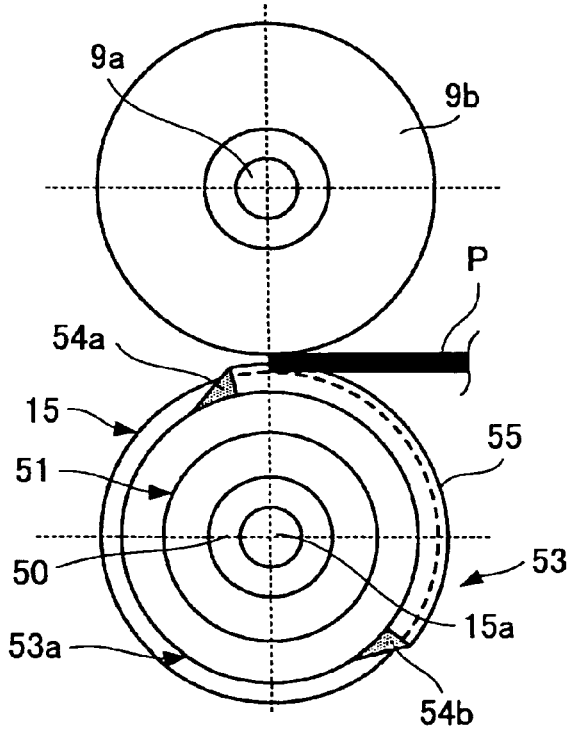

FIG. 11D shows an instant immediately after the front end of the recording sheet P arrives at the nipping portion; at this instant the cam projection portion 55 is at the nipping portion, and the opposite roller side ring 9*b* and the cam projection portion 55 are separated from each other because the recording sheet P is thick.

Since the opposite roller side ring 9*b* is in contact with the recording sheet P, the distance between the opposite roller axle 9*a* and the secondary transfer roller axle 15*a* is greater than that in FIG. 11C. At this moment, the secondary transfer roller 15 is driven to rotate by friction force with the opposite roller 9 while sandwiching the not-illustrated intermediate transfer belt 4 and the recording sheet P.

FIG. 12A through FIG. 12D are diagrams illustrating a structure in which a peripheral portion 53*b* of the cam ring 53 is in contact with and imposes a weak pressure on the outside surface of the opposite roller side ring 9*b*, and show a relationship of the distance between the opposite roller axle 9*a* and the secondary transfer roller axle 15*a* different from the relationship shown in FIG. 11A through FIG. 11D.

In the structure of the cam ring 53 shown in FIG. 12A through FIG. 12D, the peripheral portion 53*a* of the cam ring 53 in FIG. 11A through FIG. 11D is replaced with the peripheral portion 53*b* of the cam ring 53, and the front inclined-portion 54*a* in FIG. 11A through FIG. 11D is replaced with a front inclined-portion 54*c*, the back inclined-portion 54*b* in FIG. 11A through FIG. 11D is replaced with a back inclined-portion 54*d*.

The cam ring 53 shown in FIG. 12A through FIG. 12D includes a portion constituted by the cam projection portion 55 having an external radius greater than the radius of the secondary transfer roller 15 with the secondary transfer roller axle 15*a* as a center, and a portion constituted by the peripheral portion 53*b* of the cam ring 53 having an external radius equal to the radius of the secondary transfer roller 15 with the secondary transfer roller axle 15*a* as a center.

Figure 12A:
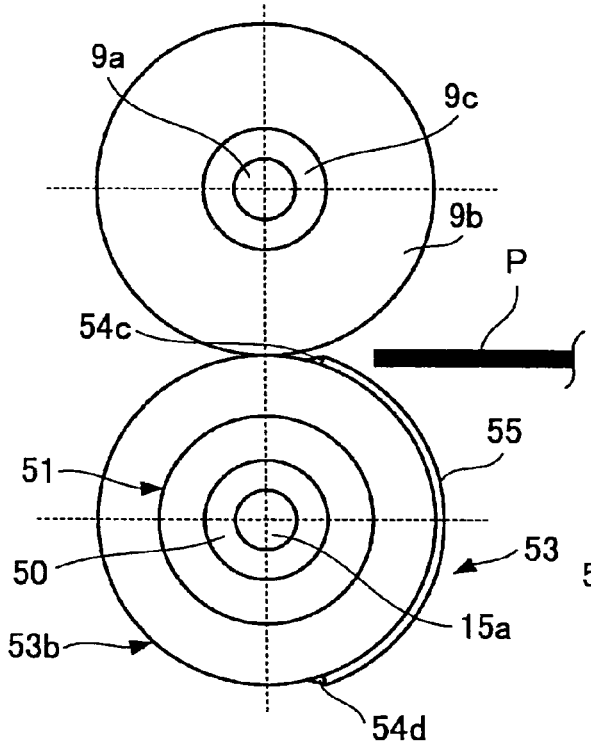
FIG. 12A through FIG. 12D are diagrams illustrating a structure in which a peripheral portion 53*b* of the cam ring 53 is in contact with and imposes a weak pressure on the outside surface of a opposite roller side ring 9*b*, and show a relationship of the distance between the opposite roller axle 9*a* and the secondary transfer roller axle 15*a* different from the relationship shown in FIG. 11A through FIG. 11D.

In FIG. 12A, before the recording sheet P arrives at the nipping portion, the opposite roller side ring 9*b* has already been in contact with the peripheral portion 53*b* of the cam ring 53 even in the standby state. The distance between the opposite roller axle 9*a* and the secondary transfer roller axle 15*a* is the minimum. At this moment, the secondary transfer roller 15 is driven to rotate by friction force with the opposite roller 9, which sandwiches the not-illustrated intermediate transfer belt 4.

Figure 12B:
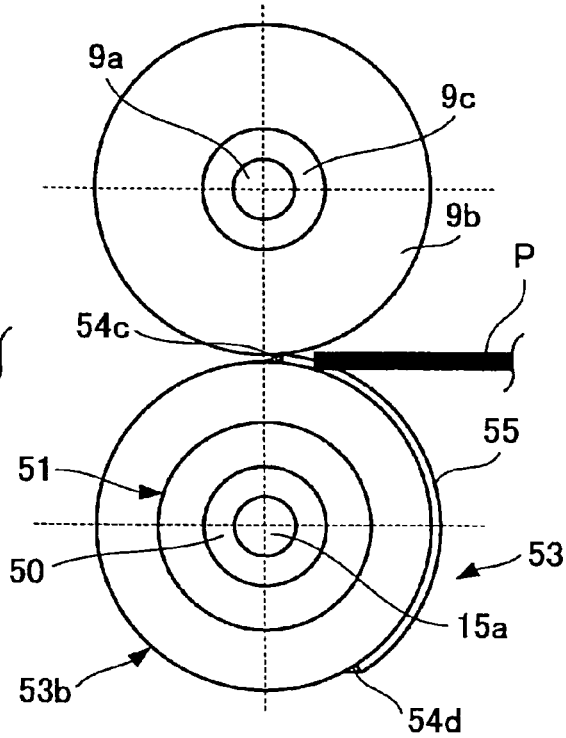

In FIG. 12B, before the recording sheet P arrives at the nipping portion, the upper-most portion of the inclined surface of the front inclined-portion 54*c*, which is joined to the peripheral portion 53*b* of the cam ring 53, is coming close to the nipping portion, and the opposite roller side ring 9*b* is in contact with the inclined surface of the front inclined-portion 54*c*, thus the distance between the opposite roller axle 9*a* and the secondary transfer roller axle 15*a* is gradually enlarged.

At this moment, the source of torque transmission of the driven rotation of the secondary transfer roller 15 is changed from friction force transmission of the opposite roller 9 to friction force transmission between the front inclined-portion 54*c* and the opposite roller side ring 9*b*. In order to transmit the friction force, the front inclined-portion 54*c* is formed of an elastic material having low resilience; thereby it is possible to absorb torque fluctuation occurring during the change of the torque transmission path.

Figure 12C:
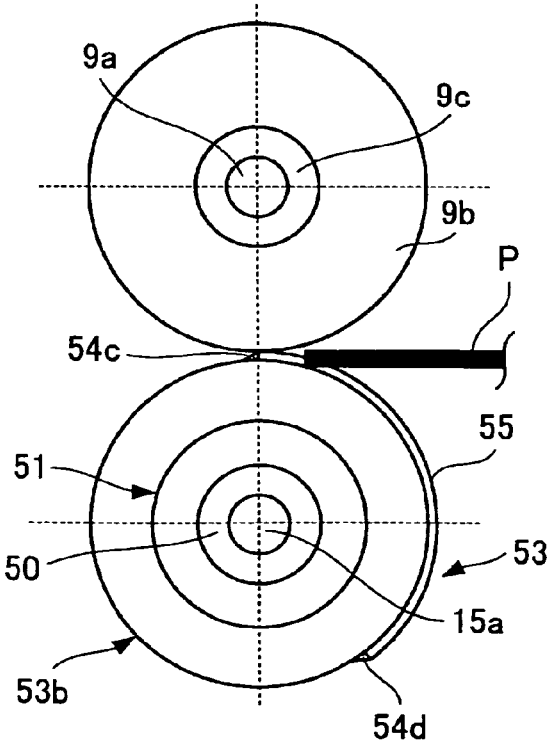

FIG. 12C shows an instant before the recording sheet P arrives at the nipping portion, where the upper-most portion of the inclined surface of the front inclined-portion 54*b*, which is joined to the peripheral portion 53*b* of the cam ring 53, passes through the nipping portion, and at which instant the cam projection portion 55 arrives at the nipping portion and is in contact with the opposite roller side ring 9*b*. Since the opposite roller side ring 9*b* is in contact with the cam projection portion 55, the distance between the opposite roller axle 9*a* and the secondary transfer roller axle 15*a* is constant for a while.

Figure 12D:
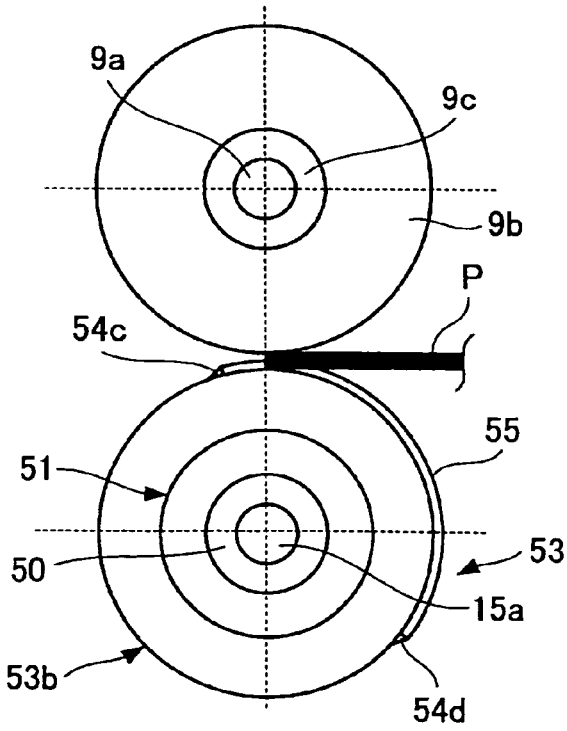

FIG. 12D shows at an instant immediately after the front end of the recording sheet P arrives at the nipping portion, and at this instant the cam projection portion 55 is at the nipping portion, and the opposite roller side ring 9*b* and the cam projection portion 55 are separated from each other because the recording sheet P is thick.

Since the opposite roller side ring 9*b* is in contact with the recording sheet P, the distance between the opposite roller axle 9*a* and the secondary transfer roller axle 15*a* is greater than that in FIG. 12C. At this moment, the secondary transfer roller 15 is driven to rotate by friction force with the opposite roller 9 while sandwiching the not-illustrated intermediate transfer belt 4 and the recording sheet P.

Below, distributions of the pressure imposed on the opposite roller 9 in the main scan direction in the states shown in FIG. 11A through FIG. 11D and FIG. 12A through FIG. 12D are described. First, definition of positions in the main scan direction used for describing the pressure distribution on the opposite roller 9 in the main scan direction is explained.

Figure 13:
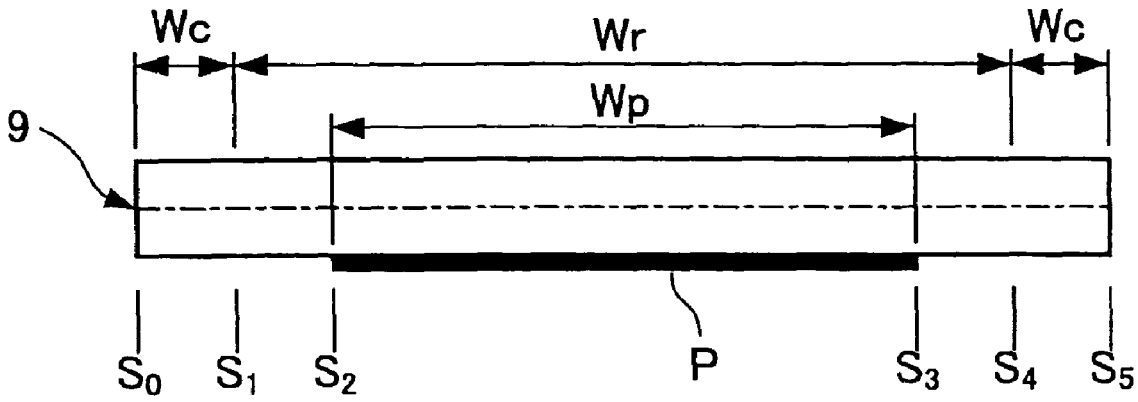
FIG. 13 is a diagram explaining definition of positions in the main scan direction used for describing the pressure distribution on the opposite roller 9 in the main scan direction.

FIG. 13 is a diagram explaining definition of positions in the main scan direction used for describing the pressure distribution on the opposite roller 9 in the main scan direction.

In FIG. 13, against the direction of conveying the recording sheet P, the two ends of the transfer pressure adjustment region Wc on the left side of the opposite roller 9 are denoted to be S0 and S1, and the two ends of the transfer pressure adjustment region Wc on the right side of the opposite roller 9 are denoted to be S4 and S5. In addition, the two ends of the position where the opposite roller 9 contacts the recording sheet P are denoted to be S2 and S3. The two ends of the opposite roller width Wr are denoted to be S1 and S4.

FIG. 14A through FIG. 14D are diagrams illustrating distributions of the pressure imposed on the opposite roller 9 in the main scan direction in the states shown in FIG. 11A through FIG. 11D.

In FIG. 14A through FIG. 14D, P1, P2, and P3 represent values of the pressures imposed on the opposite roller 9, and satisfy the relation $$P1<P2<P3.$$

In addition, in FIG. 14A through FIG. 14D, S0, S1, S2, S3, S4, and S5 represent positions in the main scan direction, as defined in FIG. 13.

Figure 14A:
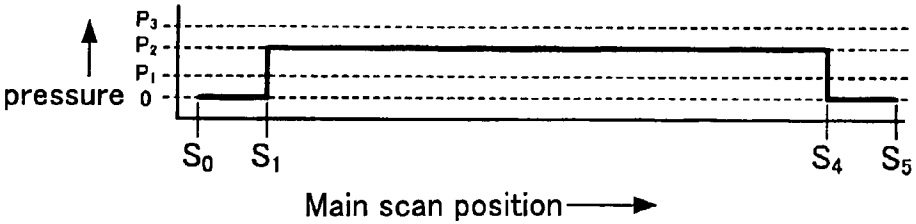
FIG. 14A through FIG. 14D are diagrams illustrating distributions of the pressure imposed on the opposite roller 9 in the main scan direction in the states shown in FIG. 11A through FIG. 11D.

FIG. 14A shows the distribution of the pressure imposed on the opposite roller 9 in the main scan direction before the recording sheet P arrives at the nipping portion, as shown in FIG. 11A.

As shown in FIG. 14A, a pressure P2 is imposed between the main scan positions S1 and S4, although there is no pressure imposed between the main scan positions S0 and S1, and between the main scan positions S4 and S5.

Figure 14B:
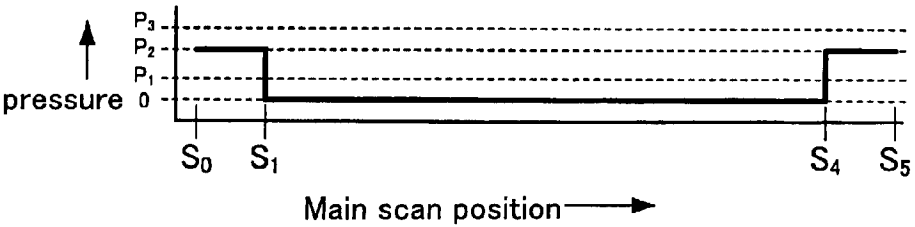

FIG. 14B shows the distribution of the pressure imposed on the opposite roller 9 in the main scan direction at the instant as shown in FIG. 11B, specifically, at the instant before the recording sheet P arrives at the nipping portion, and at the same instant, the upper-most portion of the inclined surface of the front inclined-portion 54*a* joined to the peripheral portion 53*a* of the cam ring 53 is coming close to the nipping portion, and the opposite roller side ring 9*b* is in contact with the inclined surface of the front inclined-portion 54*a*.

As shown in FIG. 14B, a pressure P2 is imposed between the main scan positions S0 and S1, and between the main scan positions S4 and S5, while there is no pressure imposed between the main scan positions S1 and S4.

Figure 14C:
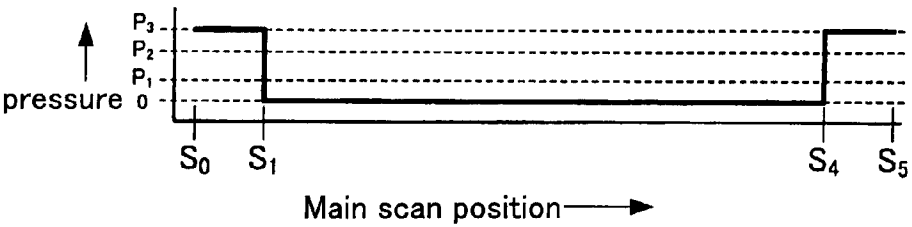

FIG. 14C shows the distribution of the pressure imposed on the opposite roller 9 in the main scan direction at the instant as shown in FIG. 11*c*, specifically, at the instant before the recording sheet P arrives at the nipping portion, and at the same instant the upper-most portion of the inclined surface of the front inclined-portion 54*a*, which is joined to the peripheral portion 53*a* of the cam ring 53, passes through the nipping portion, the cam projection portion 55 arrives at the nipping portion, and the cam projection portion 55 is in contact with the opposite roller side ring 9*b*.

As shown in FIG. 14C, a pressure P3 is imposed between the main scan positions S0 and S1, and between the main scan positions S4 and S5, while there is no pressure imposed between the main scan positions S1 and S4.

Figure 14D:
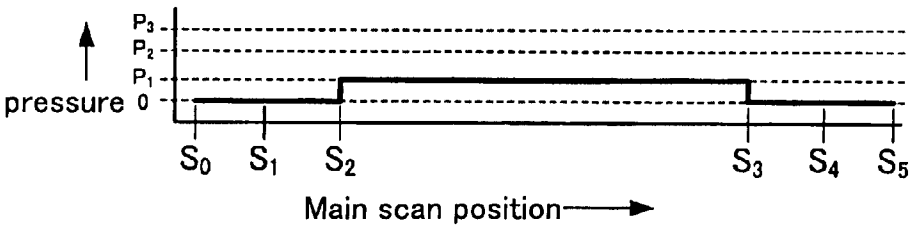

FIG. 14D shows the distribution of the pressure imposed on the opposite roller 9 in the main scan direction at the instant as shown in FIG. 11D, namely, after the front end of the recording sheet P arrives at the nipping portion.

As shown in FIG. 14D, there is no pressure imposed between the main scan positions S0 and S2, and between the main scan positions S3 and S5, while a pressure P1 is imposed between the main scan positions S2 and S3.

FIG. 15A through FIG. 15D are diagrams illustrating distributions of the pressure imposed on the opposite roller 9 in the main scan direction in the states shown in FIG. 12A through FIG. 12D.

Similar to FIG. 14A through FIG. 14D, in FIG. 15A through FIG. 15D, P1, P2, and P3 represent values of the pressures imposed on the opposite roller 9, and S0, S1, S2, S3, S4, and S5 represent positions in the main scan direction, as defined in FIG. 13.

Figure 15A:
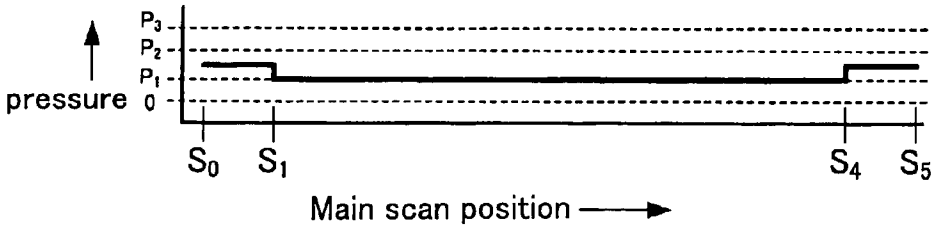
FIG. 15A through FIG. 15D are diagrams illustrating distributions of the pressure imposed on the opposite roller 9 in the main scan direction in the states shown in FIG. 12A through FIG. 12D.

FIG. 15A shows the distribution of the pressure imposed on the opposite roller 9 in the main scan direction before the recording sheet P arrives at the nipping portion, as shown in FIG. 12A.

As shown in FIG. 15A, a pressure intermediate between P1 and P2 is imposed between the main scan positions S0 and S1, and between the main scan positions S4 and S5, and a pressure P1 is imposed between the main scan positions S1 and S4.

Figure 15B:
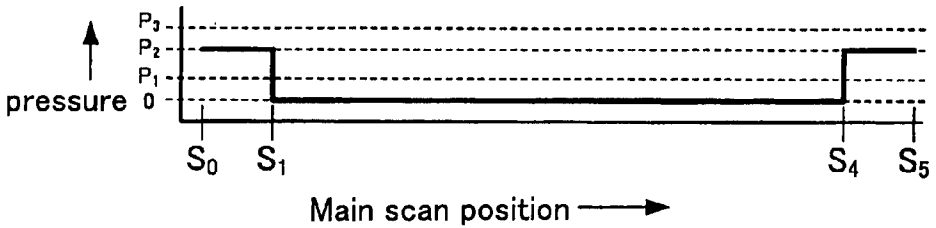

FIG. 15B shows the distribution of the pressure imposed on the opposite roller 9 in the main scan direction at the instant as shown in FIG. 12B, specifically, at the instant before the recording sheet P arrives at the nipping portion, and at the same instant, the upper-most portion of the inclined surface of the front inclined-portion 54*c* joined to the peripheral portion 53*b* of the cam ring 53 is coming close to the nipping portion, and the opposite roller side ring 9*b* is in contact with the inclined surface of the front inclined-portion 54*c*.

As shown in FIG. 15B, a pressure P2 is imposed between the main scan positions S0 and S1, and between the main scan positions S4 and S5, while there is no pressure imposed between the main scan positions S1 and S4.

Figure 15C:
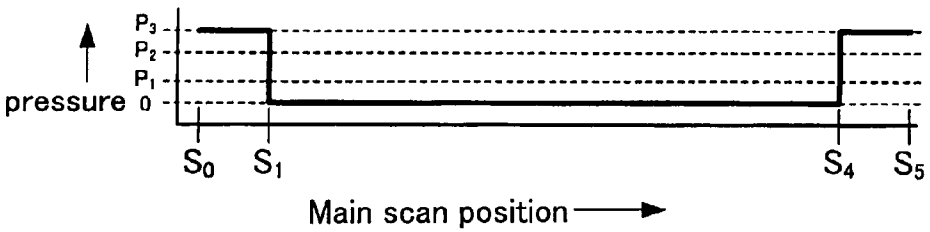

FIG. 15C shows the distribution of the pressure imposed on the opposite roller 9 in the main scan direction at the instant as shown in FIG. 12C, namely, at the instant before the recording sheet P arrives at the nipping portion, and at the same instant the upper-most portion of the inclined surface of the front inclined-portion 54*b*, which is joined to the peripheral portion 53*b* of the cam ring 53, passes through the nipping portion, and the cam projection portion 55 arrives at the nipping portion and is in contact with the opposite roller side ring 9*b*.

As shown in FIG. 15C, a pressure P3 is imposed between the main scan positions S0 and S1, and between the main scan positions S4 and S5, while there is no pressure imposed between the main scan positions S1 and S4.

Figure 15D:
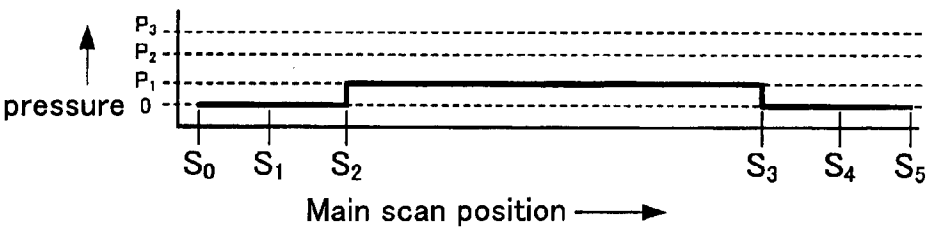

FIG. 15D shows the distribution of the pressure imposed on the opposite roller 9 in the main scan direction at the instant as shown in FIG. 12D, namely, after the front end of the recording sheet P arrives at the nipping portion.

As shown in FIG. 15D, there is no pressure imposed between the main scan positions S0 and S2, and between the main scan positions S3 and S5, while a pressure P1 is imposed the main scan positions S2 and S3.

Examining the distributions of the pressure imposed on the opposite roller 9 in the main scan direction as shown in FIG. 14A through FIG. 14D and FIG. 15A through FIG. 15D, it is found that only the main scan direction pressure distributions in FIG. 14A and FIG. 15A differ from each other. In FIG. 14A, the pressure imposed between the main scan positions S0 and S1, and between the main scan positions S4 and S5 is zero, while In FIG. 15A, a pressure intermediate between P1 and P2 is imposed between the main scan positions S0 and S1, and between the main scan positions S4 and S5, and a pressure P1 is imposed between the main scan positions S1 and S4.

In the main scan direction pressure distributions shown in FIG. 14A through FIG. 14D, during the transition from the status shown in FIG. 11A to the status shown in FIG. 11B, since a pressure is suddenly imposed between the main scan positions S0 and S1, and between the main scan positions S4 and S5, the change of pressure is large.

In comparison, in the main scan direction pressure distributions shown in FIG. 15A through FIG. 15D, in the state as shown in FIG. 12A, since the opposite roller side ring 9*b* is in contact with the peripheral portion 53*b* of the cam ring 53, a pressure is imposed between the main scan positions S1 and S4; accordingly, the pressure imposed between the main scan positions S0 and S1, and between the main scan positions S4 and S5, is relatively low, so that during the transition from when the state shown in FIG. 12A to the state shown in FIG. 12B, the pressure distribution between the main scan positions S0 and S1 and between the main scan positions S4 and S5 is relatively smooth compared to that shown in FIG. 14, namely, the change of pressure is small.

Below, with reference to timing charts in FIG. 16A through FIG. 20B and subsequent drawings, explanations are made of timings of rotational operations of the cam ring 53 (the cam member), and entrance timings of the recording sheet P.

In the timing charts in FIG. 16A through FIG. 20B and subsequent drawings, the abscissas indicate time, and the ordinates indicate the distance from the secondary transfer roller axles 15*a* to the opposite roller axle 9*a*. Below, the segment connecting the center of the secondary transfer roller axles 15*a* and the center of the opposite roller axle 9*a* is referred to as "inter-axle segment".

In the timing charts shown in FIG. 16A through FIG. 20B, the rotational operation of the cam ring 53 is indicated by solid lines, and the operation of conveyance of the recording sheet P is indicated by dashed lines. Specifically, the solid line represents the distance from the center of the secondary transfer roller axles 15*a* to the outside surface of the cam ring 53 on the inter-axle segment. This distance is referred to as the "cam radius". The dashed line represents the distance from the center of the secondary transfer roller axles 15*a* to the surface of the opposite roller 9 when the cam ring 53 (cam member) is not present.

In the timing charts shown in FIG. 16A through FIG. 20B, it is assumed that the cam rings 53 at the two ends of the secondary transfer roller 15 have the same shape, and the same rotational phase.

Figure 16A:
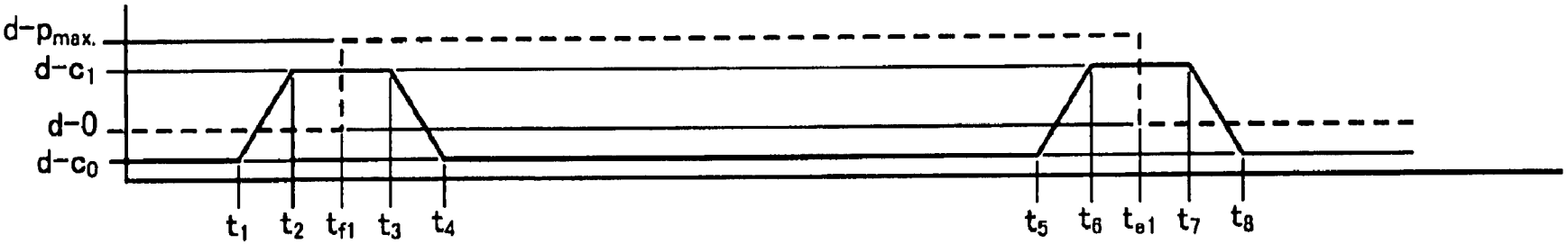
FIG. 16A and FIG. 16B are timing chart illustrating timings of rotational operations of the cam ring 53 (the cam member), and entrance timings of the recording sheet P.
Figure 16B:
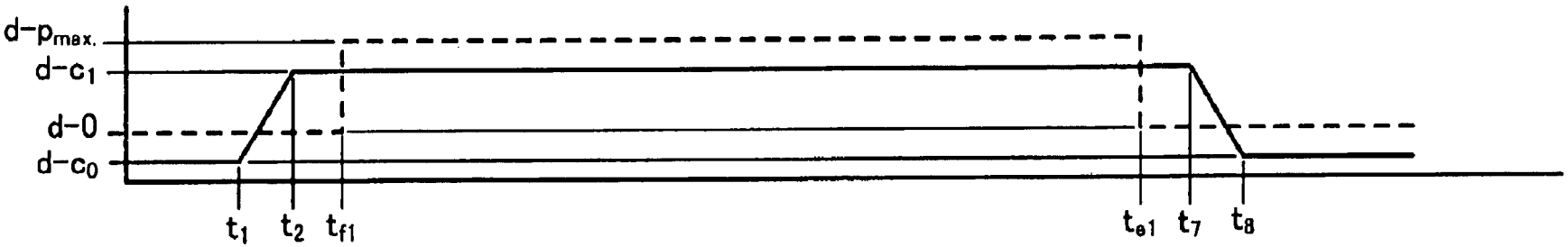

FIG. 16A and FIG. 16B are timing charts illustrating timings of rotational operations of the cam ring 53 and entrance timings of the recording sheet P when the recording sheet P is very thick.

FIG. 16A shows the timing chart of operations in which the cam rings 53 rotates to enlarge the gap of the nipping portion when the front end of the recording sheet P is conveyed to the nipping portion, and the cam rings 53 rotates to enlarge the gap of the nipping portion again when the back end of the recording sheet P is conveyed to the nipping portion.

At time earlier than time t1, the latch claws 57 latch the rotation stopping claws 52, and the cam rings 53 are at rest without rotation, namely, in the standby state. At this moment, the cam radius is d-c0. The distance d-c0 corresponds to a radius of the portion from the front inclined-portion 54*a* to the back inclined-portion 54*b* with the secondary transfer roller axle 15*a* as a center. Below, the distance d-c0 is referred to as "the second radius".

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment.

At time t2, the gap of the nipping portion is enlarged, and the cam radius is d-c1. The distance d-c1 corresponds to a radius of the cam projection portion 55 with the secondary transfer roller axle 15*a* as a center. Below, the radius d-c1 is referred to as "the first radius".

The cam rings 53 rotate further from time t2 to time tf1, and at time tf1, the front end of the recording sheet P arrives at the nipping portion, namely, the device is in the state shown in FIG. 11D, and the distance from the center of the secondary transfer roller axles 15*a* to the surface of the opposite roller 9 is d-pmax. The distance d-pmax corresponds to a height from the secondary transfer roller axle 15*a* to the transfer surface of the thick recording sheet P. Note that d-0 corresponds to the distance from the secondary transfer roller axles 15*a* to the surface of the opposite roller 9 when the recording sheet P is not present.

The cam rings 53 rotate from time tf1 to time t3, and at time t3, the back end of the back inclined-portion 54*b* is on the inter-axle segment.

The cam rings 53 rotate from time t3 to time t4, and at time t4, the front end of the back inclined-portion 54*b* is on the inter-axle segment. At time t4, the gap of the nipping portion is reduced to zero, and the cam radius is d-c0. Then, the latch claws 57 latch the rotation stopping claws 52, and the cam rings 53 are at rest without rotation, namely, in the standby state.

Immediately prior to time t5, when the paper-resisting sensor 21 detects that the back end of the recording sheet P arrives at the nipping portion, the latch claws 57 release the rotation stopping claws 52 on the right side and the left side at the same time, and the cam rings 53 start to rotate.

At time t5, the front end of the front inclined-portion 54*a* is on the inter-axle segment. The cam rings 53 rotate from time t5 to time t6, and at time t6, the back end of the front inclined-portion 54*a* is on the inter-axle segment. The cam rings 53 rotate further from time t6 to time te1, and at time te1, the back end of the recording sheet P arrives at the nipping portion, and the distance from the center of the secondary transfer roller axles 15*a* to the surface of the opposite roller 9 is d-c1. The cam rings 53 rotate from time te1 to time t7, and at time t7, the back end of the back inclined-portion 54*b* is on the inter-axle segment. The cam rings 53 rotate from time t7 to time t8, and at time t8, the front end of the back inclined-portion 54*b* is on the inter-axle segment. Then, the latch claws 57 latch the rotation stopping claws 52, and the cam rings 53 are at rest without rotation, namely, in the standby state.

FIG. 16B shows the timing chart of operations in which the cam rings 53 rotates to enlarge the gap of the nipping portion when the front end of the recording sheet P is conveyed to the nipping portion, and the cam rings 53 rotates to eliminate the gap of the nipping portion when the back end of the recording sheet P is conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the recording sheet P arrives at the nipping portion, namely, the device is in the state shown in FIG. 11D, and the distance from the center of the secondary transfer roller axles 15*a* to the surface of the opposite roller 9 is d-pmax.

At time tf1, rotation of the cam rings 53 is stopped for a while, and the gap of the nipping portion remains being enlarged.

At time te1, the back end of the recording sheet P arrives at the nipping portion, the distance from the center of the secondary transfer roller axles 15*a* to the surface of the opposite roller 9 is d-c1, and the cam rings 53 start to rotate.

The cam rings 53 rotate from time te1 to time t7, and at time t7, the back end of the back inclined-portion 54*b* is on the inter-axle segment. The cam rings 53 rotate from time t7 to time t8, and at time t8, the front end of the back inclined-portion 54*b* is on the inter-axle segment. At time t8, the gap of the nipping portion is reduced to zero, and the cam radius is d-c0. Then, the latch claws 57 latch the rotation stopping claws 52, and the cam rings 53 are at rest without rotation, namely, in the standby state.

Figure 17A:
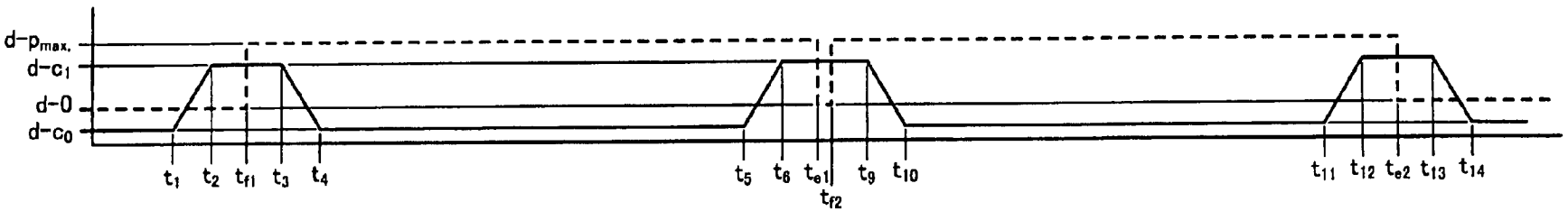
FIG. 17A and FIG. 17B are timing charts illustrating timings of rotational operations of the cam ring 53 when printing two or more very thick recording sheets P.
Figure 17B:
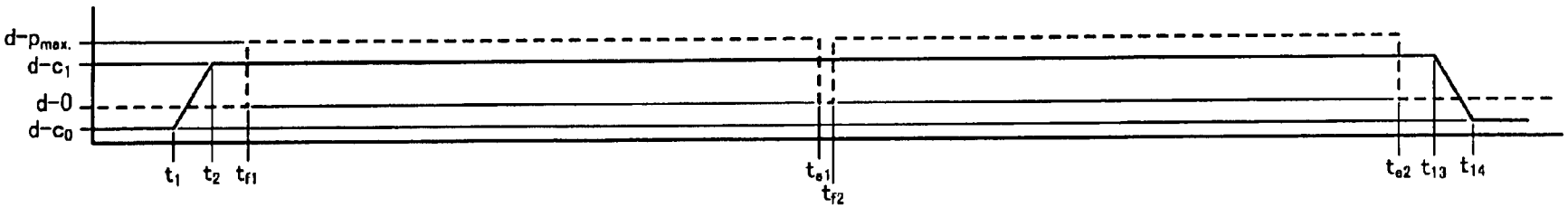

FIG. 17A and FIG. 17B are timing charts illustrating timings of rotational operations of the cam ring 53 when printing two or more very thick recording sheets P.

FIG. 17A shows the timing chart of operations in which the cam rings 53 rotates to enlarge the gap of the nipping portion when the front end of the first page of the recording sheets P is conveyed to the nipping portion, and the cam rings 53 rotates to enlarge the gap of the nipping portion again when the back end of the first page and the front end of the second page of the recording sheets P are conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the first page of the recording sheets P arrives at the nipping portion, and when the paper-resisting sensor 21 detects that the thickness of the first page of the recording sheets P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, at time t2 the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the first page of the recording sheets P arrives at the nipping portion, namely, the device is in the state shown in FIG. 11D, and the distance from the center of the secondary transfer roller axles 15*a* to the surface of the opposite roller 9 is d-pmax.

The cam rings 53 rotate from time tf1 to time t3, and at time t3, the back end of the back inclined-portion 54*b* is on the inter-axle segment. The cam rings 53 rotate from time t3 to time t4, and at time t4, the front end of the back inclined-portion 54*b* is on the inter-axle segment. At time t4, the gap of the nipping portion is reduced to zero, and the cam radius is d-c0. Then, the latch claws 57 latch the rotation stopping claws 52, and the cam rings 53 are at rest without rotation, namely, in the standby state.

Next, immediately prior to time t5, when the paper-resisting sensor 21 detects that the back end of the first page of the recording sheets P arrives at the nipping portion, the latch claws 57 release the rotation stopping claws 52 on the right side and the left side at the same time, and the cam rings 53 start to rotate.

At time t5, the front end of the front inclined-portion 54*a* is on the inter-axle segment. The cam rings 53 rotate from time t5 to time t6, and at time t6, the back end of the front inclined-portion 54*a* is on the inter-axle segment. The cam rings 53 rotate further from time t6 to time te1, and at time te1, the back end of the first page of the recording sheets P arrives at the nipping portion, and the distance from the center of the secondary transfer roller axles 15*a* to the surface of the opposite roller 9 is d-c1.

At time tf2, the front end of the second page of the recording sheets P arrives at the nipping portion, and the distance from the center of the secondary transfer roller axles 15*a* to the surface of the opposite roller 9 is d-pmax.

The cam rings 53 rotate from time tf2 to time t9, and at time t9, the back end of the back inclined-portion 54*b* is on the inter-axle segment. The cam rings 53 rotate from time t9 to time t10, and at time t10, the front end of the back inclined-portion 54*b* is on the inter-axle segment. Then, the latch claws 57 latch the rotation stopping claws 52, and the cam rings 53 are at rest without rotation, namely, in the standby state.

Immediately prior to time t11, when the paper-resisting sensor 21 detects that the back end of the second page of the recording sheets P arrives at the nipping portion, the latch claws 57 release the rotation stopping claws 52 on the right side and the left side at the same time, and the cam rings 53 start to rotate.

At time t11, the front end of the front inclined-portion 54*a* is on the inter-axle segment. The cam rings 53 rotate from time t11 to time t12, and at time t12, the back end of the front inclined-portion 54*a* is on the inter-axle segment. The cam rings 53 rotate further from time t12 to time te2, and at time te2, the back end of the second page of the recording sheets P arrives at the nipping portion, and the distance from the center of the secondary transfer roller axles 15*a* to the surface of the opposite roller 9 is d-c1.

The cam rings 53 rotate from time te2 to time t13, and at time t13, the back end of the back inclined-portion 54*b* is on the inter-axle segment. The cam rings 53 rotate from time t13 to time t14, and at time t14, the front end of the back inclined-portion 54*b* is on the inter-axle segment. Then, the latch claws 57 latch the rotation stopping claws 52, and the cam rings 53 are at rest without rotation, namely, in the standby state.

FIG. 17B shows the timing chart of operations in which the cam rings 53 rotate to enlarge the gap of the nipping portion when the front end of the first page of the recording sheets P is conveyed to the nipping portion, and the cam rings 53 rotate to eliminate the gap of the nipping portion when the back end of the second page of the recording sheets P is conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the first page of the recording sheets P arrives at the nipping portion, and when the paper-resisting sensor 21 detects that the thickness of the first page of the recording sheets P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the first page of the recording sheets P arrives at the nipping portion, namely, the device is in the state shown in FIG. 11D, and the distance from the center of the secondary transfer roller axles 15*a* to the surface of the opposite roller 9 is d-pmax.

At time tf1, rotation of the cam rings 53 is stopped for a while, and the gap of the nipping portion remains enlarged.

At time te1, the back end of the first page of the recording sheets P arrives at the nipping portion, and the distance from the center of the secondary transfer roller axles 15*a* to the surface of the opposite roller 9 is d-c1.

At time tf2, the front end of the second page of the recording sheets P arrives at the nipping portion, and the distance from the center of the secondary transfer roller axles 15*a* to the surface of the opposite roller 9 is d-pmax.

At time te2, the back end of the second page of the recording sheets P arrives at the nipping portion, and the distance from the center of the secondary transfer roller axles 15*a* to the surface of the opposite roller 9 is d-c1.

The cam rings 53 rotate from time te2 to time t13, and at time t13, the back end of the back inclined-portion 54*b* is on the inter-axle segment. The cam rings 53 rotate from time t13 to time t14, and at time t14, the front end of the back inclined-portion 54*b* is on the inter-axle segment. Then, the latch claws 57 latch the rotation stopping claws 52, and the cam rings 53 are at rest without rotation, namely, in the standby state.

Figure 18A:
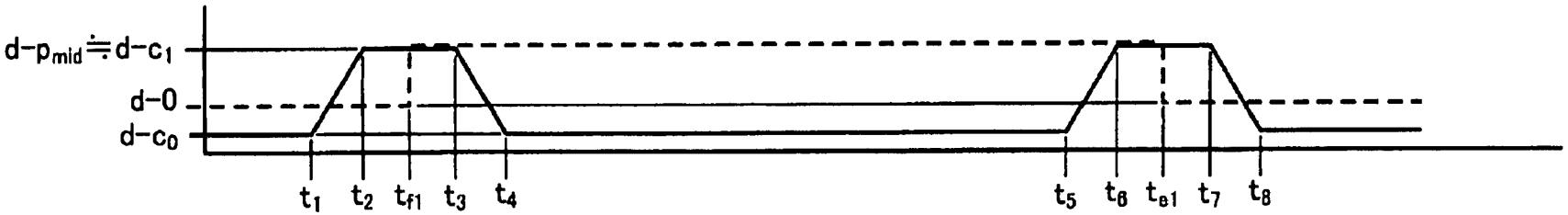
FIG. 18A and FIG. 18B are timing charts illustrating timings of rotational operations of the cam ring 53 when printing a recording sheet P having a middle thickness.
Figure 18B:
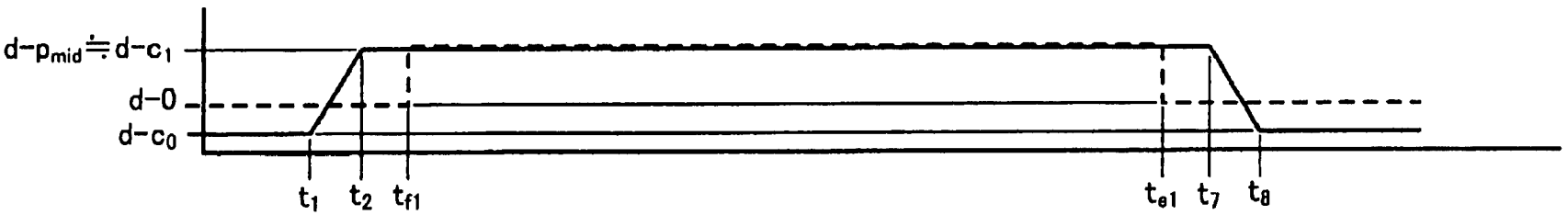

FIG. 18A and FIG. 18B are timing charts illustrating timings of rotational operations of the cam ring 53 when printing a recording sheet P having a middle thickness.

FIG. 18A shows the timing chart of operations in which the cam rings 53 rotate to enlarge the gap of the nipping portion when the front end of the recording sheet P is conveyed to the nipping portion, and the cam rings 53 rotate to enlarge the gap of the nipping portion again when the back end of the recording sheet P are conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1. The distance d-c1 corresponds to the radius of the cam projection portion 55 with the secondary transfer roller axle 15*a* as a center (the first radius).

The cam rings 53 rotate further from time t2 to time tf1, and at time tf1, the front end of the recording sheet P arrives at the nipping portion, namely, the device is in the state shown in FIG. 11D, and the distance from the center of the secondary transfer roller axles 15*a* to the surface of the opposite roller 9 is d-pmid. The distance d-pmid corresponds to the height from the secondary transfer roller axle 15*a* to the transfer surface of the recording sheet P having a middle thickness, and is nearly equal to d-c1.

The cam rings 53 rotate from time tf1 to time t3, and at time t3, the back end of the back inclined-portion 54*b* is on the inter-axle segment. The cam rings 53 rotate from time t3 to time t4, and at time t4, the front end of the back inclined-portion 54*b* is on the inter-axle segment. At time t4, the gap of the nipping portion is reduced to zero, and the cam radius is d-c0. Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the cam rings 53 start to rotate.

At time t5, the front end of the front inclined-portion 54*a* is on the inter-axle segment. The cam rings 53 rotate from time t5 to time t6, and at time t6, the back end of the front inclined-portion 54*a* is on the inter-axle segment. The cam rings 53 rotate further from time t6 to time te1, and at time te1, the back end of the recording sheet P arrives at the nipping portion.

The cam rings 53 rotate from time te1 to time t7, and at time t7, the back end of the back inclined-portion 54*b* is on the inter-axle segment. The cam rings 53 rotate from time t7 to time t8, and at time t8, the front end of the back inclined-portion 54*b* is on the inter-axle segment. Then, the latch claws 57 latch the rotation stopping claws 52, and the cam rings 53 are at rest without rotation, namely, in the standby state.

FIG. 18B shows the timing chart of operations in which the cam rings 53 rotate to enlarge the gap of the nipping portion when the front end of the recording sheet P is conveyed to the nipping portion, and the cam rings 53 rotate to eliminate the gap of the nipping portion when the back end of the recording sheet P is conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the recording sheet P arrives at the nipping portion, namely, the device is in the state shown in FIG. 11D, and the distance from the center of the secondary transfer roller axles 15*a* to the surface of the opposite roller 9 is d-pmid.

At time tf1, rotation of the cam rings 53 is stopped for a while, and the gap of the nipping portion remains enlarged.

At time te1, the back end of the recording sheet P arrives at the nipping portion, and the cam rings 53 start to rotate.

The cam rings 53 rotate from time te1 to time t7, and at time t7, the back end of the back inclined-portion 54*b* is on the inter-axle segment.

The cam rings 53 rotate from time t7 to time t8, and at time t8, the front end of the back inclined-portion 54*b* is on the inter-axle segment. At time t8, the gap of the nipping portion is reduced to zero, and the cam radius is d-c0. Then, the latch claws 57 latch the rotation stopping claws 52, and the cam rings 53 are at rest without rotation, namely, in the standby state.

Figure 19A:
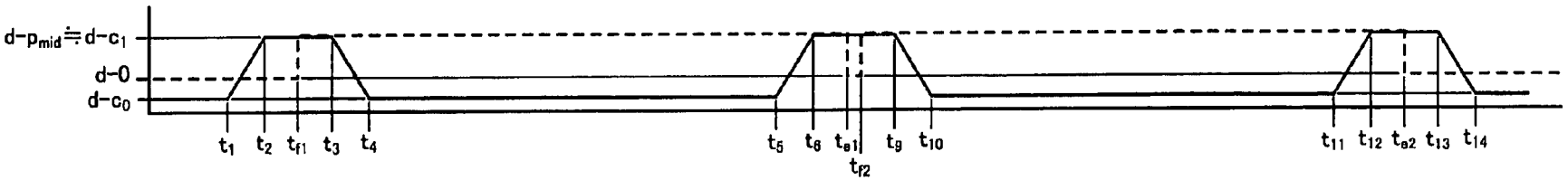
FIG. 19A and FIG. 19B are timing charts illustrating timings of rotational operations of the cam ring 53 when printing two or more recording sheets P each having a middle thickness.
Figure 19B:
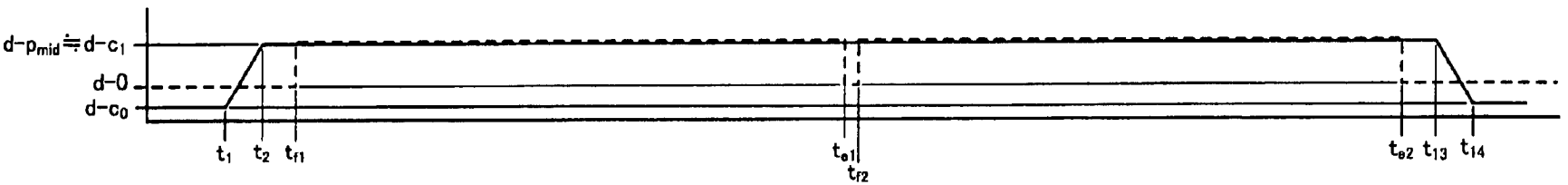

FIG. 19A and FIG. 19B are timing charts illustrating timings of rotational operations of the cam ring 53 when printing two or more recording sheets P each having a middle thickness.

FIG. 19A shows the timing chart of operations in which the cam rings 53 rotate to enlarge the gap of the nipping portion when the front end of the first page of the recording sheets P is conveyed to the nipping portion, and the cam rings 53 rotate to enlarge the gap of the nipping portion again when the back end of the first page and the front end of the second page of the recording sheets P are conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the first page of the recording sheets P arrives at the nipping portion, and when the paper-resisting sensor 21 detects that the thickness of the first page of the recording sheets P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the first page of the recording sheets P arrives at the nipping portion, namely, the device is in the state shown in FIG. 11D, and the distance from the center of the secondary transfer roller axles 15*a* to the surface of the opposite roller 9 is d-pmid.

The cam rings 53 rotate from time tf1 to time t3, and at time t3, the back end of the back inclined-portion 54*b* is on the inter-axle segment. The cam rings 53 rotate from time t3 to time t4, and at time t4, the front end of the back inclined-portion 54*b* is on the inter-axle segment. At time t4, the gap of the nipping portion is reduced to zero, and the cam radius is d-c0. Then, the latch claws 57 latch the rotation stopping claws 52, and the cam rings 53 are at rest without rotation, namely, in the standby state.

Next, immediately prior to time t5, when the paper-resisting sensor 21 detects that the back end of the first page of the recording sheets P arrives at the nipping portion, the latch claws 57 release the rotation stopping claws 52 on the right side and the left side at the same time, and the cam rings 53 start to rotate.

At time t5, the front end of the front inclined-portion 54*a* is on the inter-axle segment. The cam rings 53 rotate from time t5 to time t6, and at time t6, the back end of the front inclined-portion 54*a* is on the inter-axle segment. The cam rings 53 rotate further from time t6 to time te1, and at time te1, the back end of the first page of the recording sheets P arrives at the nipping portion. At time tf2, the front end of the second page of the recording sheets P arrives at the nipping portion.

The cam rings 53 rotate from time tf2 to time t9, and at time t9, the back end of the back inclined-portion 54*b* is on the inter-axle segment. The cam rings 53 rotate from time t9 to time t10, and at time t10, the front end of the back inclined-portion 54*b* is on the inter-axle segment. Then, the latch claws 57 latch the rotation stopping claws 52, and the cam rings 53 are at rest without rotation, namely, in the standby state.

Immediately prior to time t11, when the paper-resisting sensor 21 detects that the back end of the second page of the recording sheets P arrives at the nipping portion, the latch claws 57 release the rotation stopping claws 52 on the right side and the left side at the same time, and the cam rings 53 start to rotate.

At time t11, the front end of the front inclined-portion 54*a* is on the inter-axle segment. The cam rings 53 rotate from time t11 to time t12, and at time t12, the back end of the front inclined-portion 54*a* is on the inter-axle segment. At time t12, the gap of the nipping portion is enlarged.

The cam rings 53 rotate further from time t12 to time te2, and at time te2, the back end of the second page of the recording sheets P arrives at the nipping portion.

The cam rings 53 rotate from time te2 to time t13, and at time t13, the back end of the back inclined-portion 54*b* is on the inter-axle segment. The cam rings 53 rotate from time t13 to time t14, and at time t14, the front end of the back inclined-portion 54*b* is on the inter-axle segment. Then, the latch claws 57 latch the rotation stopping claws 52, and the cam rings 53 are at rest without rotation, namely, in the standby state.

FIG. 19B shows the timing chart of operations in which the cam rings 53 rotate to enlarge the gap of the nipping portion when the front end of the first page of the recording sheets P is conveyed to the nipping portion, and the cam rings 53 rotate to eliminate the gap of the nipping portion when the back end of the second page of the recording sheets P is conveyed to the nipping portion.

At time earlier than time t1, the latch claws 57 latch the rotation stopping claws 52, and the cam rings 53 are at rest without rotation, namely, in the standby state. At this moment, the cam radius is d-c0.

Immediately prior to time t1, the front end of the first page of the recording sheets P arrives at the nipping portion, and when the paper-resisting sensor 21 detects that the thickness of the first page of the recording sheets P is greater than the threshold value, the latch claws 57 release the rotation stopping claws 52 on the right side and the left side at the same time, and the cam rings 53 start to rotate.

At time t1, the device is in the state shown in FIG. 11A, and the front end of the front inclined-portion 54*a* is on the inter-axle segment. The cam rings 53 rotate from time t1 to time t2, and at time t2, the device is in the state shown in FIG. 11C, and the back end of the front inclined-portion 54*a* is on the inter-axle segment. At time t2, the gap of the nipping portion is enlarged, and the cam radius is d-c1.

The cam rings 53 rotate further from time t2 to time tf1, and at time tf1, the front end of the first page of the recording sheets P arrives at the nipping portion, namely, the device is in the state shown in FIG. 11D, and the distance from the center of the secondary transfer roller axles 15*a* to the surface of the opposite roller 9 is d-pmid.

At time tf1, rotation of the cam rings 53 is stopped for a while, and the gap of the nipping portion remains enlarged.

At time te1, the back end of the first page of the recording sheets P arrives at the nipping portion, and at time tf2, the front end of the second page of the recording sheets P arrives at the nipping portion.

At time te2, the back end of the second page of the recording sheets P arrives at the nipping portion. The cam rings 53 rotate from time te2 to time t13, and at time t13, the back end of the back inclined-portion 54*b* is on the inter-axle segment. The cam rings 53 rotate from time t13 to time t14, and at time t14, the front end of the back inclined-portion 54*b* is on the inter-axle segment. At time t14, the gap of the nipping portion is reduced to zero, and the cam radius is d-c0. Then, the latch claws 57 latch the rotation stopping claws 52, and the cam rings 53 are at rest without rotation, namely, in the standby state.

Figure 20A:
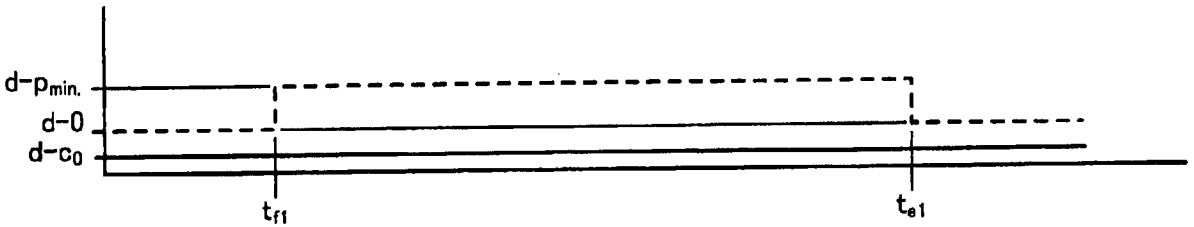
FIG. 20A and FIG. 20B are timing charts illustrating timings of rotational operations of the cam ring 53 when printing a thin recording sheet P.
Figure 20B:
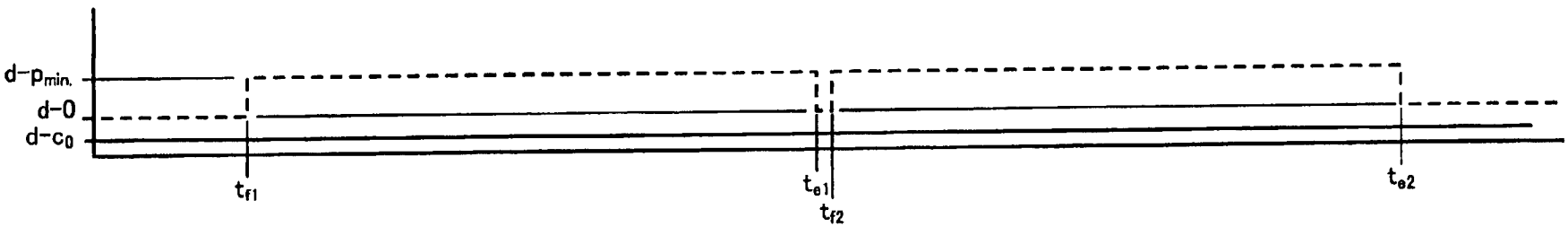

FIG. 20A and FIG. 20B are timing charts illustrating timings of rotational operations of the cam ring 53 when printing a thin recording sheet P.

FIG. 20A shows the timing chart illustrating that the cam rings 53 are resting without rotation since the thickness of the recording sheet P is less than the threshold value.

At time earlier than time t1, the latch claws 57 latch the rotation stopping claws 52, and the cam rings 53 are at rest without rotation, namely, in the standby state.

At time tf1, the front end of the recording sheet P arrives at the nipping portion, and the distance from the center of the secondary transfer roller axles 15*a* to the surface of the opposite roller 9 is d-pmin. The distance d-pmin corresponds to the height from the secondary transfer roller axle 15*a* to the transfer surface of the thin recording sheet P.

At time te1, the back end of the recording sheet P arrives at the nipping portion, and the distance from the secondary transfer roller axles 15*a* to the surface of the opposite roller 9 is d-0.

FIG. 20B shows the timing chart illustrating that the cam rings 53 are resting without rotation since the thickness of the first page and the second page of two recording sheets P is less than the threshold value.

At time earlier than time tf1, the latch claws 57 latch the rotation stopping claws 52, and the cam rings 53 are at rest without rotation, namely, in the standby state.

At time tf1, the front end of the first page of the recording sheets P arrives at the nipping portion, and the distance from the center of the secondary transfer roller axles 15*a* to the surface of the opposite roller 9 is d-pmin.

At time te1, the back end of the first page of the recording sheets P arrives at the nipping portion, and the distance from the secondary transfer roller axles 15*a* to the surface of the opposite roller 9 is d-0.

At time tf2, the front end of the second page of the recording sheets P arrives at the nipping portion, and the distance from the center of the secondary transfer roller axles 15*a* to the surface of the opposite roller 9 is d-pmin.

At time te2, the back end of the second page of the recording sheets P arrives at the nipping portion, and the distance from the center of the secondary transfer roller axles 15*a* to the surface of the opposite roller 9 is d-0.

In the above, descriptions are made of the timing charts when printing thick, moderately thick, and thin recording sheets P. Below, with reference to drawings in FIG. 21 through FIG. 33, descriptions are made of cases in which the cam rings 53 at the two ends of the secondary transfer roller 15 may have the same shape or different shapes, and may have the same or different rotational phases.

Below, for convenience of description, one of the cam rings 53 at the two ends of the secondary transfer roller 15 on the left side, when viewing against the direction of conveying the recording sheet P, is referred to as "a front cam ring 53", and the cam ring 53 on the right side is referred to as "a rear cam ring 53". Below, it is assumed that the front cam ring 53 and the rear cam ring 53 have the same rotational speed.

In FIG. 21 through FIG. 33, the first radius of the front cam ring 53 is represented to be d-cf1, and the first radius of the rear cam ring 53 is represented to be d-cr1, the second radius of the front cam ring 53 is represented to be d-cf0, and the second radius of the rear cam ring 53 is represented to be d-cr0. FIG. 21 through FIG. 27 show timing charts of rotational operations of the cam ring 53 when printing very thick recording sheets P.

In the timing charts shown in FIGS. 21, 23, 25, 27, 29, 30, 32, the rotational operation of the front cam ring 53 is indicated by solid lines, the rotational operation of the rear cam ring 53 is indicated by dot-dashed lines, and the operation of conveyance of the recording sheet P is indicated by dashed lines. Further, the solid lines and the dot-dashed lines represent cam radii.

Figure 21:
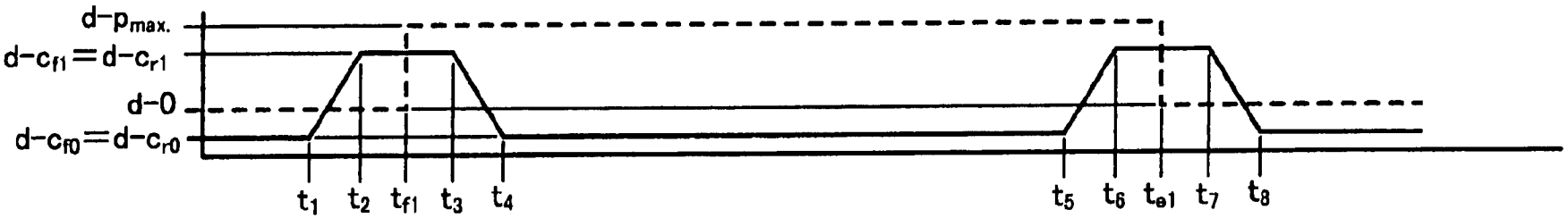
FIG. 21 is a timing chart illustrating rotational operations of the front cam ring 53 and the rear cam ring 53 which have the same first radius, the same second radius, the same first portion, and the same second portion, the first portions of which have the same rotational phase.

FIG. 21 is a timing chart illustrating rotational operations of the front cam ring 53 and the rear cam ring 53 when the front cam ring 53 and the rear cam ring 53 have the same first radius, the same second radius, the same first portion (the cam projection portion 55), the same second portion (the peripheral portion 53*a* of the cam ring 53), and the front cam ring 53 and the rear cam ring 53 rotate such that the first portions of the front cam ring 53 and the rear cam ring 53 have the same rotational phase.

At time earlier than time t1, the latch claws 57 latch the rotation stopping claws 52, and the cam rings 53 are at rest without rotation, namely, in the standby state.

Figure 22B:
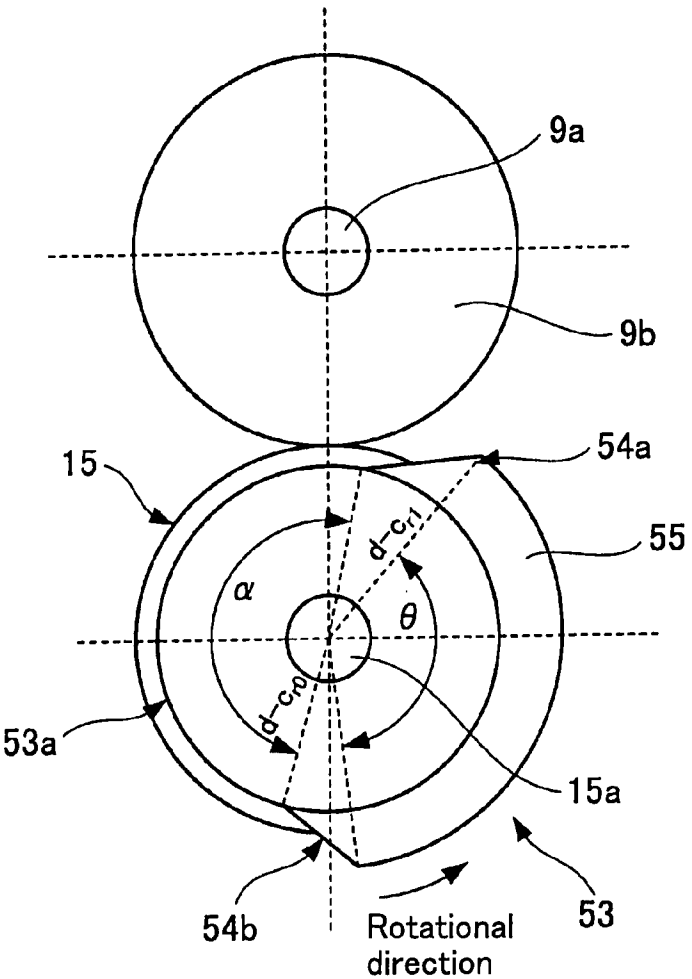
FIG. 22A and FIG. 22B are diagrams illustrating the front cam ring 53 and the rear cam ring 53 in the standby state.
Figure 22A:
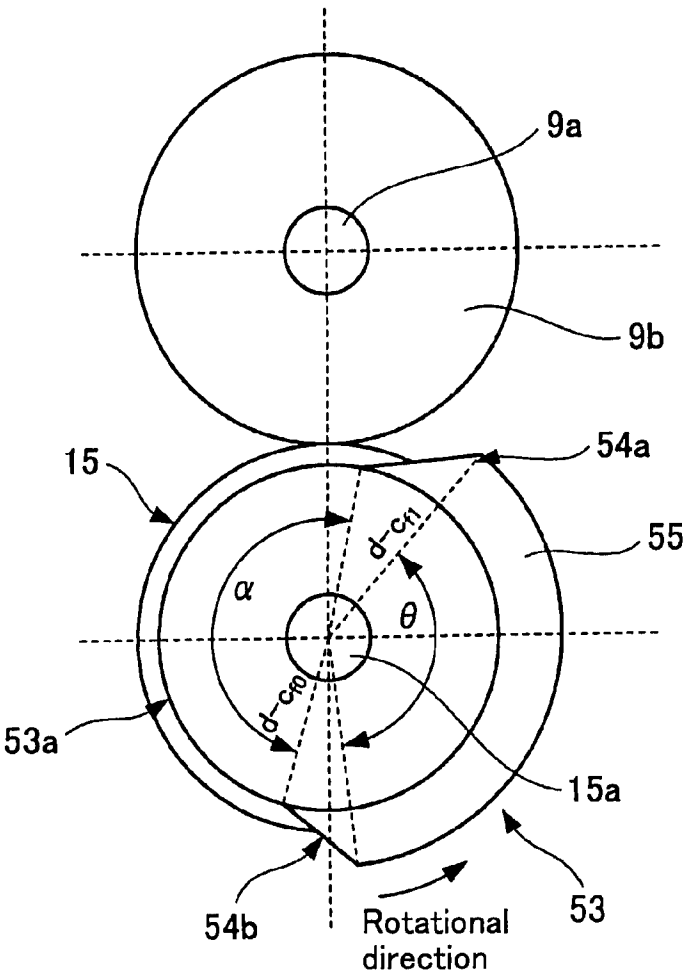

FIG. 22A and FIG. 22B are diagrams illustrating the front cam ring 53 and the rear cam ring 53 in the standby state.

Specifically, FIG. 22A shows the front cam ring 53, and FIG. 22B shows the rear cam ring 53.

In FIG. 22A, the first portion of the front cam ring 53 has the first radius of d-cf1, and subtends an angle θ; the second portion of the front cam ring 53 has the second radius of d-cf0, and subtends an angle α.

In FIG. 22B, the first portion of the rear cam ring 53 has the first radius of d-cr1, and subtends an angle θ; the second portion of the front cam ring 53 has the second radius of d-cr0, and subtends an angle α. The front cam ring 53 and the rear cam ring 53 are in the standby state such that the first portions of the front cam ring 53 and the rear cam ring 53 have the same rotational phase when the front cam ring 53 and the rear cam ring 53 rotate.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front ends of the front inclined-portions 54*a* of the front cam ring 53 and the rear cam ring 53 are on the inter-axle segment. The cam rings 53 rotate from time t1 to time t2, and at time t2, the back ends of the front inclined-portions 54*a* of the front cam ring 53 and the rear cam ring 53 are on the inter-axle segment.

At time t2, the gap of the nipping portion is enlarged, the cam radius of the front cam ring 53 is d-cf1, and the cam radius of the rear cam ring 53 is d-cr1. The length of d-cf1 is equal to the length of d-cr1.

The cam rings 53 rotate further from time t2 to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back ends of the back inclined-portions 54*b* of the front cam ring 53 and the rear cam ring 53 are on the inter-axle segment.

The cam rings 53 rotate from time t3 to time t4, and at time t4, the front ends of the back inclined-portions 54*b* of the front cam ring 53 and the rear cam ring 53 are on the inter-axle segment. At time t4, the gap of the nipping portion is reduced to zero, the cam radius of the front cam ring 53 is d-cf0, and the cam radius of the rear cam ring 53 is d-cr0. Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front ends of the front inclined-portions 54*a* of the front cam ring 53 and the rear cam ring 53 are on the inter-axle segment. The cam rings 53 rotate from time t5 to time t6, and at time t6, the back ends of the front inclined-portions 54*a* of the front cam ring 53 and the rear cam ring 53 are on the inter-axle segment. The cam rings 53 rotate further from time t6 to time te1, and at time te1, the back end of the recording sheet P arrives at the nipping portion, and the distance from the center of the secondary transfer roller axles 15*a* to the surface of the opposite roller 9 is d-cf1. The cam rings 53 rotate from time te1 to time t7, and at time t7, the back ends of the back inclined-portions 54*b* of the front cam ring 53 and the rear cam ring 53 are on the inter-axle segment. The cam rings 53 rotate from time t7 to time t8, and at time t8, the front ends of the back inclined-portions 54*b* of the front cam ring 53 and the rear cam ring 53 are on the inter-axle segment. At time t8, the gap of the nipping portion is reduced to zero, the cam radius of the front cam ring 53 is d-cf0, and the cam radius of the rear cam ring 53 is d-cr0. Then, the latch claws 57 latch the rotation stopping claws 52, and the cam rings 53 are at rest without rotation, namely, in the standby state.

Figure 23:
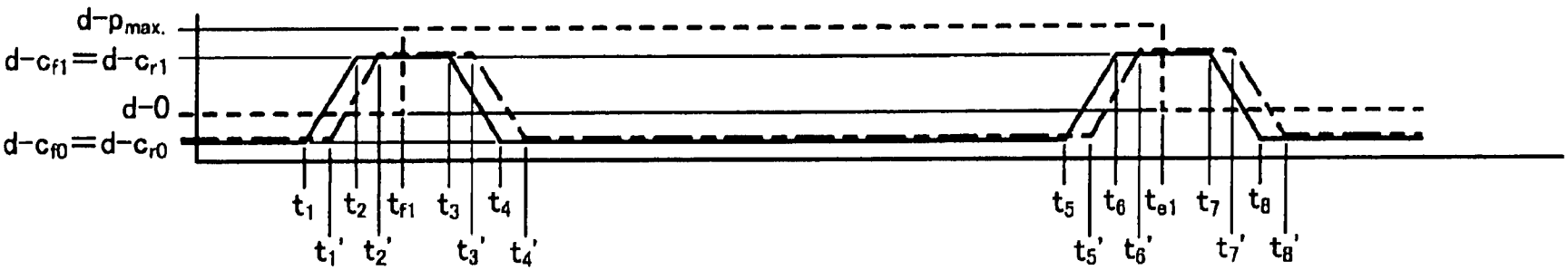
FIG. 23 is a timing chart illustrating rotational operations of the front cam ring 53 and the rear cam ring 53 which have the same first radius, the same second radius, the same first portion, and the same second portion, and the first portions of which have different rotational phases.

FIG. 23 is a timing chart illustrating rotational operations of the front cam ring 53 and the rear cam ring 53 when the front cam ring 53 and the rear cam ring 53 have the same first radius, the same second radius, the same first portion (the cam projection portion 55), the same second portion (the peripheral portion 53*a* of the cam ring 53), and the front cam ring 53 and the rear cam ring 53 rotate such that the first portions of the front cam ring 53 and the rear cam ring 53 have different rotational phases.

At time earlier than time t1, the latch claws 57 latch the rotation stopping claws 52, and the cam rings 53 are at rest without rotation, namely, in the standby state.

Figure 24A:
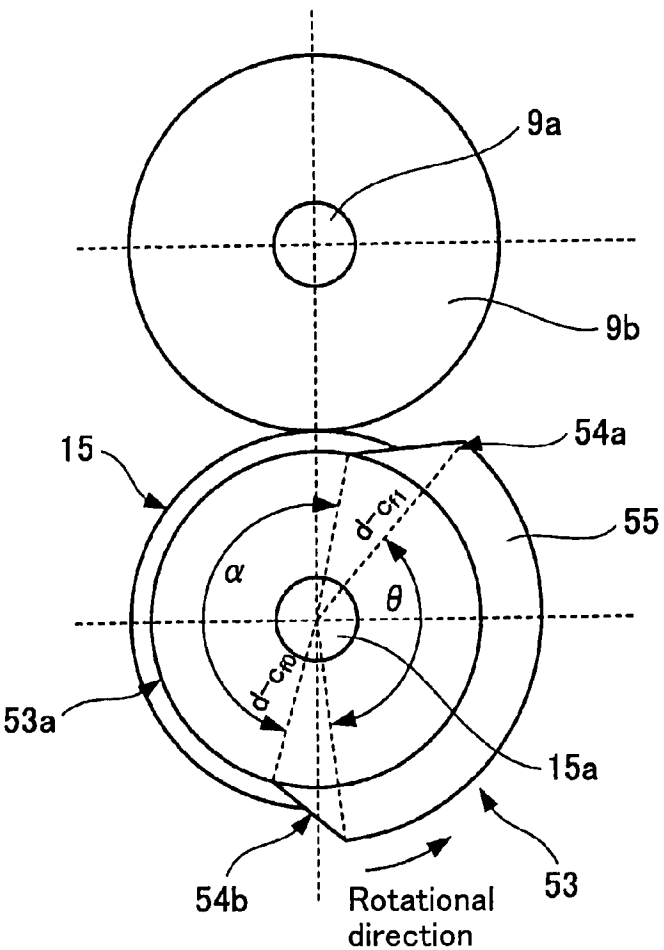
FIG. 24A and FIG. 24B are diagrams illustrating the front cam ring 53 and the rear cam ring 53 in the standby state.
Figure 24B:
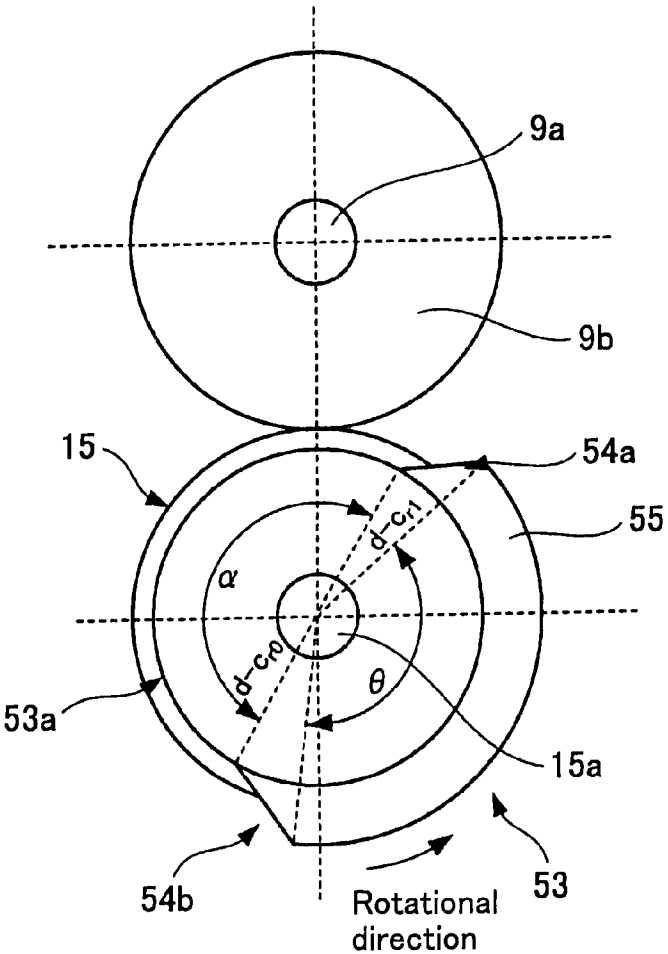

FIG. 24A and FIG. 24B are diagrams illustrating the front cam ring 53 and the rear cam ring 53 in the standby state.

Specifically, FIG. 24A shows the front cam ring 53, and FIG. 24B shows the rear cam ring 53.

In FIG. 24A, the first portion of the front cam ring 53 has the first radius of d-cf1, and subtends an angle θ; the second portion of the front cam ring 53 has the second radius of d-cf0, and subtends an angle α.

In FIG. 24B, the first portion of the rear cam ring 53 has the first radius of d-cr1, and subtends an angle θ; the second portion of the front cam ring 53 has the second radius of d-cr0, and subtends an angle α. Here, the front cam ring 53 and the rear cam ring 53 are in the standby state such that when the front cam ring 53 and the rear cam ring 53 rotate, the first portions of the front cam ring 53 and the rear cam ring 53 have different rotational phases.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front end of the front inclined-portion 54*a* of the front cam ring 53 is on the inter-axle segment, and at time t1', the front end of the front inclined-portion 54*a* of the rear cam ring 53 is on the inter-axle segment.

The cam rings 53 rotate from time t1 to time t2, and at time t2, the back end of the front inclined-portion 54*a* of the front cam ring 53 is on the inter-axle segment. At time t2, the cam radius of the front cam ring 53 is d-cf1.

The cam rings 53 rotate from time t1' to time t2', and at time t2', the back end of the front inclined-portion 54*a* of the rear cam ring 53 is on the inter-axle segment. At time t2', the cam radius of the rear cam ring 53 is d-cr1.

The cam rings 53 rotate further from time t2' to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back end of the back inclined-portion 54*b* of the front cam ring 53 is on the inter-axle segment. At time t3', the back end of the back inclined-portion 54*b* of the rear cam ring 53 is on the inter-axle segment.

The cam rings 53 rotate from time t3 to time t4, and at time t4, the front end of the back inclined-portion 54*b* of the front cam ring 53 is on the inter-axle segment. At time t4, the cam radius of the front cam ring 53 is d-cf0.

The cam rings 53 rotate from time t3' to time t4', and at time t4', the front end of the back inclined-portion 54*b* of the rear cam ring 53 is on the inter-axle segment. At time t4', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front end of the front inclined-portion 54*a* of the front cam ring 53 is on the inter-axle segment. At time t5', the front end of the front inclined-portion 54*a* of the rear cam ring 53 is on the inter-axle segment.

The cam rings 53 rotate from time t5 to time t6, and at time t6, the back end of the front inclined-portion 54*a* of the front cam ring 53 is on the inter-axle segment. At time t6, the cam radius of the front cam ring 53 is d-cf1.

The cam rings 53 rotate from time t5' to time t6', and at time t6', the back end of the front inclined-portion 54*a* of the rear cam ring 53 is on the inter-axle segment. At time t6', the cam radius of the rear cam ring 53 is d-cr1.

The cam rings 53 rotate further from time t6' to time te1, and at time te1, the back end of the recording sheet P arrives at the nipping portion, and the distance from the center of the secondary transfer roller axles 15*a* to the surface of the opposite roller 9 is d-cf1.

The cam rings 53 rotate from time te1 to time t7, and at time t7, the back end of the back inclined-portions 54*b* of the front cam ring 53 is on the inter-axle segment. At time t7', the back end of the back inclined-portion 54*b* of the rear cam ring 53 is on the inter-axle segment.

The cam rings 53 rotate from time t7 to time t8, and at time t8, the front end of the back inclined-portions 54*b* of the front cam ring 53 is on the inter-axle segment. At time t8, the cam radius of the front cam ring 53 is d-cf0.

The cam rings 53 rotate from time t7' to time t8', and at time t8', the front end of the back inclined-portion 54*b* of the rear cam ring 53 is on the inter-axle segment. At time t8', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

Figure 25:
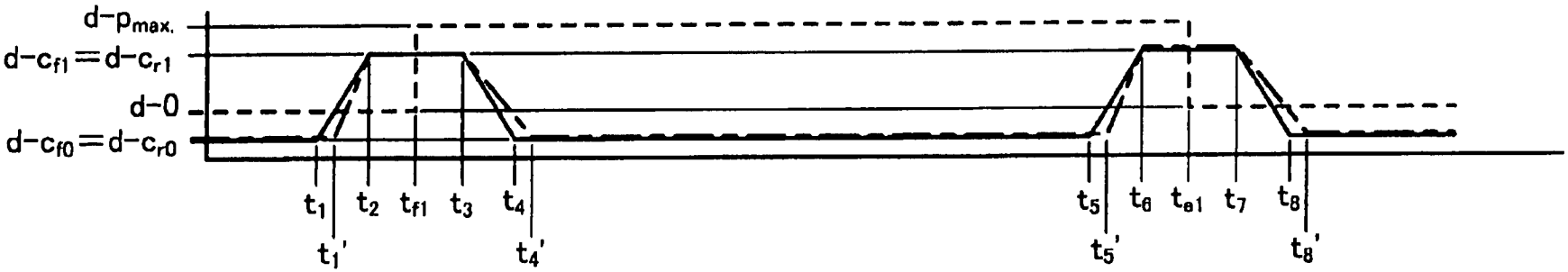
FIG. 25 is a timing chart illustrating rotational operations of the front cam ring 53 and the rear cam ring 53 which have the same first radius, the same second radius, and the same first portion, and the first portions of which have the same rotational phases, but the second portions of which have different lengths.

FIG. 25 is a timing chart illustrating rotational operations of the front cam ring 53 and the rear cam ring 53 when the front cam ring 53 and the rear cam ring 53 have the same first radius, the same second radius, the same first portion (the cam projection portion 55), and the front cam ring 53 and the rear cam ring 53 rotate such that the first portions of the front cam ring 53 and the rear cam ring 53 have the same rotational phases, but the second portions (the peripheral portion 53*a* of the cam ring 53) of the front cam ring 53 and the rear cam ring 53 have different lengths.

At time earlier than time t1, the latch claws 57 latch the rotation stopping claws 52, and the cam rings 53 are at rest without rotation, namely, in the standby state.

Figure 26B:
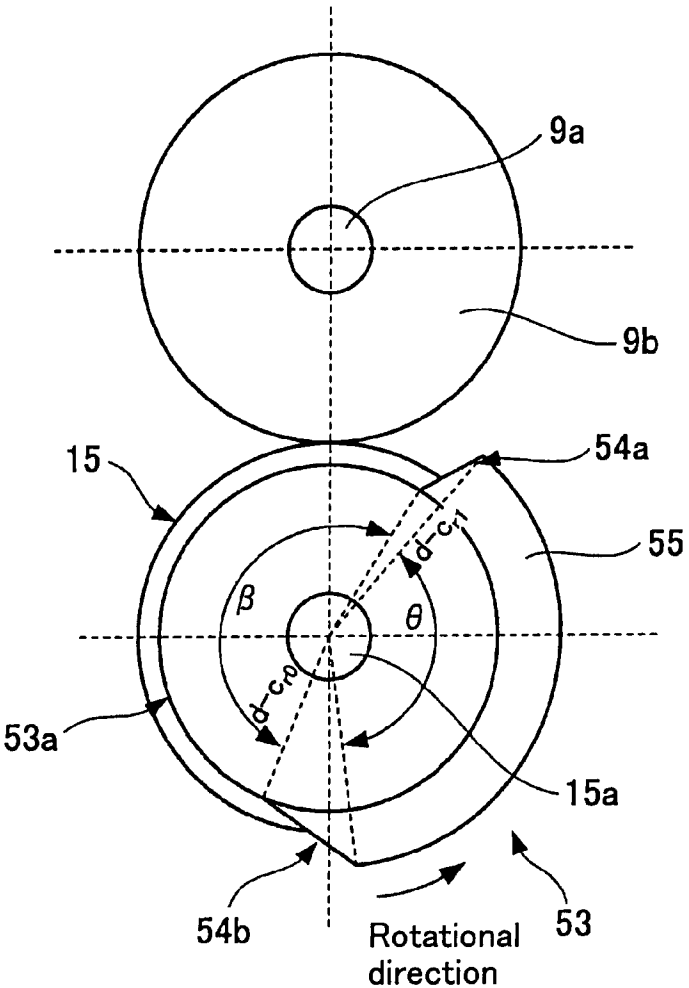
FIG. 26A and FIG. 26B are diagrams illustrating the front cam ring 53 and the rear cam ring 53 in the standby state.
Figure 26A:
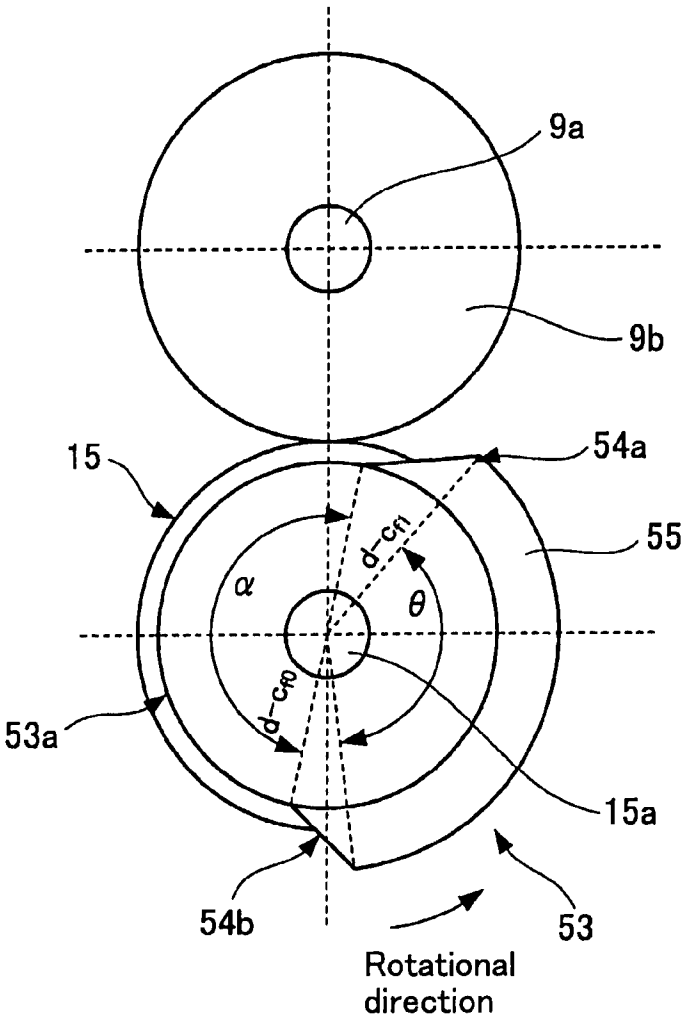

FIG. 26A and FIG. 26B are diagrams illustrating the front cam ring 53 and the rear cam ring 53 in the standby state.

Specifically, FIG. 26A shows the front cam ring 53, and FIG. 26B shows the rear cam ring 53.

In FIG. 26A, the first portion of the front cam ring 53 has the first radius of d-cf1, and subtends an angle θ, the second portion of the front cam ring 53 has the second radius of d-cf0, and subtends an angle α.

In FIG. 26B, the first portion of the rear cam ring 53 has the first radius of d-cr1, and subtends an angle θ, the second portion of the front cam ring 53 has the second radius of d-cr0, and subtends an angle β. Here, the front cam ring 53 and the rear cam ring 53 are in the standby state such that the first portions of the front cam ring 53 and the rear cam ring 53 have the same rotational phase when the front cam ring 53 and the rear cam ring 53 rotate.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front end of the front inclined-portion 54*a* of the front cam ring 53 is on the inter-axle segment, and at time t1', the front end of the front inclined-portion 54*a* of the rear cam ring 53 is on the inter-axle segment.

The cam rings 53 rotate from time t1 to time t2, and at time t2, the back ends of the front inclined-portions 54*a* of the front cam ring 53 and the rear cam ring 53 are on the inter-axle segment. At time t2, the cam radius of the front cam ring 53 is d-cf1, the cam radius of the rear cam ring 53 is d-cr1.

The cam rings 53 rotate further from time t2 to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back ends of the back inclined-portions 54*b* of the front cam ring 53 and the rear cam ring 53 are on the inter-axle segment.

The cam rings 53 rotate from time t3 to time t4, and at time t4, the front end of the back inclined-portion 54*b* of the front cam ring 53 is on the inter-axle segment. At time t4, the cam radius of the front cam ring 53 is d-cf0.

At time t4', the front end of the back inclined-portion 54*b* of the rear cam ring 53 is on the inter-axle segment. At time t4', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front end of the front inclined-portion 54*a* of the front cam ring 53 is on the inter-axle segment. At time t5', the front end of the front inclined-portion 54*a* of the rear cam ring 53 is on the inter-axle segment.

The cam rings 53 rotate from time t5 to time t6, and at time t6, the back ends of the front inclined-portions 54*a* of the front cam ring 53 and the rear cam ring 53 are on the inter-axle segment. At time t6, the cam radius of the front cam ring 53 is d-cf1, and the cam radius of the rear cam ring 53 is d-cr1.

The cam rings 53 rotate further from time t6 to time te1, and at time te1, the back end of the recording sheet P arrives at the nipping portion, and the distance from the center of the secondary transfer roller axles 15*a* to the surface of the opposite roller 9 is d-cf1.

The cam rings 53 rotate from time te1 to time t7, and at time t7, the back ends of the back inclined-portions 54*b* of the front cam ring 53 and the rear cam ring 53 are on the inter-axle segment.

The cam rings 53 rotate from time t7 to time t8, and at time t8, the front end of the back inclined-portions 54*b* of the front cam ring 53 is on the inter-axle segment. At time t8, the cam radius of the front cam ring 53 is d-cf0.

At time t8', the front end of the back inclined-portion 54*b* of the rear cam ring 53 is on the inter-axle segment. At time t8', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

Figure 27:
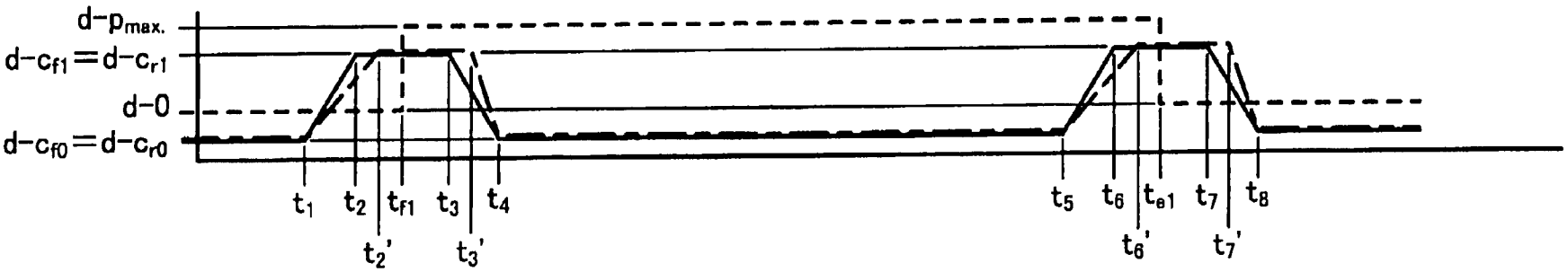
FIG. 27 is a timing chart illustrating rotational operations of the front cam ring 53 and the rear cam ring 53 which have the same first radius, the same second radius, and the same second portion, the second portions of which have the same rotational phases, but the first portions of which have different lengths.

FIG. 27 is a timing chart illustrating rotational operations of the front cam ring 53 and the rear cam ring 53 when the front cam ring 53 and the rear cam ring 53 have the same first radius, the same second radius, the same second portion (the peripheral portion 53*a* of the cam ring 53), and the front cam ring 53 and the rear cam ring 53 rotate such that the second portions of the front cam ring 53 and the rear cam ring 53 have the same rotational phases, but the first portions (the cam projection portion 55) of the front cam ring 53 and the rear cam ring 53 have different lengths.

At time earlier than time t1, the latch claws 57 latch the rotation stopping claws 52, and the cam rings 53 are at rest without rotation, namely, in the standby state.

Figure 28B:
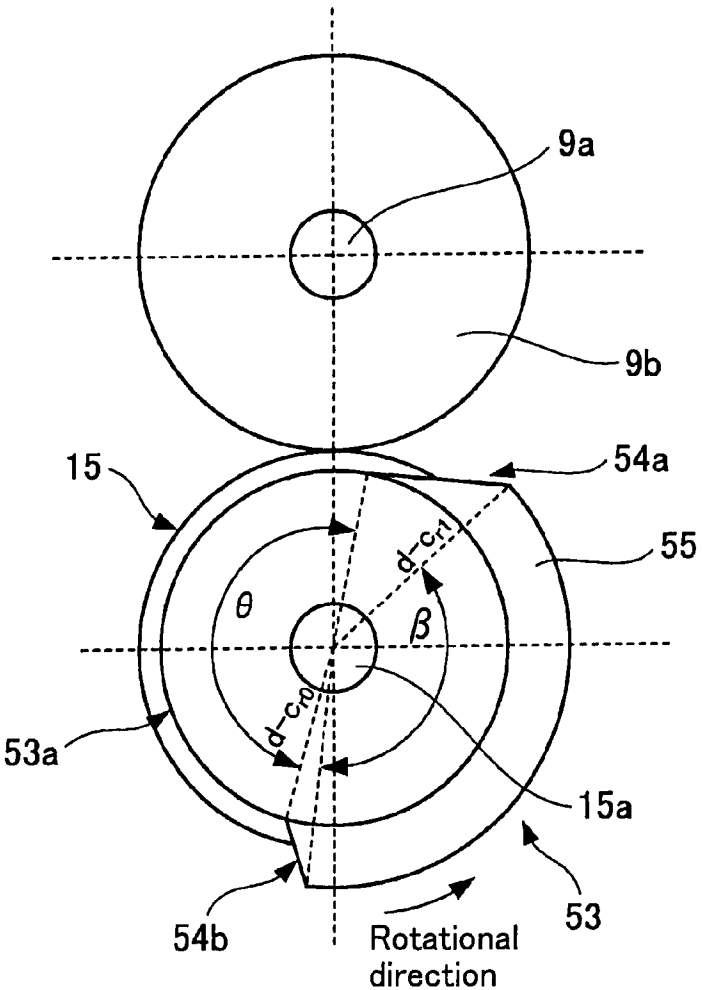
FIG. 28A and FIG. 28B are diagrams illustrating the front cam ring 53 and the rear cam ring 53 in the standby state.
Figure 28A:
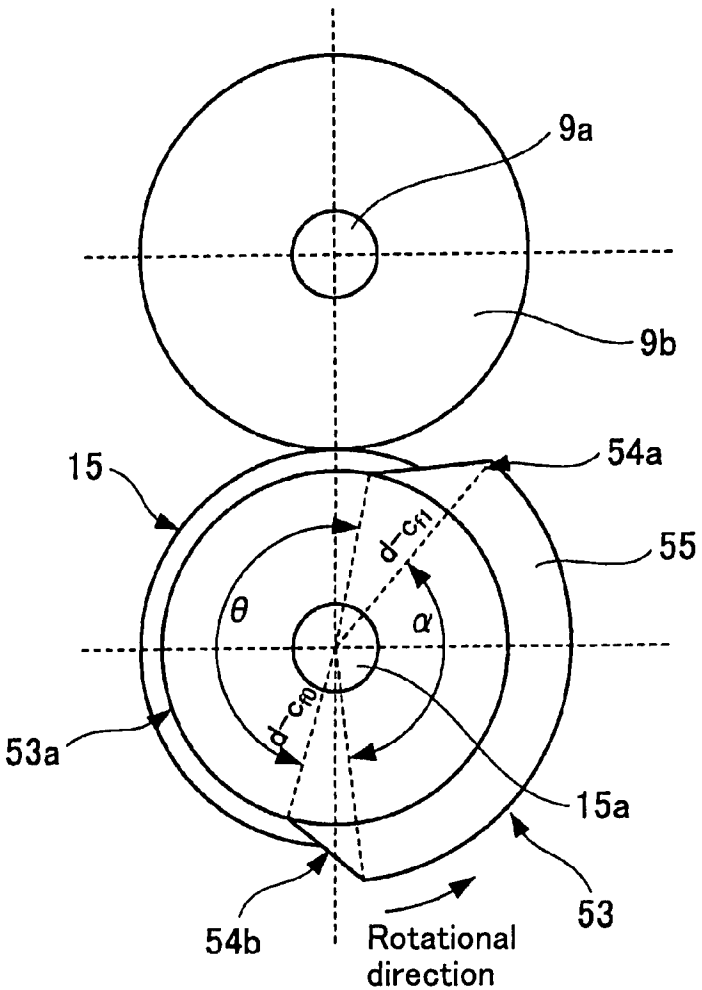

FIG. 28A and FIG. 28B are diagrams illustrating the front cam ring 53 and the rear cam ring 53 in the standby state.

Specifically, FIG. 28A shows the front cam ring 53, and FIG. 28B shows the rear cam ring 53.

In FIG. 28A, the first portion of the front cam ring 53 has the first radius of d-cf1, and subtends an angle α, the second portion of the front cam ring 53 has the second radius of d-cf0, and subtends an angle θ.

In FIG. 28B, the first portion of the rear cam ring 53 has the first radius of d-cr1, and subtends an angle β, the second portion of the front cam ring 53 has the second radius of d-cr0, and subtends an angle θ. Here, the front cam ring 53 and the rear cam ring 53 are in the standby state such that when the front cam ring 53 and the rear cam ring 53 rotate, the second portions of the front cam ring 53 and the rear cam ring 53 have the same rotational phase.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front ends of the front inclined-portions 54*a* of the front cam ring 53 and the rear cam ring 53 are on the inter-axle segment.

The cam rings 53 rotate from time t1 to time t2, and at time t2, the back end of the front inclined-portion 54*a* of the front cam ring 53 is on the inter-axle segment. At time t2', the back end of the front inclined-portion 54*a* of the rear cam ring 53 is on the inter-axle segment. At time t2, the cam radius of the front cam ring 53 is d-cf1, and at time t2', the cam radius of the rear cam ring 53 is d-cr1.

The cam rings 53 rotate further from time t2' to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back end of the back inclined-portion 54*b* of the front cam ring 53 is on the inter-axle segment. At time t3', the back end of the back inclined-portion 54*b* of the rear cam ring 53' is on the inter-axle segment.

The cam rings 53 rotate from time t3 to time t4, and at time t4, the front ends of the back inclined-portions 54*b* of the front cam ring 53 and the rear cam ring 53 are on the inter-axle segment. At time t4, the gap of the nipping portion is reduced to zero, and the cam radius of the front cam ring 53 is d-cf0, and the cam radius of the rear cam ring 53 is d-cr0.

Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front ends of the front inclined-portions 54*a* of the front cam ring 53 and the rear cam ring 53 are on the inter-axle segment.

The cam rings 53 rotate from time t5 to time t6, and at time t6, the back end of the front inclined-portion 54*a* of the front cam ring 53 is on the inter-axle segment. At time t6', the back end of the front inclined-portion 54*a* of the rear cam ring 53 is on the inter-axle segment. At time t6, the cam radius of the front cam ring 53 is d-cf1, and at time t6', the cam radius of the rear cam ring 53 is d-cr1.

The cam rings 53 rotate further from time t6' to time te1, and at time te1, the back end of the recording sheet P arrives at the nipping portion, and the distance from the center of the secondary transfer roller axles 15*a* to the surface of the opposite roller 9 is d-cf1.

The cam rings 53 rotate from time te1 to time t7, and at time t7, the back end of the back inclined-portion 54*b* of the front cam ring 53 is on the inter-axle segment. At time t7', the back end of the back inclined-portion 54*b* of the rear cam ring 53 is on the inter-axle segment.

The cam rings 53 rotate from t7' to time t8, and at time t8, the front ends of the back inclined-portions 54*b* of the front cam ring 53 and the rear cam ring 53 are on the inter-axle segment. At time t8, the gap of the nipping portion is reduced to zero, and the cam radius of the front cam ring 53 is d-cf0, and the cam radius of the rear cam ring 53 is d-cr0.

Then, the latch claws 57 latch the rotation stopping claws 52, and the cam rings 53 are at rest without rotation, namely, in the standby state.

Figure 29:
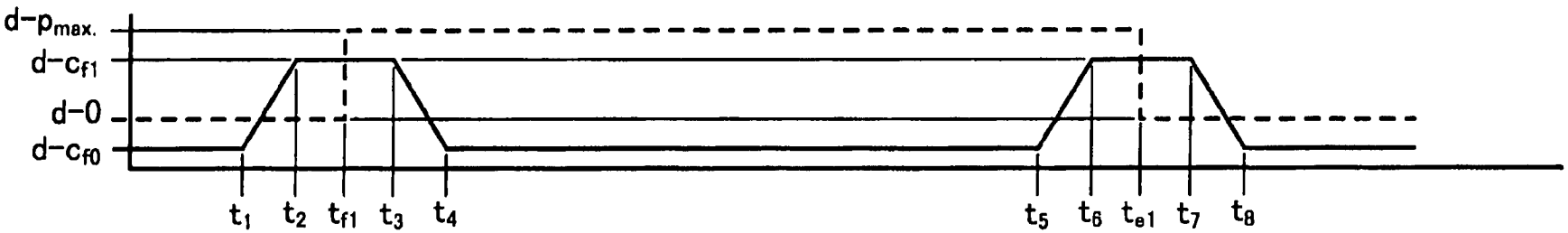
FIG. 29 is a timing chart illustrating rotational operations of the cam ring 53 when only one cam ring 53 is provided on one side of the transfer pressure adjustment region Wc.

FIG. 29 is a timing chart illustrating rotational operations of the cam ring 53 when only one cam ring 53 is provided on one side of the transfer pressure adjustment region Wc.

The condition of the cam ring 53 is the same as that shown in FIG. 22A.

At time earlier than time t1, the latch claws 57 latch the rotation stopping claws 52, and the cam ring 53 is at rest without rotation, namely, in the standby state. The cam radius of the cam ring 53 is d-cf0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the cam ring 53 starts to rotate.

At time t1, the front end of the front inclined-portion 54*a* of the cam ring 53 is on the inter-axle segment. The cam ring 53 rotates from time t1 to time t2, and at time t2, the back end of the front inclined-portion 54*a* of the cam ring 53 is on the inter-axle segment. At time t2, the gap of the nipping portion is enlarged, and the cam radius of the cam ring 53 is d-cf1.

The cam ring 53 rotates further from time t2 to time tf1, and at time tf1, the front end of the recording sheet P arrives at the nipping portion, and the distance from the center of the secondary transfer roller axles 15*a* to the surface of the opposite roller 9 is d-pmax.

The cam ring 53 rotates from time tf1 to time t3, and at time t3, the back end of the back inclined-portion 54*b* of the cam ring 53 is on the inter-axle segment.

The cam ring 53 rotates from time t3 to time t4, and at time t4, the front end of the back inclined-portion 54*b* of the cam ring 53 is on the inter-axle segment. At time t4, the gap of the nipping portion is reduced to zero, and the cam radius of the cam ring 53 is d-cf0. Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the cam ring 53 start to rotate.

At time t5, the front end of the front inclined-portion 54*a* of the cam ring 53 is on the inter-axle segment. The cam ring 53 rotates from time t5 to time t6, and at time t6, the back end of the front inclined-portion 54*a* of the cam ring 53 is on the inter-axle segment. The cam ring 53 rotates further from time t6 to time te1, and at time te1, the back end of the recording sheet P arrives at the nipping portion, and the distance from the center of the secondary transfer roller axles 15*a* to the surface of the opposite roller 9 is d-cf1. The cam ring 53 rotates from time te1 to time t7, and at time t7, the back end of the back inclined-portion 54*b* of the cam ring 53 is on the inter-axle segment. The cam ring 53 rotates from time t7 to time t8, and at time t8, the front end of the back inclined-portion 54*b* of the cam ring 53 is on the inter-axle segment. At time t8, the gap of the nipping portion is reduced to zero, and the cam radius of the cam ring 53 is d-cf0. Then, the latch claws 57 latch the rotation stopping claws 52, and the cam rings 53 are at rest without rotation, namely, in the standby state.

Figure 30:
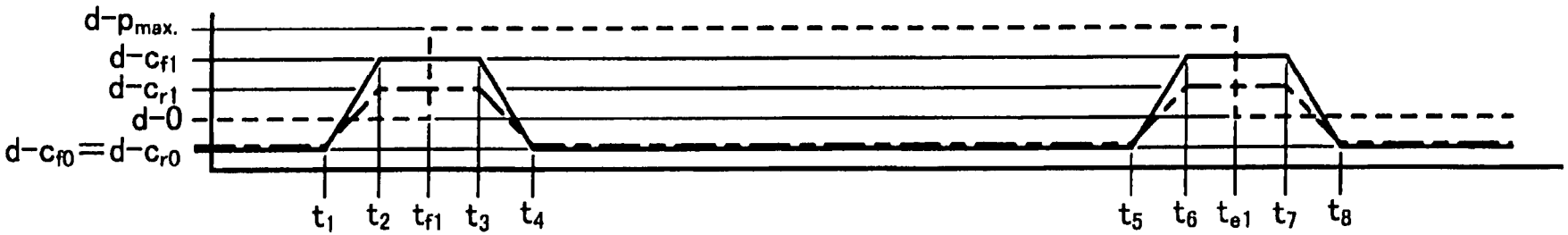
FIG. 30 is a timing chart illustrating rotational operations of the front cam ring 53 and the rear cam ring 53 which have the same second radius and the same second portion, the first portions of which have the same rotational phases, and the first radii, the lengths of the first portions of which are different.

FIG. 30 is a timing chart illustrating rotational operations of the front cam ring 53 and the rear cam ring 53 when the front cam ring 53 and the rear cam ring 53 have the same second radius, the same second portion (the peripheral portion 53*a* of the cam ring 53), and the front cam ring 53 and the rear cam ring 53 rotate such that the first portions of the front cam ring 53 and the rear cam ring 53 have the same rotational phases, but the first radii, and the lengths of the first portions (the cam projection portion 55) of the front cam ring 53 and the rear cam ring 53 are different.

At time earlier than time t1, the latch claws 57 latch the rotation stopping claws 52, and the cam rings 53 are at rest without rotation, namely, in the standby state.

Figure 31A:
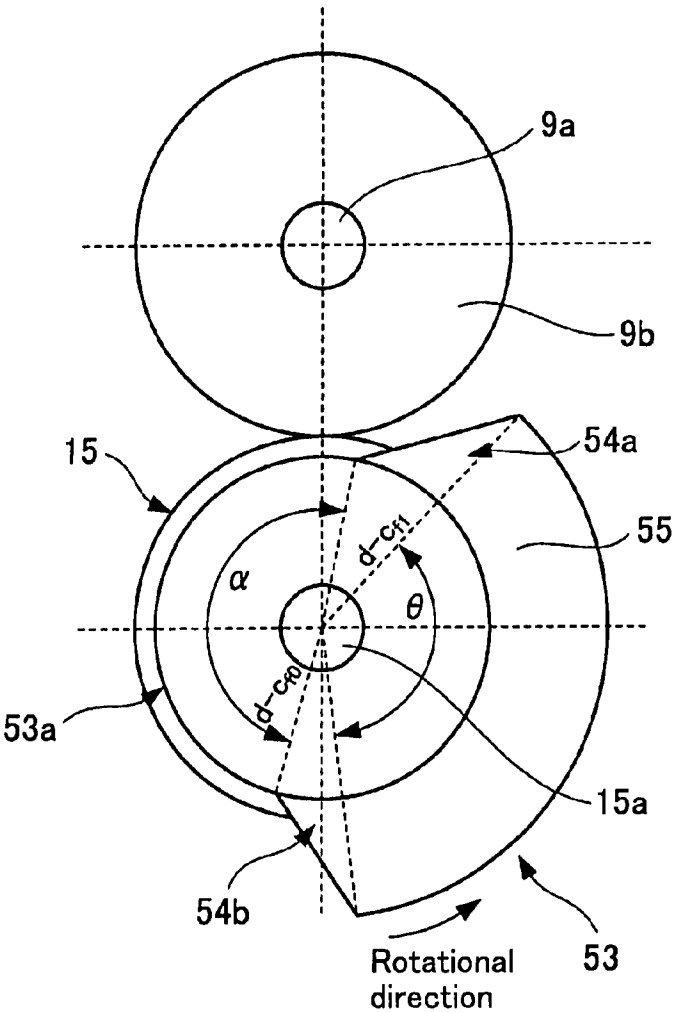
FIG. 31A and FIG. 31B are diagrams illustrating the front cam ring 53 and the rear cam ring 53 in the standby state.
Figure 31B:
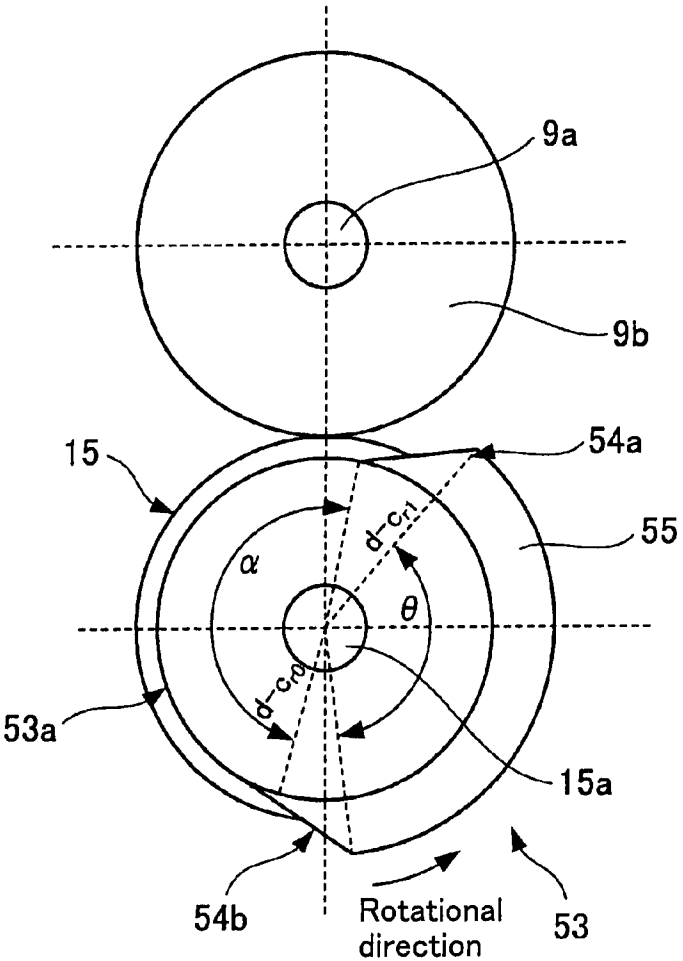

FIG. 31A and FIG. 31B are diagrams illustrating the front cam ring 53 and the rear cam ring 53 in the standby state.

Specifically, FIG. 31A shows the front cam ring 53, and FIG. 32B shows the rear cam ring 53. In FIG. 31A, the first portion of the front cam ring 53 has the first radius of d-cf1, and subtends an angle θ, the second portion of the front cam ring 53 has the second radius of d-cf0, and subtends an angle α.

In FIG. 31B, the first portion of the rear cam ring 53 has the first radius of d-cr1, and subtends an angle θ, the second portion of the front cam ring 53 has the second radius of d-cr0, and subtends an angle α. Here, the front cam ring 53 and the rear cam ring 53 are in the standby state such that the first portions of the front cam ring 53 and the rear cam ring 53 have the same rotational phase when the front cam ring 53 and the rear cam ring 53 rotate.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front ends of the front inclined-portions 54*a* of the front cam ring 53 and the rear cam ring 53 are on the inter-axle segment.

The cam rings 53 rotate from time t1 to time t2, and at time t2, the back ends of the front inclined-portions 54*a* of the front cam ring 53 and the rear cam ring 53 are on the inter-axle segment. At time t2, the gap of the nipping portion is reduced to zero, and the cam radius of the front cam ring 53 is d-cf1, and the cam radius of the rear cam ring 53 is d-cr1.

The cam rings 53 rotate further from time t2 to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back ends of the back inclined-portions 54*b* of the front cam ring 53 and the rear cam ring 53 are on the inter-axle segment.

The cam rings 53 rotate from time t3 to time t4, and at time t4, the front ends of the back inclined-portions 54*b* of the front cam ring 53 and the rear cam ring 53 are on the inter-axle segment. At time t4, the gap of the nipping portion is reduced to zero, and the cam radius of the front cam ring 53 is d-cf0, and the cam radius of the rear cam ring 53 is d-cr0.

Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front ends of the front inclined-portions 54*a* of the front cam ring 53 and the rear cam ring 53 are on the inter-axle segment. The cam rings 53 rotate from time t5 to time t6, and at time t6, the back ends of the front inclined-portion 54*a* of the front cam ring 53 and the rear cam ring 53 are on the inter-axle segment.

The cam rings 53 rotate further from time t6 to time te1, and at time te1, the back end of the recording sheet P arrives at the nipping portion, and the distance from the center of the secondary transfer roller axles 15*a* to the surface of the opposite roller 9 is d-cf1.

The cam rings 53 rotate from time te1 to time t7, and at time t7, the back ends of the back inclined-portions 54*b* of the front cam ring 53 and the rear cam ring 53 are on the inter-axle segment.

The cam rings 53 rotate from time t7 to time t8, and at time t8, the front ends of the back inclined-portions 54*b* of the front cam ring 53 and the rear cam ring 53 are on the inter-axle segment. At time t8, the gap of the nipping portion is reduced to zero, and the cam radius of the front cam ring 53 is d-cf0, and the cam radius of the rear cam ring 53 is d-cr0.

Then, the latch claws 57 latch the rotation stopping claws 52, and the cam rings 53 are at rest without rotation, namely, in the standby state.

Figure 32:
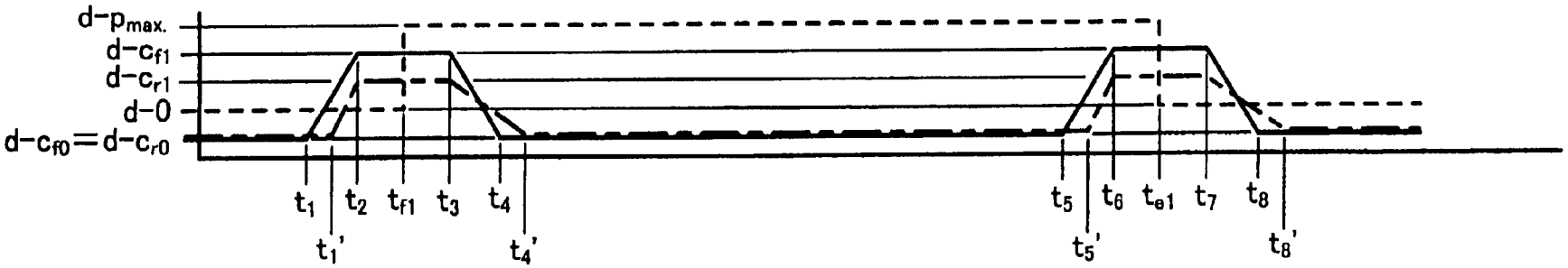
FIG. 32 is a timing chart illustrating rotational operations of the front cam ring 53 and the rear cam ring 53 which have the same second radius and the same first portions, the first portions of which have the same rotational phases, but the first radii and the lengths of the second portions of which are different.

FIG. 32 is a timing chart illustrating rotational operations of the front cam ring 53 and the rear cam ring 53 when the front cam ring 53 and the rear cam ring 53 have the same second radius, the same first portions (the cam projection portion 55), and the front cam ring 53 and the rear cam ring 53 rotate such that the first portions of the front cam ring 53 and the rear cam ring 53 have the same rotational phases, but the first radii and the lengths of the second portions (the peripheral portion 53*a* of the cam ring 53) of the front cam ring 53 and the rear cam ring 53 are different.

At time earlier than time t1, the latch claws 57 latch the rotation stopping claws 52, and the cam rings 53 are at rest without rotation, namely, in the standby state.

Figure 33A:
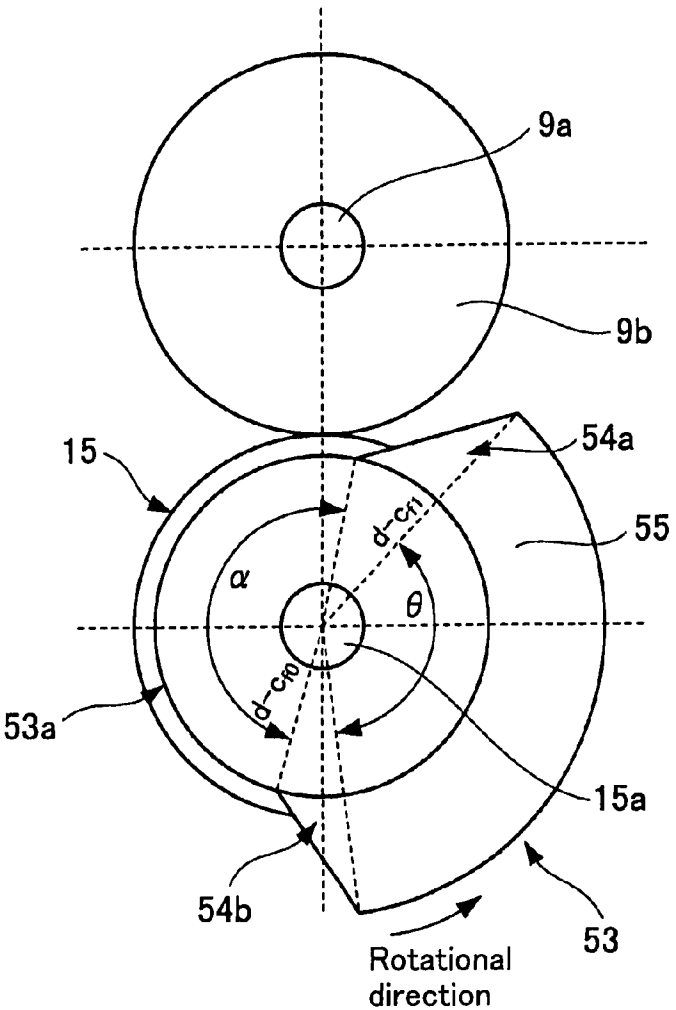
FIG. 33A and FIG. 33B are diagrams illustrating the front cam ring 53 and the rear cam ring 53 in the standby state.
Figure 33B:
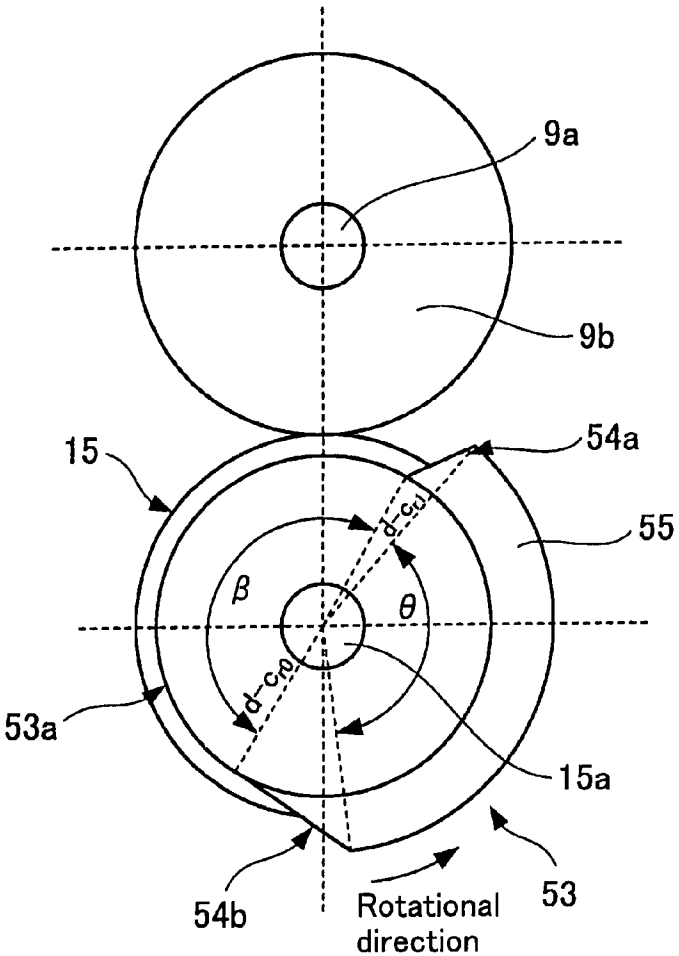

FIG. 33A and FIG. 33B are diagrams illustrating the front cam ring 53 and the rear cam ring 53 in the standby state.

Specifically, FIG. 33A shows the front cam ring 53, and FIG. 33B shows the rear cam ring 53. In FIG. 33A, the first portion of the front cam ring 53 has the first radius of d-cf1, and subtends an angle θ, the second portion of the front cam ring 53 has the second radius of d-cf0, and subtends an angle α.

In FIG. 33B, the first portion of the rear cam ring 53 has the first radius of d-cr1, and subtends an angle θ, the second portion of the front cam ring 53 has the second radius of d-cr0, and subtends an angle β. Here, the front cam ring 53 and the rear cam ring 53 are in the standby state such that the first portions of the front cam ring 53 and the rear cam ring 53 have the same rotational phase when the front cam ring 53 and the rear cam ring 53 rotate.

In the standby state, the cam radius of the front cam ring 53 is d-cf0, and the cam radius of the rear cam ring 53 is d-cr0.

Immediately prior to time t1, the front end of the recording sheet P arrives at the nipping portion, and when the paper-resisting sensor 21 detects that the thickness of the recording sheet P is greater than the threshold value, the latch claws 57 release the rotation stopping claws 52 on the right side and the left side at the same time, and the front cam ring 53 and the rear cam ring 53 start to rotate at the same time.

At time t1, the front end of the front inclined-portion 54*a* of the front cam ring 53 is on the inter-axle segment, and at time t1', the front end of the front inclined-portion 54*a* of the rear cam ring 53 is on the inter-axle segment.

The cam rings 53 rotate from time t1 to time t2, and at time t2, the back ends of the front inclined-portions 54*a* of the front cam ring 53 and the rear cam ring 53 are on the inter-axle segment. At time t2, the cam radius of the front cam ring 53 is d-cf1, and the cam radius of the rear cam ring 53 is d-cr1.

The cam rings 53 rotate further from time t2 to time tf1, and at time tf1, the front end of the recording sheet P arrives at the nipping portion, and the distance from the center of the secondary transfer roller axles 15*a* to the surface of the opposite roller 9 is d-pmax.

The cam rings 53 rotate from time tf1 to time t3, and at time t3, the back ends of the back inclined-portions 54*b* of the front cam ring 53 and the rear cam ring 53 are on the inter-axle segment.

The cam rings 53 rotate from time t3 to time t4, and at time t4, the front end of the back inclined-portion 54*b* of the front cam ring 53 is on the inter-axle segment. At time t4, the cam radius of the front cam ring 53 is d-cf0. At time t4', the front end of the back inclined-portion 54*b* of the rear cam ring 53 is on the inter-axle segment. At time t4', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

Next, immediately prior to time t5, when the paper-resisting sensor 21 detects that the back end of the recording sheet P arrives at the nipping portion, the latch claws 57 release the rotation stopping claws 52 on the right side and the left side at the same time, and the front cam ring 53 and the rear cam ring 53 start to rotate at the same time.

At time t5, the front end of the back inclined-portion 54*b* of the front cam ring 53 is on the inter-axle segment. At time t5', the front end of the back inclined-portion 54*b* of the rear cam ring 53 is on the inter-axle segment.

The cam rings 53 rotate from time t5 to time t6, and at time t6, the front ends of the front inclined-portions 54*a* of the front cam ring 53 and the rear cam ring 53 are on the inter-axle segment. At time t6, the cam radius of the front cam ring 53 is d-cf1, and the cam radius of the rear cam ring 53 is d-cr1.

The cam rings 53 rotate further from time t6 to time te1, and at time te1, the back end of the recording sheet P arrives at the nipping portion, and the distance from the center of the secondary transfer roller axles 15*a* to the surface of the opposite roller 9 is d-cf1.

The cam rings 53 rotate from time te1 to time t7, and at time t7, the back ends of the back inclined-portions 54*b* of the front cam ring 53 and the rear cam ring 53 are on the inter-axle segment.

The cam rings 53 rotate from time t7 to time t8, and at time t8, the front end of the back inclined-portions 54*b* of the front cam ring 53 is on the inter-axle segment. At time t8, the cam radius of the front cam ring 53 is d-cf0. At time t8', the front end of the back inclined-portion 54*b* of the rear cam ring 53 is on the inter-axle segment. At time t8', the gap of the nipping portion is reduced to zero, and the cam radius of the rear cam ring 53 is d-cr0.

Then, the latch claws 57 latch the rotation stopping claws 52, and the cam rings 53 are at rest without rotation, namely, in the standby state.

In the embodiment shown in FIG. 2, after the toner image is transferred to the recording sheet P by the secondary transfer, the toner image is heated and fused by another pair of fusing rollers 14 provided downstream in the conveyance direction. Different from the above embodiment, below, another embodiment is explained with reference to FIG. 34 trough FIG. 38, in which a transfer and fusing unit is used to transfer and fuse a toner image onto a recording sheet at the same time.

Here, the transfer and fusing unit is a device for transferring an image formed on the surface of an image carrier to a recording sheet and fusing the image on the recording sheet. The cam member rotates with respect to a rotational axis of the transfer and fusing unit, and according to the rotational position of the cam member, the cam member increases the gap of the nipping portion between the image carrier and the transfer and fusing unit, or reduces the gap of the nipping portion to bring the image carrier and the transfer and fusing unit into contact.

Figure 34:
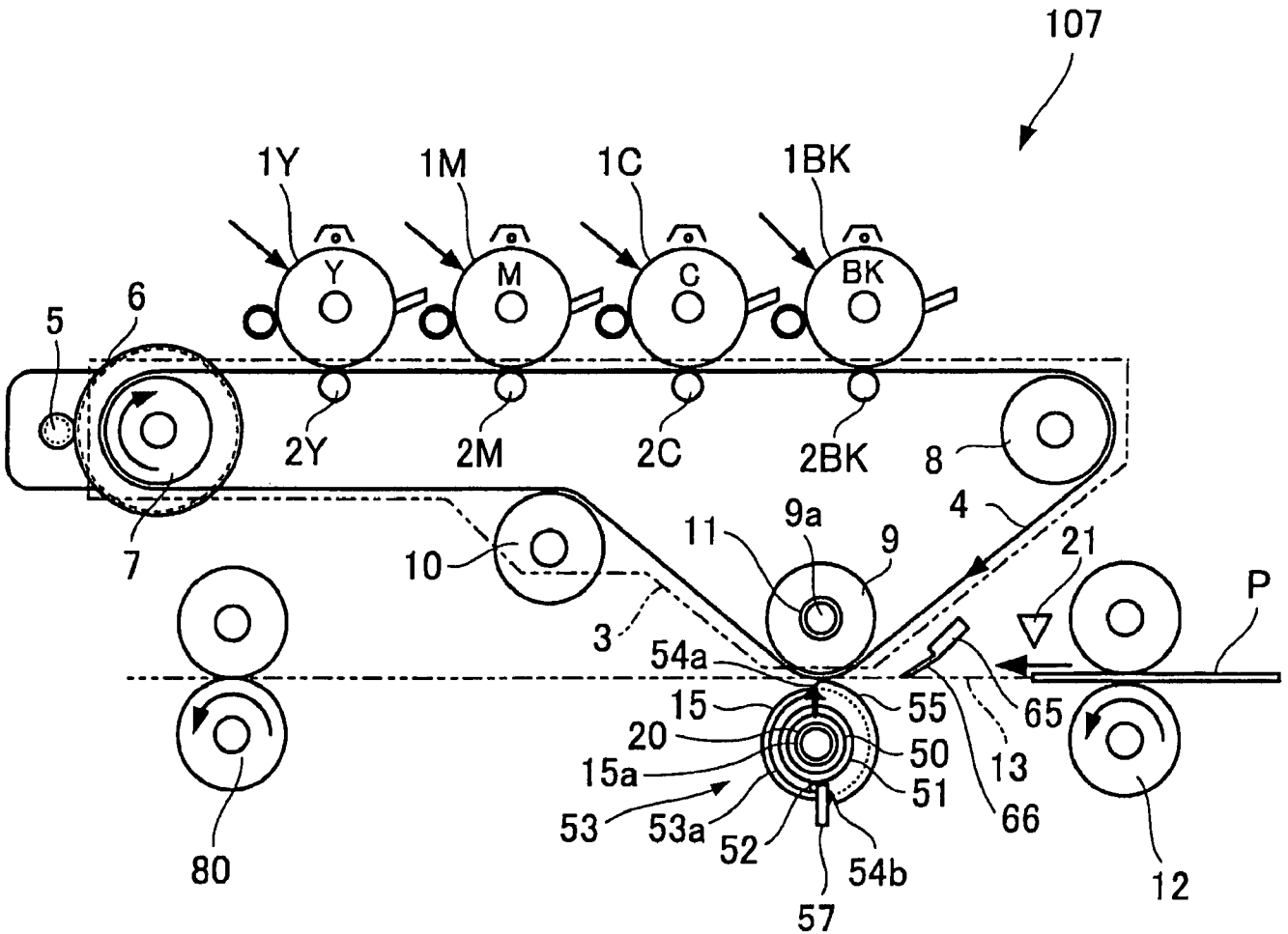
FIG. 34 is a schematic diagram of the intermediate transfer unit 107 of the image forming device according to another embodiment of the present invention.

FIG. 34 is a schematic diagram of the intermediate transfer unit 107 of the image forming device according to another embodiment of the present invention.

The intermediate transfer unit 107 shown in FIG. 34 is different from the intermediate transfer unit 107 in FIG. 2 in that the transfer unit of the intermediate transfer unit 107 in FIG. 2 is replaced by a transfer and fusing unit.

As shown in FIG. 34, the intermediate transfer unit 107 includes a heating unit having a heater 65, and a heat-transmission sheet 66 for transferring heat of the heater 65 to the transfer surface of the recording sheet P while being in contact with the recording sheet P. The heating unit is provided between the pair of the resisting rollers 12 and the opposite roller 9. In this embodiment, the transfer and fusing unit includes the heating unit and the secondary transfer roller 15.

The toner image is continuously transferred onto the recording sheet P, which is emitting heat, at the nipping portion between the opposite roller 9 and the secondary transfer roller 15, while the heating unit fuses the toner image. The temperature of the heater 65 and heated air are specified so that the toner image is softened and can be fused onto the heated recording sheet P.

Since the materials and properties of the secondary transfer roller 15 should be selected so that transfer and fusing can be performed at the same nipping position, the materials of the secondary transfer roller 15 may be different from the materials of the secondary transfer roller 15 shown in FIG. 2.

Preferably, the heat-transmission sheet 66 is formed from metals having a high heat transfer rate, such as copper, aluminum. Considering corrosion resistance and abrasion resistance, it is preferable to use stainless. For close contact with the recording sheet, it is preferable that the thickness of the heat-transmission sheet 66 be about 0.2 mm in order to ensure flexibility.

The opposite roller 9 and the secondary transfer roller 15 shown in FIG. 34 include opposite roller side rings 9*b*, which are located at two ends of the opposite roller 9 and rotate and slide with respect to the same axis of the opposite roller axle 9*a*, and the cam rings 53, which face the opposite roller side rings 9*b* and rotate and slide with respect to the same axis of the secondary transfer roller axle 15*a*. The cam rings 53 are arranged at the two ends of the secondary transfer roller 15, which is not in contact with the recording sheet P.

The cam rings 53 correspond to the cam member in claims; however, the cam member of the present invention is not limited to this, but can be any device able to rotate with respect to the same rotational axis of the transfer and fusing unit so as to increase the gap of the nipping portion.

In addition, FIG. 34 shows a pair of paper delivery rollers 80 for delivering the recording sheet.

Figure 35:
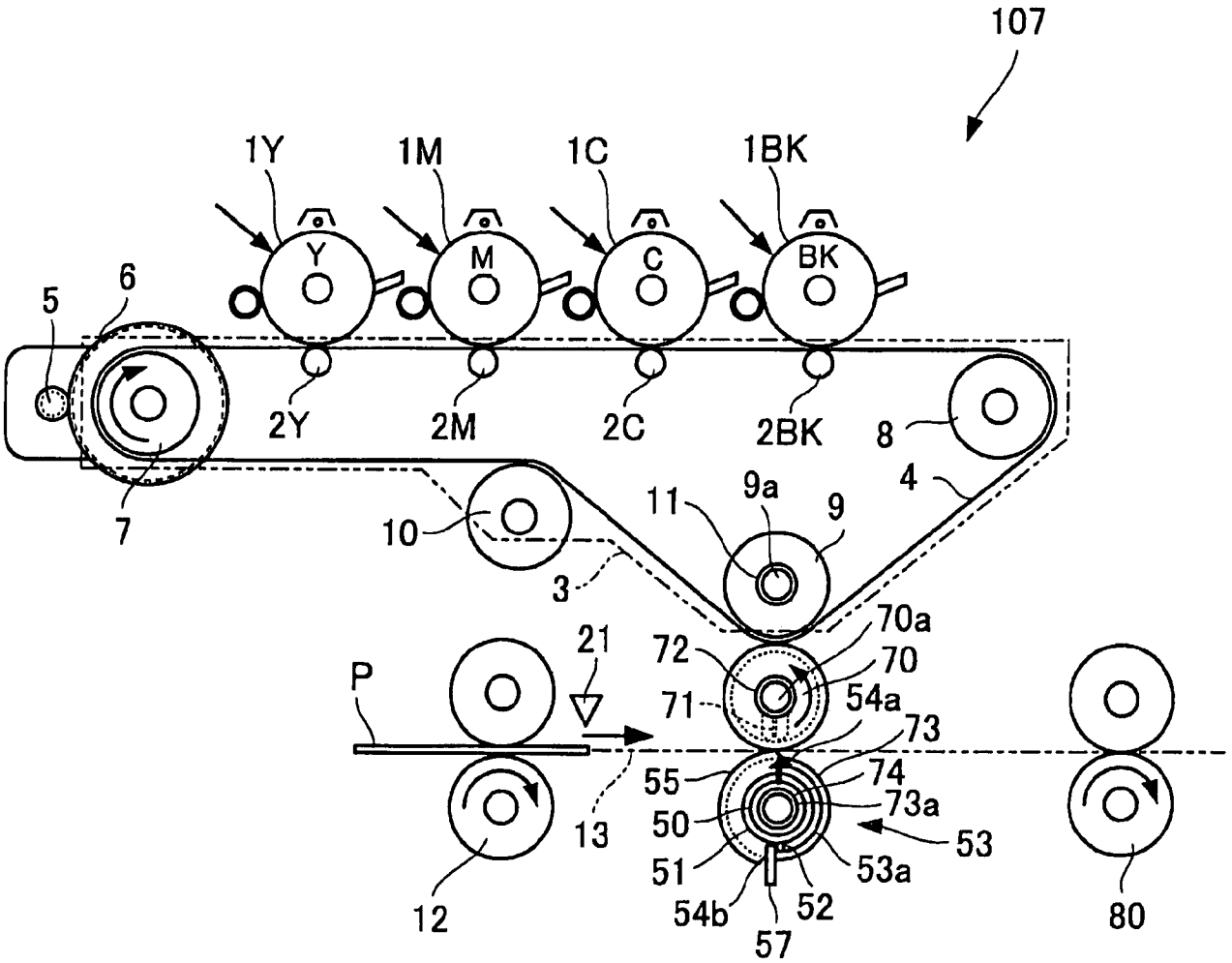
FIG. 35 is a schematic diagram of the intermediate transfer unit 107 of the image forming device according to another embodiment of the present invention.

FIG. 35 is a schematic diagram of the intermediate transfer unit 107 of the image forming device according to another embodiment of the present invention.

The intermediate transfer unit 107 shown in FIG. 35 is different from the intermediate transfer unit 107 in FIG. 2 in that the transfer unit of the intermediate transfer unit 107 in FIG. 2 is replaced by a transfer and fusing unit.

In the embodiment of the intermediate transfer unit 107 shown in FIG. 35, a third transfer and fusing roller 70 is provided between the opposite roller 9 and a transfer-fusing-pressing roller 73, which corresponds to the secondary transfer roller 15.

The third transfer and fusing roller 70 transfers (referred to as "third transfer") the toner image carried by the intermediate transfer belt 4 extended by the opposite roller 9 as shown in FIG. 2, softens the toner by a built-in fusing heater 71, is brought into contact with the transfer-fusing-pressing roller 73 located downstream in the conveyance direction, and transfers the toner image, at the nipping position, onto the recording sheet P conveyed by the resisting rollers 12, while heating the toner image. In this embodiment, the transfer and fusing unit includes the fusing heater 71 and the transfer-fusing-pressing roller 73.

Figure 36:
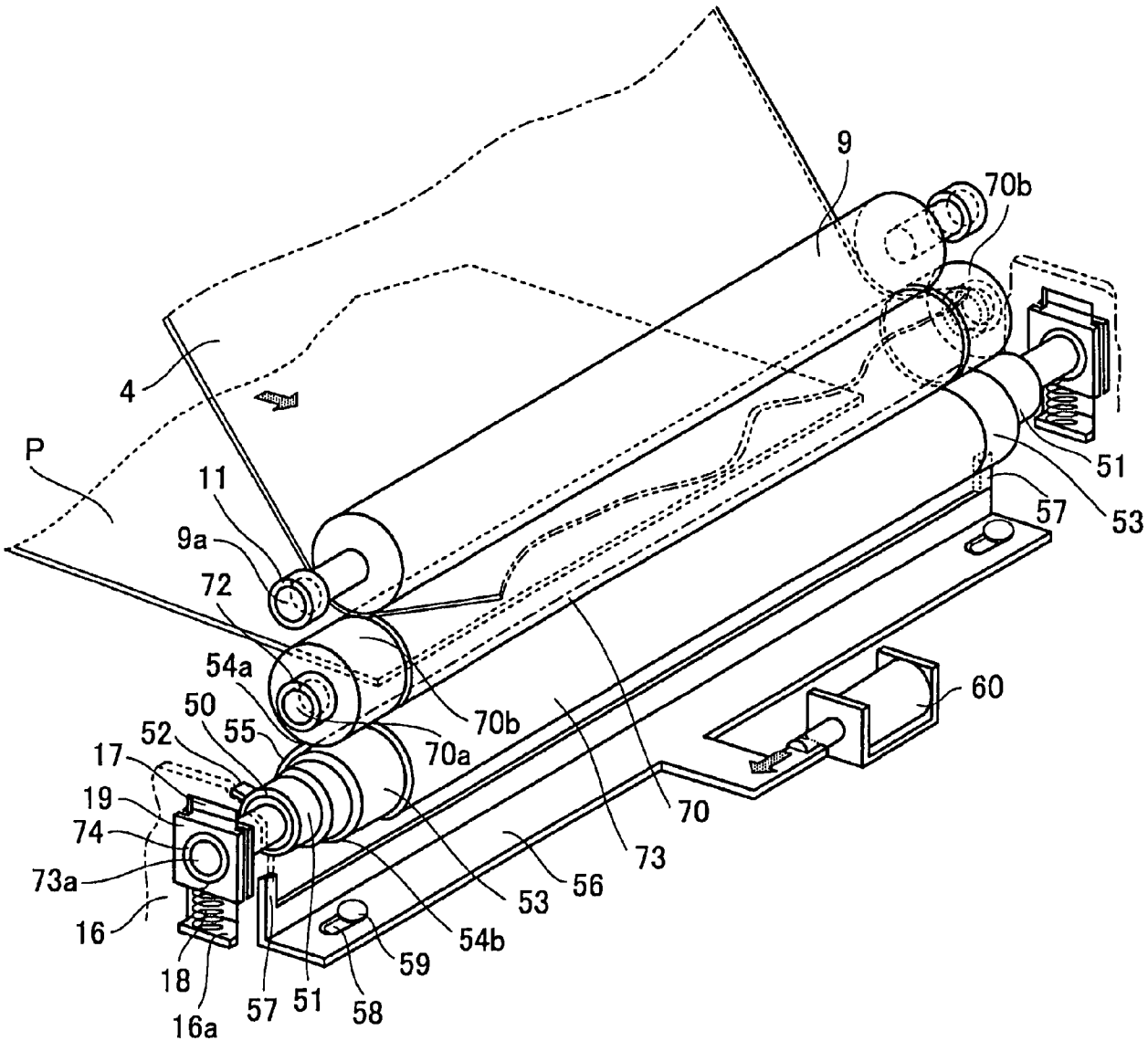
FIG. 36 is a perspective view illustrating a portion of the intermediate transfer unit 107 shown in FIG. 35 including the opposite roller 9, the transfer-fusing pressing roller 73, the third transfer and fusing roller 70.

FIG. 36 is a perspective view illustrating a portion of the intermediate transfer unit 107 shown in FIG. 35 including the opposite roller 9, the transfer-fusing-pressing roller 73, and the third transfer and fusing roller 70.

The third transfer and fusing roller 70 includes third transfer and fusing roller side rings 70*b*, which are located at the two ends of the third transfer and fusing roller 70 and rotate and slide with respect to the same axis of an axle 70*a* of the third transfer and fusing roller 70.

The transfer-fusing-pressing roller 73 includes cam rings 53, which face the third transfer and fusing roller side rings 70*b*, and rotate and slide with respect to the same axis of an axle 73*a* of the transfer-fusing-pressing roller 73. The cam rings 53 are arranged at the two ends of the transfer-fusing-pressing roller 73, which is not in contact with the recording sheet P.

The cam rings 53 corresponds to the cam member in claims; however, the cam member of the present invention is not limited to this, but can be any device able to rotate with respect to the same rotational axis of the transfer and fusing unit, such as the transfer-fusing-pressing roller 73, so as to increase the gap of the nipping portion.

Figure 37:
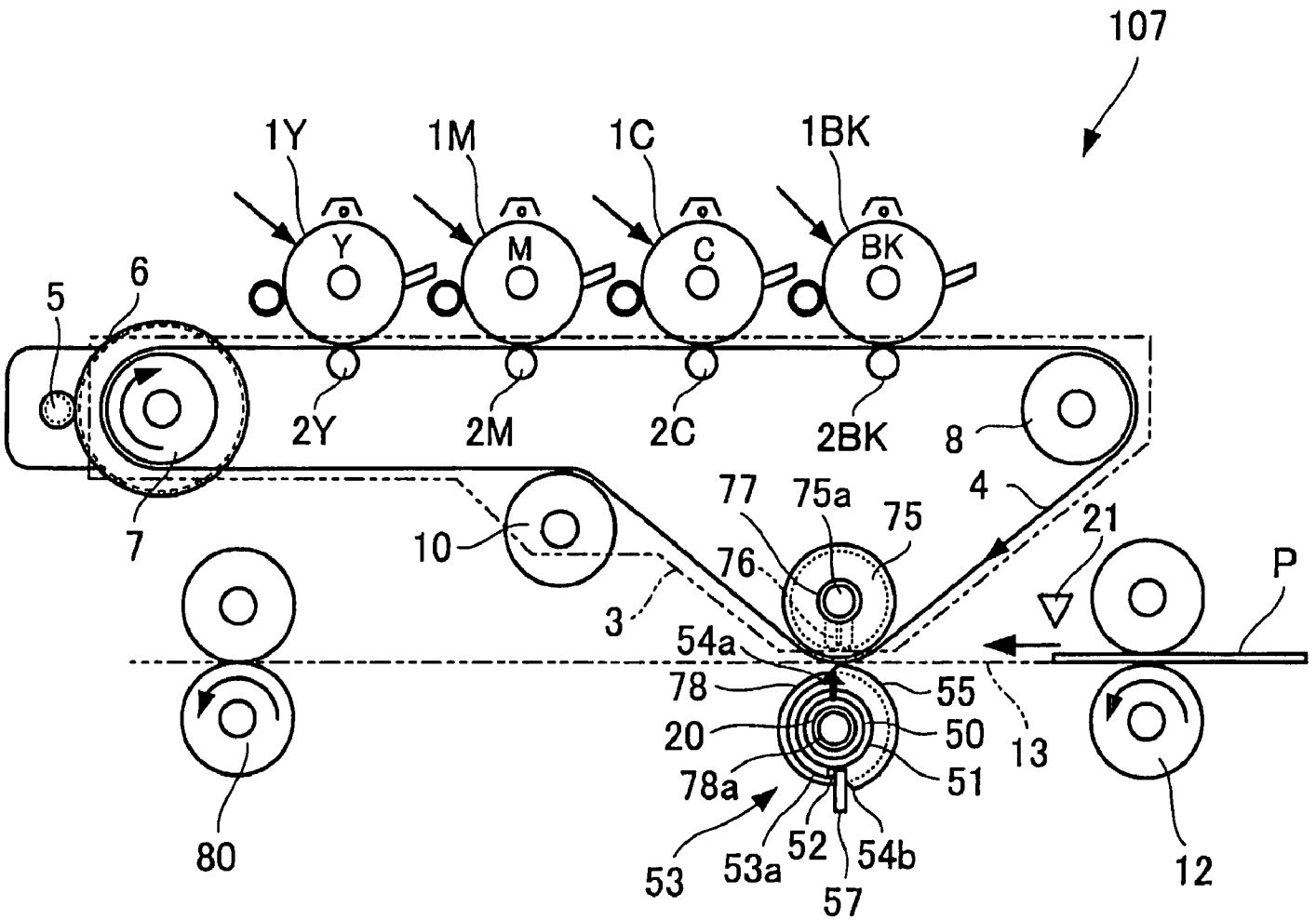
FIG. 37 is a schematic diagram of the intermediate transfer unit 107 of the image forming device according to another embodiment of the present invention.

FIG. 37 is a schematic diagram of the intermediate transfer unit 107 of the image forming device according to another embodiment of the present invention.

In the intermediate transfer unit 107 shown in FIG. 37, the opposite roller 9 as shown in FIG. 2 is replaced by a transfer-fusing opposite roller 75, which has a built-in fusing heater 76.

In the embodiment of the intermediate transfer unit 107 shown in FIG. 37, the fusing heater 76 softens the toner, and at a nipping position where the transfer-fusing opposite roller 75 and a secondary transfer and fusing roller 78 are in contact with each other, the transfer-fusing opposite roller 75 transfers the toner image onto the recording sheet P conveyed by the resisting rollers 12, while heating the toner image. In this embodiment, the transfer and fusing unit includes the fusing heater 76 and the secondary transfer-fusing roller 78.

Figure 38:
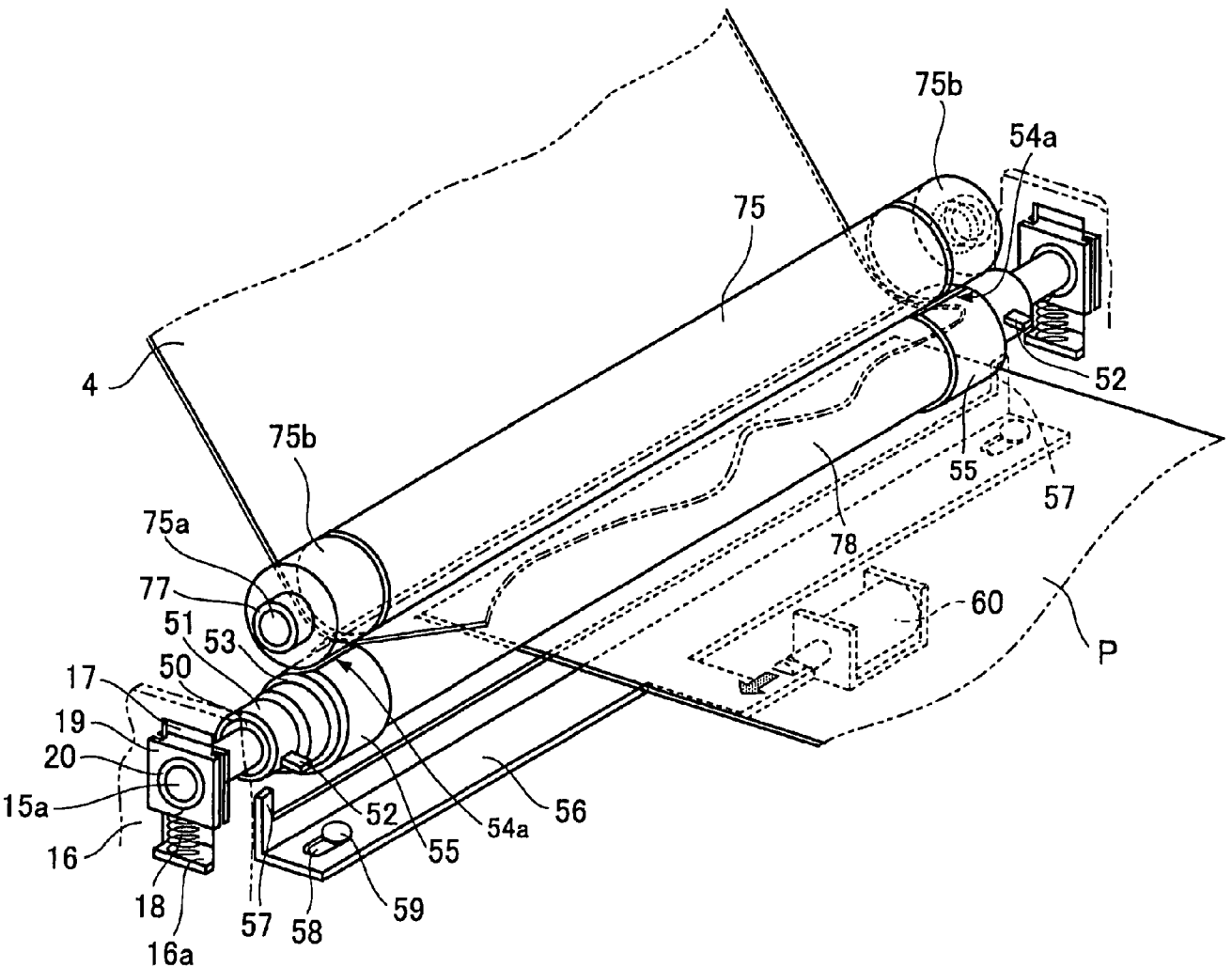
FIG. 38 is a perspective view illustrating a portion of the intermediate transfer unit 107 shown in FIG. 37 including the transfer-fusing opposite roller 75 and the secondary transfer-fusing roller 78.

FIG. 38 is a perspective view illustrating a portion of the intermediate transfer unit 107 shown in FIG. 37 including the transfer-fusing opposite roller 75 and the secondary transfer-fusing roller 78.

The transfer-fusing opposite roller 75 includes transfer-fusing opposite roller side rings 75*b*, which are located at the two ends of the transfer-fusing opposite roller 75 and rotate and slide with respect to the same axis of an axle 75*a* of the transfer-fusing opposite roller 75.

The secondary transfer-fusing roller 78 includes cam rings 53, which face the transfer-fusing opposite roller side rings 75*b*, and rotate and slide with respect to the same axis of an axle 78*a* of the secondary transfer-fusing roller 78. The cam rings 53 are arranged at the two ends of the secondary transfer-fusing roller 78, which is not in contact with the recording sheet P.

The cam rings 53 corresponds to the cam member in claims; however, the cam member of the present invention is not limited to this, but can be any device able to rotate with respect to the same rotational axis of the transfer and fusing unit, such as the secondary transfer-fusing roller 78, so as to increase the gap of the nipping portion.

According to the above embodiments of the present invention, when the thickness of the recording sheet being conveyed is greater than a predetermined threshold value, control of motion imposed by the rotation stopping claws 52 is released, the rotation stopping claws 52 and the cam rings 53 are driven, and the cam rings 53 rotate to enlarge the gap of the nipping portion; therefore, it is possible to enlarge the gap of a nipping portion with a mechanism having a simple and inexpensive structure, and to reduce impact when the front end of the recording sheet runs into or when a back end of the recording sheet passes through the nipping portion. As a result, it is possible to smoothly convey the recording sheet, like paper, and form images of high quality.

In addition, in the embodiments of the present invention, when the cam rings 53 rotate to enlarge the gap of the nipping portion, the driving source is the intermediate transfer belt 4 or the secondary transfer roller 15, it is not necessary to provide a separate driving source. Since the torque limiters 50 serve as to transmit torque of the driving source, even when motion of the rotation stopping claws 52, which support the torque limiter holders 51 integrated with the cam rings 53, acting as the objects to be driven, is restricted by the latch claws 57, rotational motion of the intermediate transfer belt 4 and the secondary transfer roller 15 is not influenced.

The image forming device of the present invention is able to prevent a change of a rotational speed of an image carrying unit in response to the thickness of a recording sheet, and able to form images of high quality, and it is useful in an electrophotographic image forming device such as a copier, a printer, a facsimile machine, and others.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

This patent application is based on Japanese Priority Patent Application No. 2007-228005 filed on Sep. 3, 2007, the entire contents of which are hereby incorporated by reference.

What is claimed is:

1. An image forming device, comprising:

an image carrying unit that, while rotating, carries an image;

an image forming unit that forms the image on a surface of the image carrying unit;

a transfer unit that transfers the image formed on the surface of the image carrying unit to a recording sheet while rotating and being in contact with the image carrying unit;

a conveyance unit that conveys the recording sheet to a nipping portion between the image carrying unit and the transfer unit;

a determination unit that determines whether a thickness of the recording sheet conveyed by the conveyance unit is greater than a set threshold value; and a cam member that rotates with respect to a rotational axis of the transfer unit, and enlarges or reduces a gap of the nipping portion between the image carrying unit and the transfer unit according to a rotational position of the cam member, the cam member includes a first portion having a first external radius and a second portion having a second external radius, the first external radius being greater than a radius of the transfer unit with the rotational axis of the transfer unit as a center, the second external radius being equal to or less than the radius of the transfer unit with the rotational axis of the transfer unit as a center, wherein an outside surface of the cam member includes a surface of the first portion, a surface of the second portion, and an inclined surface joining an end of the surface of the first portion and an end of the surface of the second portion, the inclined surface portion is formed from an elastic material having low resilience, and wherein when the determination unit determines that the thickness of the recording sheet is greater than the set threshold value, the cam member rotates so that the gap of the nipping portion is enlarged.

2. The image forming device as claimed in claim 1, wherein the first portion is formed from a material having a Young's modulus greater than a Young's modulus of the inclined surface portion.

3. The image forming device as claimed in claim 1, wherein the cam member is provided on a portion of the transfer unit not contacting the recording sheet.

4. The image forming device as claimed in claim 3, wherein plural of the cam members are provided on two ends of the transfer unit, respectively, and the cam members on the two ends of the transfer unit rotate at the same speed.

5. The image forming device as claimed in claim 4, wherein the cam members on the two ends of the transfer unit have the same first portion, the same first external radius, the same second portion, the same second external radius, and the cam members rotate so that rotational phases of the first portions of the cam members are the same.

6. The image forming device as claimed in claim 4, wherein the cam members on the two ends of the transfer unit have the same first portion, the same first external radius, the same second portion, and the same second external radius, and the cam members rotate so that rotational phases of the first portions of the cam members differ from each other.

7. The image forming device as claimed in claim 4, wherein the cam members on the two ends of the transfer unit have the same first portion, the same first external radius, and the same second external radius, the second portions of the cam members have different lengths, and the cam members rotate so that rotational phases of the first portions of the cam members are the same.

8. The image forming device as claimed in claim 4, wherein the cam members on the two ends of the transfer unit have the same first external radius, the same second external radius, and the same second portion, the first portions of the cam members have different lengths, and the cam members rotate so that rotational phases of the second portions of the cam members are the same.

9. The image forming device as claimed in claim 4, wherein the cam members on the two ends of the transfer unit have the same second external radius and the same second portion, the first external radii of the first portions of the cam members are different from each other, the first portions of the cam members have different lengths, and the cam members rotate so that rotational phases of the second portions of the cam members are the same.

10. The image forming device as claimed in claim 4, wherein the cam members on the two ends of the transfer unit have the same second external radius, the first external radii of the first portions of the cam members are different from each other, the first portions of the cam members have different lengths, the second portions of the cam members have different lengths, and the cam members rotate so that rotational phases of the first portions of the cam members are the same.

11. An image forming device, comprising:

an image carrying unit that, while rotating, carries an image;

an image forming unit that forms the image on a surface of the image carrying unit;

a transfer and fusing unit that transfers an image formed on the surface of the image carrying unit to a recording sheet while rotating and being in contact with the image carrying unit, and fuses the image on the recording sheet;

a conveyance unit that conveys the recording sheet to a nipping portion between the image carrying unit and the transfer and fusing unit;

a determination unit that determines whether a thickness of the recording sheet conveyed by the conveyance unit is greater than a set threshold value; and a cam member that rotates with respect to a rotational axis of the transfer and fusing unit, and enlarges or reduces the gap of the nipping portion between the image carrying unit and the transfer and fusing unit according to a rotational position of the cam member, the cam member includes a first portion having a first external radius and a second portion having a second external radius, the first external radius being greater than a radius of the transfer and fusing unit with the rotational axis of the transfer and fusing unit as a center, the second external radius being equal to or less than the radius of the transfer and fusing unit with the rotational axis of the transfer and fusing unit as a center, wherein an outside surface of the cam member includes a surface of the first portion, a surface of the second portion, and an inclined surface joining an end of the surface of the first portion and an end of the surface of the second portion, the inclined surface portion is formed from an elastic material having low resilience, and wherein when the determination unit determines that the thickness of the recording sheet is greater than the set threshold value, the cam member rotates so that a gap of the nipping portion is enlarged.

* * * * *